US011408061B2

(12) United States Patent
De Luca et al.

(10) Patent No.: US 11,408,061 B2
(45) Date of Patent: Aug. 9, 2022

(54) HIGH TEMPERATURE, CREEP-RESISTANT ALUMINUM ALLOY MICROALLOYED WITH MANGANESE, MOLYBDENUM AND TUNGSTEN

(71) Applicants: Ford Global Technologies, LLC, Dearborn, MI (US); Northwestern University, Evanston, IL (US)

(72) Inventors: Anthony De Luca, Dübendorf (CH); David N. Seidman, Skokie, IL (US); David C. Dunand, Evanston, IL (US); James M. Boileau, Novi, MI (US); Bita Ghaffari, Ann Arbor, MI (US)

(73) Assignees: Ford Global Technologies, LLC, Dearborn, MI (US); Northwestern University, Evanston, IL (US)

( * ) Notice: Subject to any disclaimer, the term of this patent is extended or adjusted under 35 U.S.C. 154(b) by 370 days.

(21) Appl. No.: 16/590,094

(22) Filed: Oct. 1, 2019

(65) Prior Publication Data

US 2021/0095365 A1 Apr. 1, 2021

(51) Int. Cl.
*C22F 1/04* (2006.01)
*C22C 21/00* (2006.01)

(52) U.S. Cl.
CPC ..... *C22F 1/04* (2013.01); *C22C 21/00* (2013.01)

(58) Field of Classification Search
CPC ..... C22F 1/04; C22C 21/00
See application file for complete search history.

(56) References Cited

U.S. PATENT DOCUMENTS

| | | | |
|---|---|---|---|
| 3,198,676 | A | 8/1965 | Sprawls et al. |
| 5,529,642 | A | 6/1996 | Sugahara et al. |
| 9,453,272 | B2 | 9/2016 | Vo et al. |
| 9,551,050 | B2 | 1/2017 | Huskamp et al. |
| 9,797,030 | B2 | 10/2017 | Huskamp et al. |

(Continued)

FOREIGN PATENT DOCUMENTS

CN 105483455 4/2016

OTHER PUBLICATIONS

De Luca, et al., Mechanical properties and optimization of the aging of a dilute Al—Sc—Er—Zr—Si alloy with a high Zr/Sc ratio, Acta Materialia, 2016, pp. 35-42, vol. 119, Elsevier Ltd.

(Continued)

*Primary Examiner* — Anthony M Liang
*Assistant Examiner* — Danny N Kang
(74) *Attorney, Agent, or Firm* — Burris Law, PLLC

(57) ABSTRACT

A high temperature creep-resistant aluminum alloy microalloyed with manganese and molybdenum and/or tungsten is provided. The aluminum alloy includes scandium, zirconium, erbium, silicon, at least one of molybdenum and tungsten, manganese and the balance aluminum and incidental impurities. The concentration of the alloying elements, in atom %, is greater than 0.0 and less than or equal to 0.15 scandium, greater than 0.0 and less than or equal to 0.35 zirconium, greater than 0.0 and less than or equal to 0.15 erbium, greater than 0.0 and less than or equal to 0.2 silicon, greater than 0.0 and less or equal to 0.75 molybdenum when included, greater than 0.0 and less than or equal to 0.35 tungsten when included, and greater than 0.0 and less than or equal to 1.5 manganese. And the total concentration of Zr+Er+Sc is greater than or equal to 0.1.

15 Claims, 17 Drawing Sheets

(56) References Cited

U.S. PATENT DOCUMENTS

| | | | | |
|---|---|---|---|---|
| 9,803,296 | B2 | 10/2017 | Garnier | |
| 9,945,018 | B2 | 4/2018 | Krishnamurthy | |
| 9,970,494 | B2 | 5/2018 | Bertoldo | |
| 2017/0101703 | A1* | 4/2017 | Apelian | C22F 1/04 |

OTHER PUBLICATIONS

De Luca, et al., Microstructure and mechanical properties of a precipitation-strengthened Al—Zr—Sc—Er—Si alloy with a very small Sc content, Acta Materialia, 2018, pp. 80-91, vol. 144, Elsevier Ltd.
Vo, et al., Improving aging and creep resistance in a dilute Al—Sc alloy by microalloying with Si, Zr and Er, Acta Materialia, 2014, pp. 73-85, vol. 63, Elsevier Ltd.
Vo, et al., Role of silicon in the precipitation kinetics of dilute Al—Sc—Er—Zr alloys, Materials Science and Engineering A, 2016, pp. 485-495, vol. 677, Elsevier B.V.
Booth-Morrison, et al., Coarsening resistance at 400° C of precipitation-strengthened Al—Zr—Sc—Er alloys, Acta Materialia, 2011, pp. 7029-7042, vol. 59, Elsevier Ltd.
Knipling, et al., Nucleation and Precipitation Strengthening in Dilute Al—Ti and Al—Zr Alloys, Metallurgical and Materials Transactions A, 2007, pp. 2552-2563, vol. 38A, The Minerals, Metals & Materials Society and ASM International.
Knipling, et al., Precipitation evolution in Al—Zr and Al—Zr—Ti alloys during isothermal aging at 375-425° C, Acta Materialia, 2008, pp. 114-127, vol. 56, Elsevier Ltd.
Knipling, et al., Precipitation evolution in Al—Zr and Al—Zr—Ti alloys during aging at 450-600° C, Acta Materialia, 2008, pp. 1182-1195, vol. 56, Elsevier Ltd.
Erdeniz, et al., Effect of vanadium micro-alloying on the microstructural evolution and creep behavior of Al—Er—Sc—Zr—Si alloys, Acta Materialia, 2017, pp. 501-512, vol. 124, Elsevier Ltd.
Krug, et al., Composition profiles within Al3Li and Al3Sc/Al3Li nanoscale precipitates in aluminum, Applied Physics Letters, 2008, pp. 124107-124107-3, vol. 92, American Institute of Physics.
Krug, et al., Effects of Li additions on precipitation-strengthened Al—Sc and Al—Sc—Yb alloys, Acta Materialia, 2011, pp. 1700-1715, vol. 59, Elsevier Ltd.
Yang, et al., The influence of Sc solute partitioning on the microalloying effect and mechanical properties of Al—Cu alloys with minor Sc addition, Acta Materialia, 2016, pp. 68-79, vol. 119, Elsevier Ltd.
Farkoosh, et al., Dispersoid strengthening of a high temperature Al—Si—Cu—Mg alloy via Mo addition, Materials Science and Engineering A, 2015, pp. 181-189, vol. 620, Elsevier B.V.
Booth-Morrison, et al., Role of silicon in accelerating the nucleation of AI3(Sc,Zr) precipitates in dilute Al—Sc—Zr alloys, Acta Materialia, 2012, pp. 4740-4752, vol. 60, Elsevier Ltd.
Ryen, et al., Strengthening Mechanisms in Solid Solution Aluminum Alloys, Metallurgical and Materials Transactions A, 2006, pp. 1999-2006, vol. 37A.
Li, et al., Precipitation crystallography of plate-shaped Al6(Mn,Fe) dispersoids in AA5182 alloy, Acta Materialia, 2012, pp. 5963-5974, vol. 60, Elsevier Ltd.
Feufel, et al., Investigation of the Al—Mg—Si system by experiments and thermodynamic calculations, Journal of Alloys and Compounds, 1997, pp. 31-42, vol. 247, Elsevier Science S.A.
Jia, et al., Effect of homogenization and alloying elements on recrystallization resistance of Al—Zr—Mn alloys, Materials Science and Engineering A, 2007, pp. 284 290, vol. 444, Elsevier B.V.
Knipling, et al., Criteria for developing castable, creep-resistant aluminum-based alloys—A review, Zeitschrift fuer Metallkunde/Materials Research and Advanced Techniques, 2006, pp. 246-265, vol. 97, Carl Hanser Verlag, München.
Du, et al., Reassessment of the Al—Mn system and a thermodynamic description of the Al—Mg—Mn system, Abstract in the International Journal of Materials Research, Sep. 2007, pp. 855-871, vol. 98(9), doi:10.3139/146.101547.
Sugiyama, et al., Refinement of a—(AlMnSi), Acta Crystallographica Section C, 1998, vol. 54, pp. 445-447, available at doi: 10.1107/S0108270197015989.
Wen, et al., Synergetic effect of Er and Zr on the precipitation hardening of Al—Er—Zr alloy, Scripta Materialia, 2011, pp. 592-595, vol. 65, Elsevier Ltd.
Michi, et al., Effects of Si and Fe micro-additions on the aging response of a dilute Al-0.08Zr-0.08Hf-0.045Er at.% alloy, Materials Characterization, 2019, pp. 72-83, vol. 147, Elsevier Inc.
Farkoosh, A.R., Development of Creep-Resistant Al—Si Cast Alloys Strengthened with Nanoscale Dispersoids, McGill University, 2014.
Lagneborg, et al., The stress/creep rate behaviour of precipitation-hardened alloys, Metal Science, 1976, pp. 20-28, vol. 10(1), Taylor & Francis Group.
Erdeniz et al., Effects of Nb and Ta additions on the strength and coarsening resistance of precipitation-strengthened Al—Zr—Sc—Er—Si alloys, Materials Characterization, 2018, pp. 260-266, vol. 141, Elsevier Inc.
Karnesky, et al., Evolution of nanoscale precipitates in Al microalloyed with Sc and Er, Acta Materialia, 2009, pp. 4022-4031, vol. 57, Elsevier Ltd.
Hosford, et al., Effect of Stress During Aging on the Precipitation of 0' in Al-4 Wt PCT Cu, Metallurgical Transactions A, 1975, pp. 487-491, vol. 6A.
Burton, B., On the Mechanism of the Inhibition of Diffusional Creep by Second Phase Particles, Materials Science and Engineering, 1973, pp. 337-343, vol. 11, American Society for Metals, Metals Park, Ohio, and Elsevier Sequoia S.A., Lausanne.
Kang, et al., Effects of homogenization treatments on the microstructure evolution, microhardness and electrical conductivity of dilute Al—Sc—Zr—Er alloys, Journal of Alloys and Compounds, 2017, pp. 683-692, vol. 704, Elsevier B.V.
Liu, et al., Enhanced elevated-temperature properties via Mo addition in Al—Mn—Mg 3004 alloy, Journal of Alloys and Compounds, 2017, pp. 354-365, vol. 694, Elsevier B.V.
Liu, et al., Progress on phase equilibria of the Al—Si—Zr system at 700 and 900° C, Journal of Alloys and Compounds, 2017, pp. 357-365, vol. 693, Elsevier B.V.
Chen, et al., Assessments of Sc—Containing Ternary Systems Al—Sc—Ti and Al—Sc—Zr Within the Thermodynamic Database for Aluminium Alloys, TCAL5, in Light Metals 2018, The Minerals, Metals & Materials Series, (ed.) O. Martin, pp. 347-353, The Minerals, Metals & Materials Society.
Nic, et al., Site occupancy in ternary L12 ordered alloys as determined by diffraction: observations on (Al,Cr)3 Ti alloys, Intermetallics, 1999, pp. 39-47, vol. 7, Elsevier Science Ltd.
Mabuchi, et al., Formation of structural LI2 compounds in TiAl3-base alloys containing Mn, Scripts Metallurgica, 1989, pp. 1761-1765, vol. 23, Pergamon Press plc.
Li, et al., Precipitation of partially coherent a—AI(Mn,Fe)Si dispersoids and their strengthening effect in AA 3003 alloy, Acta Materialia, 2012, pp. 1004-1014, vol. 60, Elsevier Ltd.
Lai, et al., The disorder-order transformation of C—Al(Mn, Fe)Si phase, Scripta Metallurgica et Materialia, 1993, pp. 395-900, vol. 29, Pergamon Press Ltd.
Cooper, et al., The crystal structure of the ternary alloy a(AlFeSi), Acta Crystallographica, 1967, pp. 1106-1107, vol. 23.
Li, et al., Quantitative study on the precipitation behavior of dispersoids in DC-cast AA3003 alloy during heating and homogenization, Acta Materialia, 2003, pp. 3415-3428, vol. 51, Elsevier Science Ltd.
Balitchev, et al., Thermodynamic assessment of the quaternary system Al—Fe—Mn—Si in the Al-rich corner, Computer Coupling of Phase Diagrams and Thermochemistry, 2003, pp. 275-278, vol. 27, Elsevier Ltd.
Kim, et al., Effects of Mn on the crystal structure of a—AI(Mn,Fe)Si particles in A356 alloys, Journal of Crystal Growth, 2006, pp. 207-211, vol. 291, Elsevier B.V.
Fuller, et al., Microstructure and mechanical properties of a 5754 aluminum alloy modified by Sc and Zr additions, Materials Science and Engineering A, 2002, pp. 8-16, vol. 338, Elsevier Science B.V.

(56) References Cited

OTHER PUBLICATIONS

Ikeshita, et al., Hardness and microstructural variation of Al—Mg—Mn—Sc—Zr alloy, Micron, 2016, pp. 1-8, vol. 82, Elsevier Ltd.
Vlach, et al., Phase transformations in isochronally annealed mould-cast and cold-rolled Al—Sc—Zr-based alloy, Journal of Alloys and Compounds, 2010, pp. 143-148, vol. 492, Elsevier B.V.
Vlach, et al., Characterization of phase development in non-isothermally annealed mould-cast and heat-treated Al—Mn—Sc—Zr alloys, Materials Characterization, 2010, pp. 1400-1405, vol. 61, Elsevier Inc.
Farkoosh, et al., Interaction between molybdenum and manganese to form effective dispersoids in an Al—Si—Cu—Mg alloy and their influence on creep resistance, Materials Science and Engineering A, 2015, pp. 127-138, vol. 627, Elsevier B.V.
Angermann, et al., Investigation of the aluminium-rich comer in the Al—Si—W phase diagram, Scripta Metallurgica et Materialia, 1995, pp. 1423-1428, vol. 32(9), Pergamon, Elsevier Science Ltd.
Fan, et al., Stabilizing the strengthening precipitates in aluminum-manganese alloys by the addition of tungsten, Materials Science and Engineering A, 2017, pp. 1-7, vol. 691, Elsevier B.V.
Stan-Glowinska, et al., Enhanced thermal stability of a quasicrystalline phase in rapidly solidified Al—Mn—Fe-X alloys, Journal of Alloys and Compounds, 2017, pp. 216-228, vol. 702, Elsevier B.V.
Stan, et al., Effect of Mo on stability of quasicrystalline phase in Al—Mn—Fe alloy, Journal of Alloys and Compounds, 2014, pp. S395-S399, vol. 586, Elsevier B.V.
Booth-Morrison, et al., Effect of Er additions on ambient and high-temperature strength of precipitation-strengthened Al—Zr—Sc—Si alloys, Acta Materialia, 2012,pp. 3643-3654, vol. 60, Elsevier Ltd.
Karnesky, etaL, Creep of Al—Sc Microalloys with Rare-Earth Element Additions, Materials Science Forum, 2006, pp. 1035-1040, vols. 519-521, Trans Tech Publications Ltd, Switzerland.
Hori, et al., Effects of small addition of Si on the precipitation of Al-0.6%Zr alloys, Journal of Japan Institute of Light Metals, 1978, pp. 78-84, vol. 28.
Clark, W.D., The aluminium-tungsten equilibrium diagram, Journal of the Institute of Metals, 1986, pp. 271-286, vol. 66.
Krug, et al., Comparison between dislocation dynamics model predictions and experiments in precipitation-strengthened Al—Li—Sc alloys, Acta Materialia, 2014, pp. 382-395, vol. 79, Elsevier Ltd.
Wang, et al., Thermodynamic re-assessment of the Al—Co—W system, Calphad, 2017, pp. 112-130, vol. 59, Elsevier Ltd.
Beeri, et al., Roles of impurities on precipitation kinetics of dilute Al—Sc alloys, Materials Science and Engineering A, 2010, pp. 3501-3509, vol. 527, Elsevier B.V.
Fujikawa, et al., Diffusion of Silicon in Aluminum, Metallurgical Transactions A, 1978, pp. 1811-1815, vol. 9A, American Society for Metals and The Metallurgical Society of AIME.
Zhang, et al., The study on the coarsening process and precipitation strengthening of Al3Er precipitate in Al—Er binary alloy, Journal of Alloys and Compounds, 2014, pp. 27-34, vol. 610, Elsevier B.V.
Krakauer, et al., A system for systematically preparing atom-probe field-ion-microscope specimens for the study of nternal interfaces, Review of Scientific Instruments, 1990, pp. 3390-3398, vol. 61, American Institute of Physics.
Krakauer, et al., Systematic procedures for atom-probe field-ion microscopy studies of grain boundary segregation, Review of Scientific Instruments, 1992, pp. 4071-4079, vol. 63, American Institute of Physics.
Seidman, D.N., Three-Dimensional Atom-Probe Tomography: Advances and Applications, Annual Review of Materials Research, 2007, pp. 127-158, vol. 37.
Kelly, et al., Atom probe tomography, Review of Scientific Instruments, 2007, pp. 031101-031101-20, vol. 78, American Institute of Physics.
Marquis, et al., Model for creep threshold stress in precipitation-strengthened alloys with coherent particles, Scripta Materialia, 2002, pp. 503-508, vol. 47, Elsevier Science Ltd.
Krug, et al., Modeling the creep threshold stress due to climb of a dislocation in the stress field of a misfitting precipitate, Acta Materialia, 2011, pp. 5125-5134, vol. 59, Elsevier Ltd.
Knipling, et al., Precipitation evolution in AI-0.1Sc, Al-0.1Zr and Al-0.1Sc-0.1Zr (at.%) alloys during isochronal aging, Acta Materialia, 2010, pp. 5184-5195, vol. 58, Elsevier Ltd.
Zhang, et al., General relationship between strength and hardness, Materials Science and Engineering A, 2011, pp. 62-73, vol. 529, Elsevier B.V.
Ardell, A.J., Precipitation Hardening, Metallurgical Transactions A, Dec. 1985, pp. 2131-2165, vol. 16A.
Gypen, et al., Multi-component solid solution hardening—part 1 Proposed model, Journal of Materials Science, 1977, pp. 1028-1033, vol. 12, Chapman and Hall Ltd., GB.
Fedorov, et al., pp. 210-212, Structure and properties of Al—W, Al—Mo, and Al—Nb alloys obtained from granules, All-Union Institute of Light Alloys, as translated from Metallovedenie i Termicheskaya Obrabotka Metallov, Mar. 1979, pp. 39-41, vol. 3, Plenum Publishing Corporation.

* cited by examiner

HIGH TEMPERATURE, CREEP-RESISTANT ALUMINUM ALLOY MICROALLOYED WITH MANGANESE, MOLYBDENUM AND TUNGSTEN

FIELD

The present disclosure relates to aluminum alloy and particularly to cast aluminum alloys.

BACKGROUND

The statements in this section merely provide background information related to the present disclosure and may not constitute prior art.

Aluminum alloys are used in a wide range of applications and components such as vehicle frames, pillars and wheels, among others. However, the maximum operational temperature of current aluminum alloys is limited to approximately 300° C. and use in engine components has been limited.

The present disclosure addresses the issues related to the use of aluminum alloys at high temperatures and other issues related to aluminum alloys.

SUMMARY

In one form of the present disclosure, an aluminum alloy includes scandium, zirconium, erbium, silicon, at least one of molybdenum and tungsten, manganese and the balance aluminum and incidental impurities. In one variation the concentration of the alloying elements, in atom % is greater than 0.0 and less than or equal to 0.15 scandium, greater than 0.0 and less than or equal to 0.35 zirconium, greater than 0.0 and less than or equal to 0.15 erbium, greater than 0.0 and less than or equal to 0.2 silicon, greater than 0.0 and less or equal to 0.75 molybdenum when included, greater than 0.0 and less than or equal to 0.35 tungsten when included, and greater than 0.0 and less than or equal to 1.5 manganese. In at least one variation the total concentration or content of Zr+Er+Sc in the aluminum alloy is greater than or equal to 0.1.

In some variations, the concentration of scandium is greater than 0.0 and less than or equal to 0.025, the concentration of zirconium is greater than 0.0 and less than or equal to 0.1, the concentration of erbium is greater than 0.0 and less than or equal to 0.01 and/or the concentration of silicon is greater than 0.0 and less than or equal to 0.1. When molybdenum is included, in one variation the concentration of molybdenum is greater than 0.0 and less than or equal to 0.2. When tungsten is included, in one variation the concentration of tungsten is greater than 0.0 and less than or equal to 0.05. In at least one variation the concentration of manganese is greater than 0.0 and less than or equal to 0.5.

In some variations, the aluminum alloy includes iron with a concentration, in atom %, of greater than 0.0 and less than or equal to 0.1. In one such variation, the concentration of iron is greater than 0.0 and less than or equal to 0.045.

In some variations of the present disclosure, the aluminum alloy has a concentration of scandium greater than 0.0 and less than or equal to 0.045, zirconium greater than 0.0 and less than or equal to 0.1, erbium greater than 0.0 and less than or equal to 0.07, silicon greater than 0.0 and less than or equal to 0.1, molybdenum greater than 0.0 and less or equal to 0.2, tungsten greater than 0.0 and less than or equal to 0.05, and manganese greater than 0.0 and less than or equal to 1.1. In addition, in one variation the aluminum alloy also includes a concentration of iron greater than 0.0 and less than or equal to 0.045, for example a concentration of iron greater than 0.0 and less than or equal to 0.02.

In some variations the aluminum alloy includes $L1_2$ precipitates and at least one of α-Al(Mn,M")Si precipitates, $Al_6Mn$ precipitates and $Al_{12}Mn$ precipitates where M" is at least one of Fe, Mn, Mo and W. Also, the $L1_2$ precipitates include $Al_3M$ precipitates where M is one or more rare earth elements, one or more early transition metals, or combinations thereof.

In another form of the present disclosure, a method of forming an aluminum alloy component includes melting and solidifying an aluminum alloy, solution treating the solidified aluminum alloy and aging the solution treated solidified aluminum alloy. In some variations, the aluminum alloy includes a concentration, in atom %, of scandium greater than 0.0 and less than or equal to 0.15, zirconium greater than 0.0 and less than or equal to 0.35, erbium greater than 0.0 and less than or equal to 0.15, silicon greater than 0.0 and less than or equal to 0.2, at least one of molybdenum greater than 0.0 and less or equal to 0.75 and tungsten greater than 0.0 and less than or equal to 0.35, manganese greater than 0.0 and less than or equal to 1.5 and the balance aluminum and incidental impurities. The solution treating of the aluminum alloy includes solution treating at a temperature greater than or equal to 620° C. and less than or equal to 650° C. for a time between 1 hours and 48 hours. And aging the solution treated solidified aluminum alloy includes aging at a temperature greater than or equal to 300° C. and less than or equal to 450° C. for a time between 1 hour and 264 hours. In some variations the aluminum alloy is solution treated a temperature greater than or equal to 620° C. and less than or equal to 650° C. for a time between 4 hours and 24 hours, for example for a time between 4 hours and 16 hours. In such variations, the aluminum alloy is aged at a temperature greater than or equal to 300° C. and less than or equal to 450° C. for a time between 1 hour and 168 hours, for example for a time between 1 hour and 48 hours.

In some variations of the present disclosure, the solution treated aluminum alloy includes $L1_2$ precipitates. In such variations the aged solution treated aluminum alloy includes at least one of α-Al(Mn,M")Si precipitates, $Al_6Mn$ precipitates and $Al_{12}Mn$ precipitates where M" is at least one of Fe, Mn, Mo and W.

In at least one variation the aluminum alloy has a concentration of scandium greater than 0.0 and less than or equal to 0.045, zirconium greater than 0.0 and less than or equal to 0.1, erbium greater than 0.0 and less than or equal to 0.07, silicon greater than 0.0 and less than or equal to 0.1, molybdenum greater than 0.0 and less or equal to 0.2, tungsten greater than 0.0 and less than or equal to 0.05, and manganese greater than 0.0 and less than or equal to 1.1. In such a variation, the aged and solution treated aluminum alloy includes $L1_2$ precipitates and at least one of α-Al(Mn, M")Si precipitates, $Al_6Mn$ precipitates and $Al_{12}Mn$ precipitates where M" is at least one of Fe, Mn, Mo and W.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which:

FIG. 1 is a series of scanning electron microscopy (SEM) images of Alloy 2 showing: (a) Alloy 2 in as-cast state with Er—Si-rich (type A) and Mn—Si—Fe-rich (type B) primary precipitates (the insets share the same scale bar); and (b) Alloy 2 after homogenization at 640° C. for 2 h (inset, at same magnification as the main micrograph), where the formation of large spherical precipitates, $Al_3M$-type, is observed and follow the dendritic distribution of solute atoms in the alloy (as demarcated by white dashed-lines in b);

FIG. 2 is a series Vickers microhardness plots as a function of aging time for: (a) Alloys 1, 2 and 3 aged at 400° C.; (b) Alloys 1, 2 and 3 aged at 425° C.; (c) Alloys 2 and 3, and an Al-0.0055Sc-0.005Er-0.02Zr-0.04Si alloy (similar to Alloy 1) aged at 450° C.; and (d) Alloy 2 aged at 400° C., 425° C. and 450° C.;

FIG. 3 is a series of atom-probe tomography (APT) reconstructions of: (a) Alloy 2 aged isothermally at 400° C. for 24 h; and (b) Alloy 2 aged isothermally at 400° C. for 11 days, with the images showing a 20 nm-thick slice of the volume and the isoconcentration surfaces implying a concentration of 3 at. % Sc+Er+Zr;

FIG. 4 is a series of concentration profiles across the matrix/$L1_2$-nanoprecipitate interface of Alloy 2 aged isothermally at 400° C. for the elements: (a) Zr, Sc, Er and Si after aging for 24 hours; (b) Mn and Mo after aging for 24 hours; (c) Zr, Sc, Er and Si after aging for 11 days; and (d) Mn and Mo after aging for 11 days;

FIG. 5 is an SEM micrograph of Alloy 2 aged at 400° C. for 11 days (the three scale bars are 10 μm);

FIG. 6 is a plot illustrating the yield stress increment vs. mean precipitate radius, ⟨R⟩ for Alloy 1 aged at 375° C. for 24 h or 21 days (open circles), Alloy 1 aged at 400° C. for 24 h or 11 days (solid circles), and Alloy 2 aged at 400° C. for 24 or 11 days (solid squares), with dotted lines representing the calculated predictions of the strength increment associated with ordering ($\Delta\sigma_{ord}$), coherency ($\Delta\sigma_{coh}$) and modulus ($\Delta\sigma_{mod}$) or Orowan ($\Delta\sigma_{oro}$);

Figure 11:
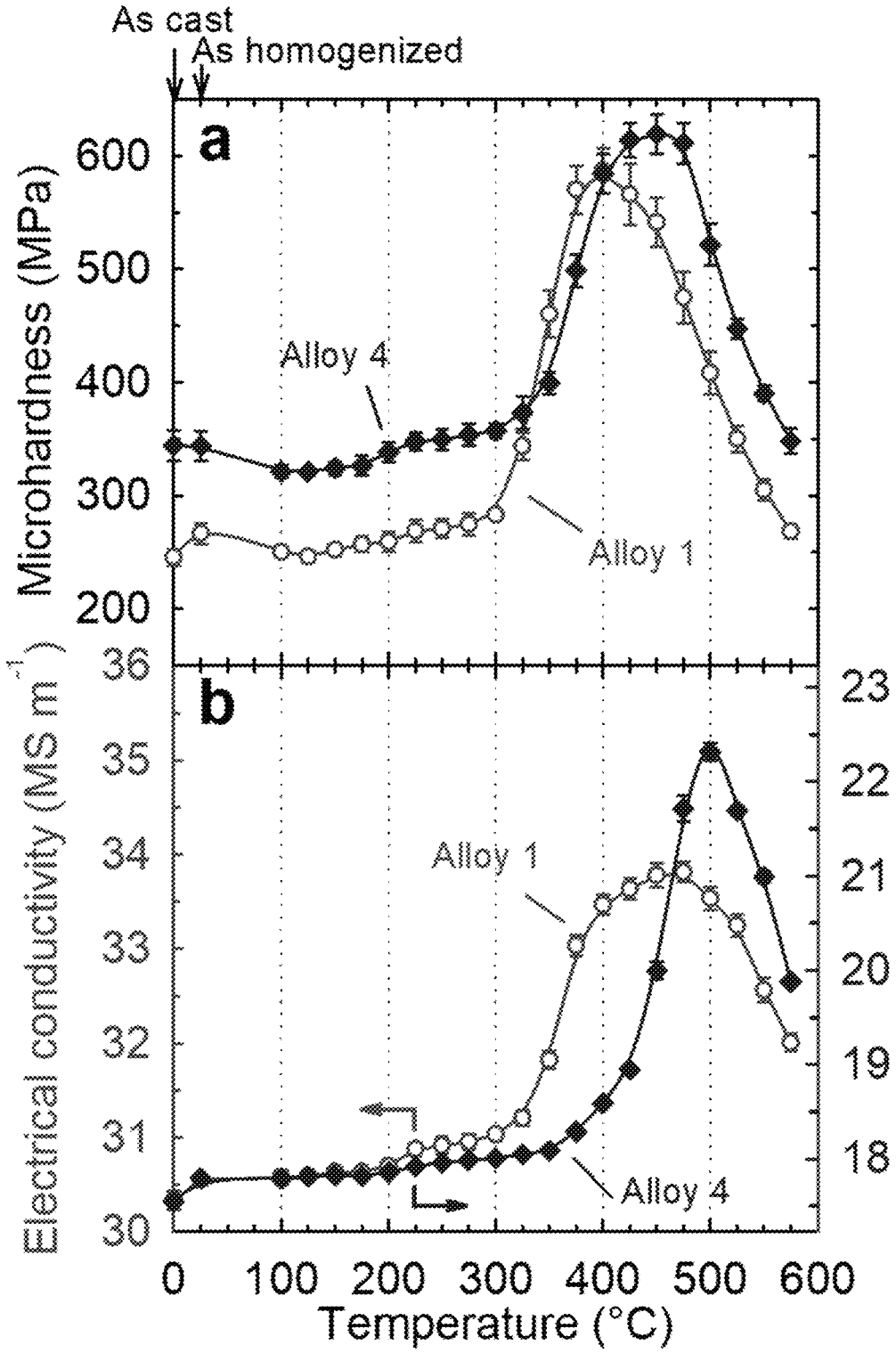
Figure 12:
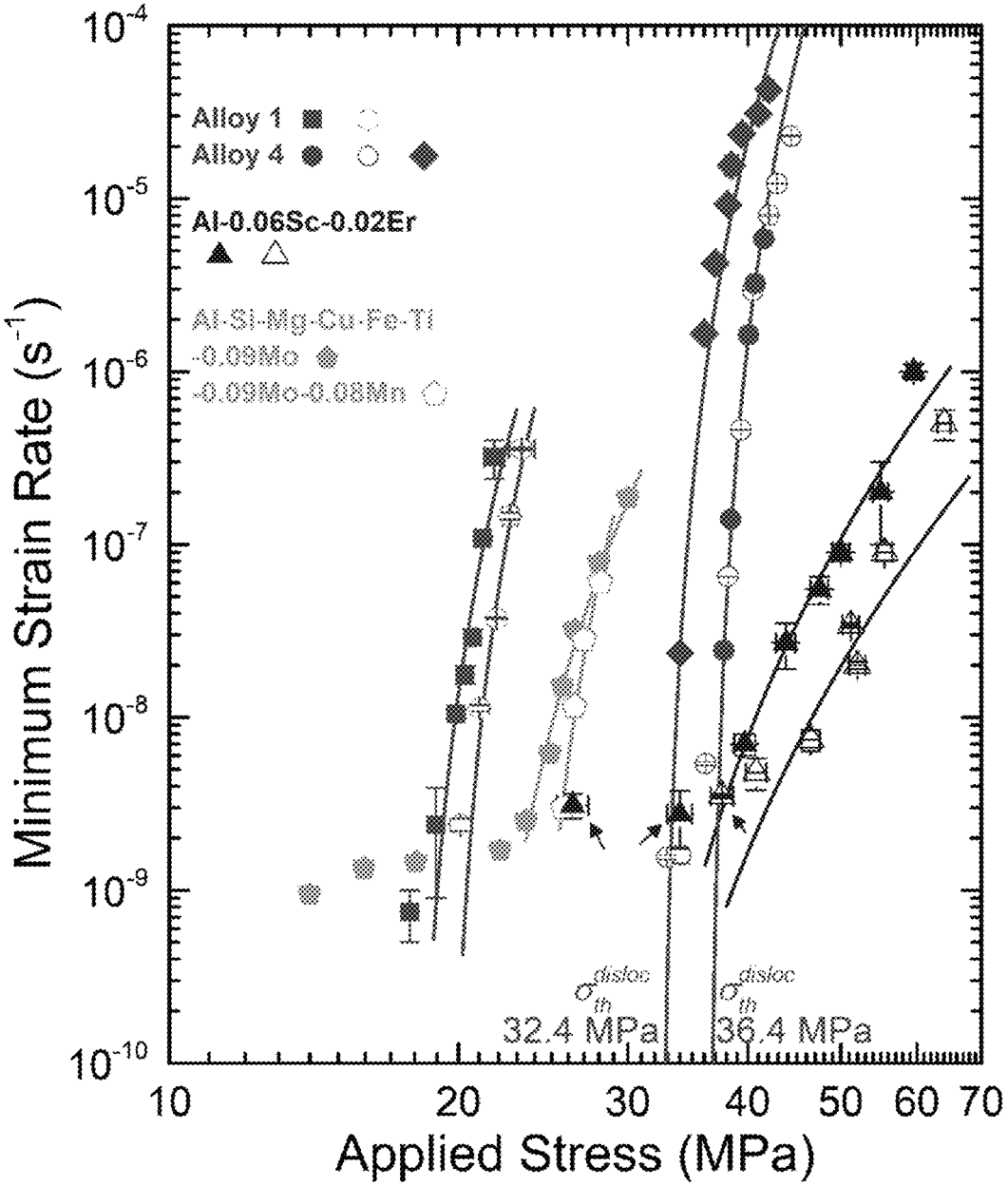
Figure 13:
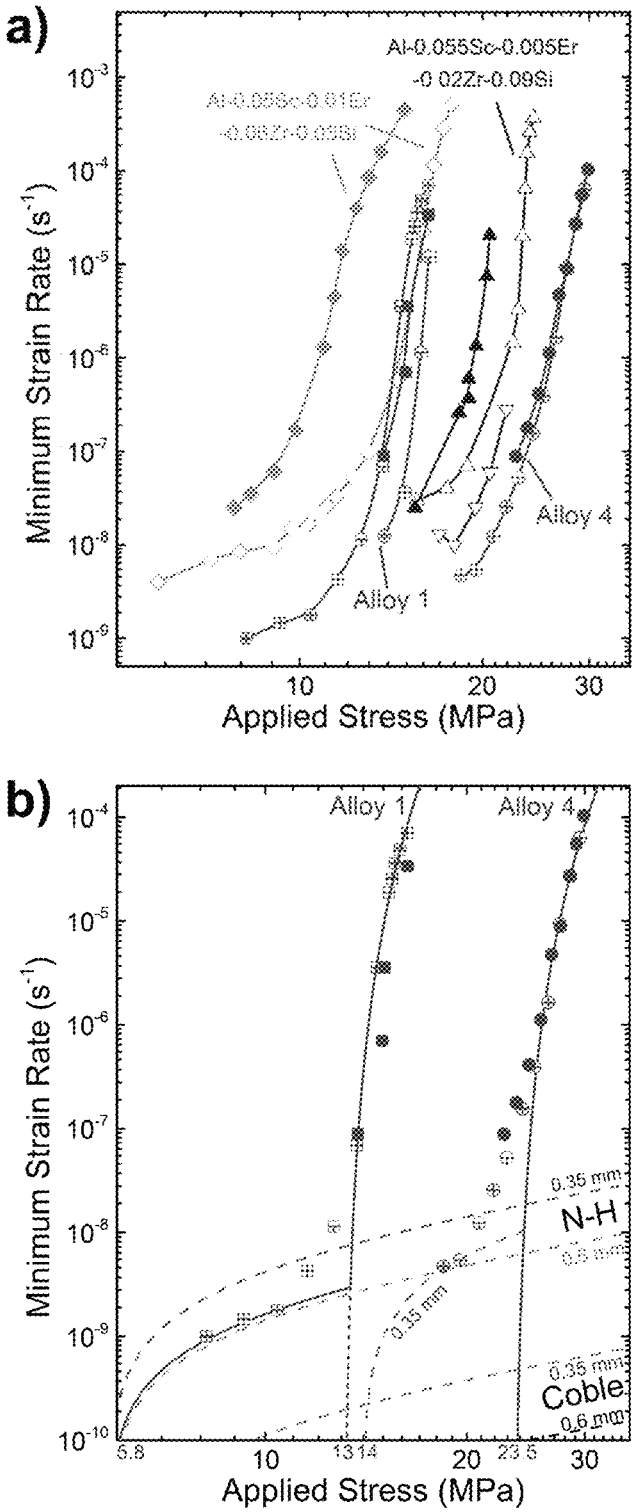
Figure 14:
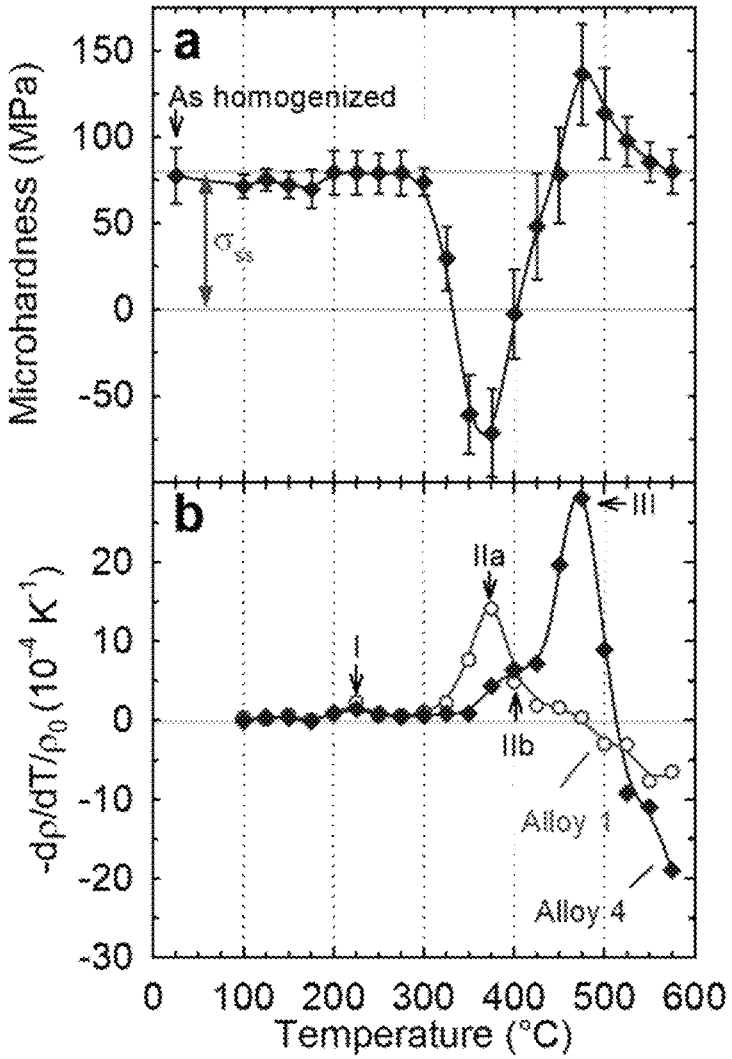

FIG. 11 is a pair of plots showing: (a) Vickers microhardness during isochronal aging, with steps of 25° C. for 3 h for Alloy 1 homogenized at 640° C. for 8 h and Alloy 4 homogenized at 640° C. for 2 h; and (b) electrical conductivity during isochronal aging, with steps of 25° C. for 3 h for Alloy 1 homogenized at 640° C. for 8 h and Alloy 4 homogenized at 640° C. for 2 h;

FIG. 12 is a double-logarithmic plot of minimum creep strain rate vs. applied stress during compressive creep tests at 300° C. for Alloy 4 peak-aged for 24 h at 400° C. (●, ○) or overaged for 264 h at 400° C. (◆), Alloy 1 peak-aged for 24 h at 375° C. (■) and overaged for 264 h at 400° C. (⬡), Al-0.06Sc-0.02Er alloy peak-aged at 300° C. for 24 h (▲) or overaged for 384 h (Δ), and for 0.09Mo (⬟) and 0.09Mo-0.08Mn (⬠) modified Al-6.3Si-0.34Mg-0.21Cu-0.05Fe-0.05Ti (at. %) alloys, aged 4 h at 500° C. followed by 1 h at 540° C.; water-quenched; 5 h at 200° C., and soaked at 300° C. for 100 h prior to creep;

FIG. 13 is a pair of double-logarithmic plots of minimum creep strain rate vs applied stress during compressive creep tests at 400° C. for: (a) Alloy 1 (■, □) and Alloy 4 (●, ○) peak-aged for 24 h at 400° C., Alloy 1 (⬡) overaged for 264 h at 400° C., Al-0.055Sc-0.005Er-0.02Zr-0.09Si peak-aged (double-aged at 300° C. for 4 h and 425° C. for 8 h, ▲) and overaged (double-aged and subsequently aged at 400° C. for ~200 h, Δ and ∇), and Al-0.05Sc-0.01Er-0.06Zr-0.03Si peak aged (◆) and over aged (◇); and (b) dislocation creep and diffusional creep fitted curves for peak-aged Alloy 1 and Alloy 4 and associated threshold stress;

FIG. 14 is a pair of plots showing: (a) the difference in microhardness between Alloy 4 and Alloy 1 during isochronal aging (3 h steps) from FIG. 11*a* where $\sigma_{ss}$ represents the solid solution strengthening produced by Mo and Mn addition; and (b) the negative numerical derivatives of the measured resistivity p divided by the initial resistivity, $\rho_0$, during isochronal aging of Alloy 1 and Alloy 4 using the electrical resistivity calculated from FIG. 11*b;*

Figure 15:
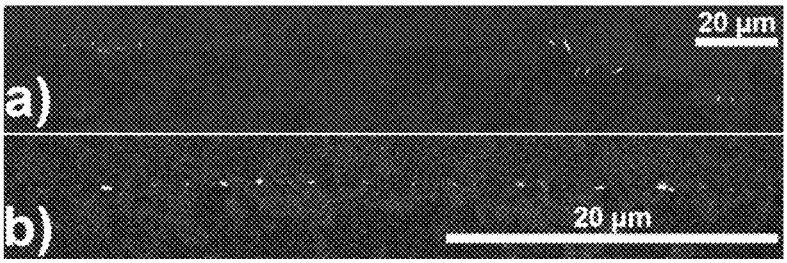
Figure 16:
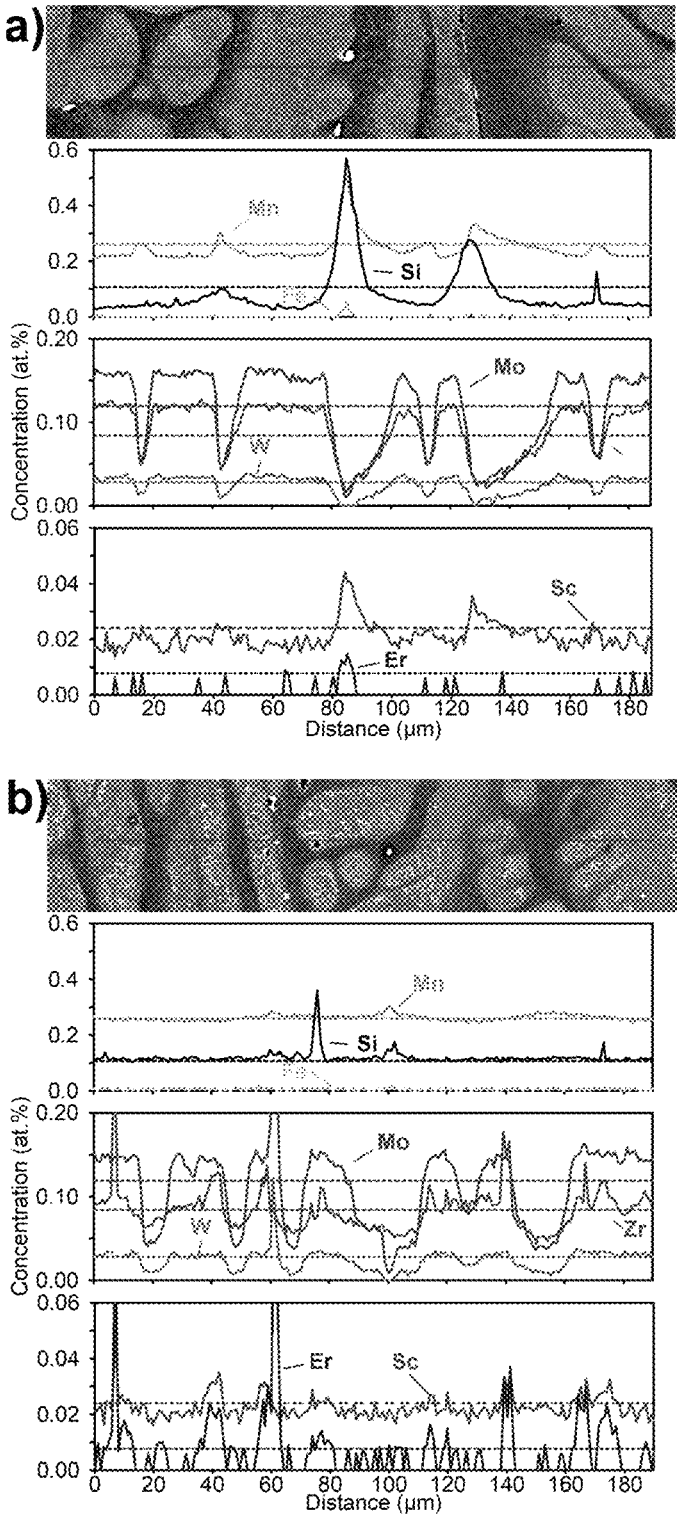
Figure 17:
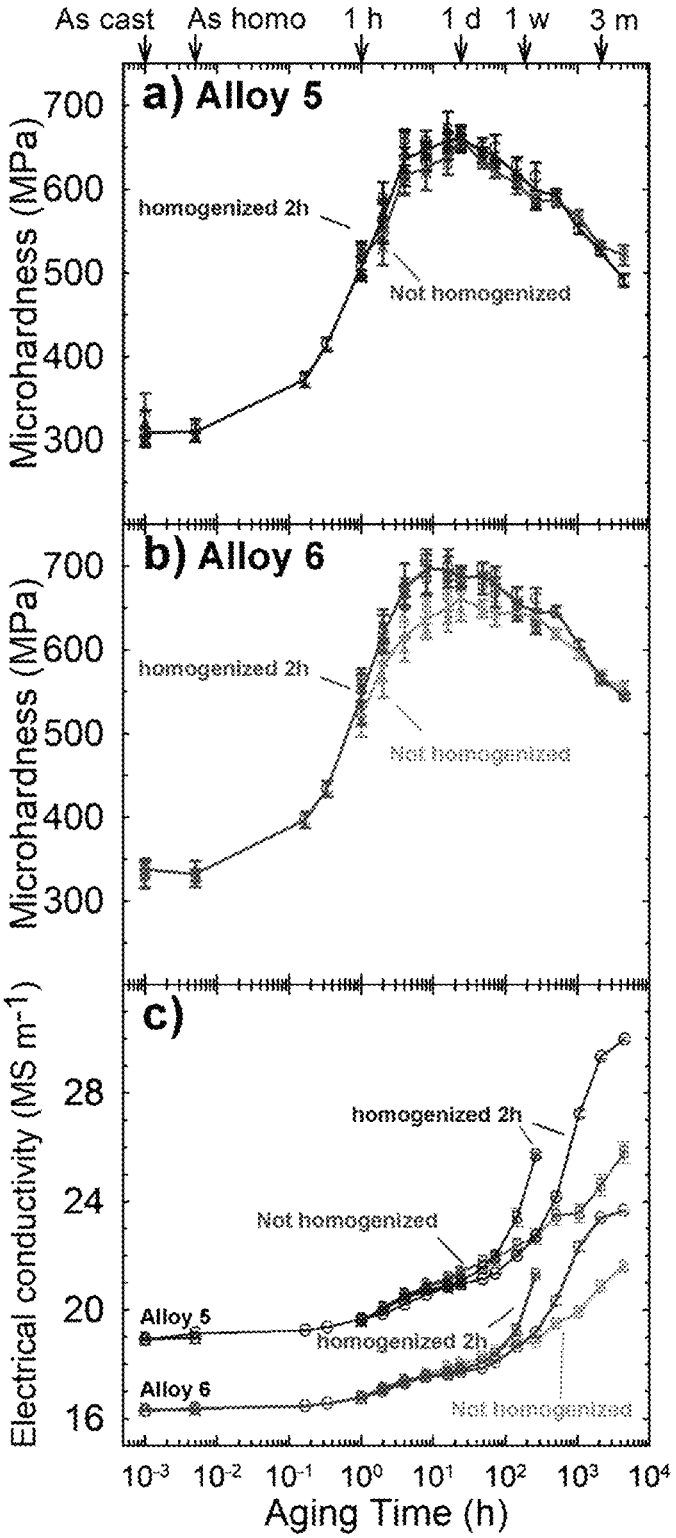
Figure 18:
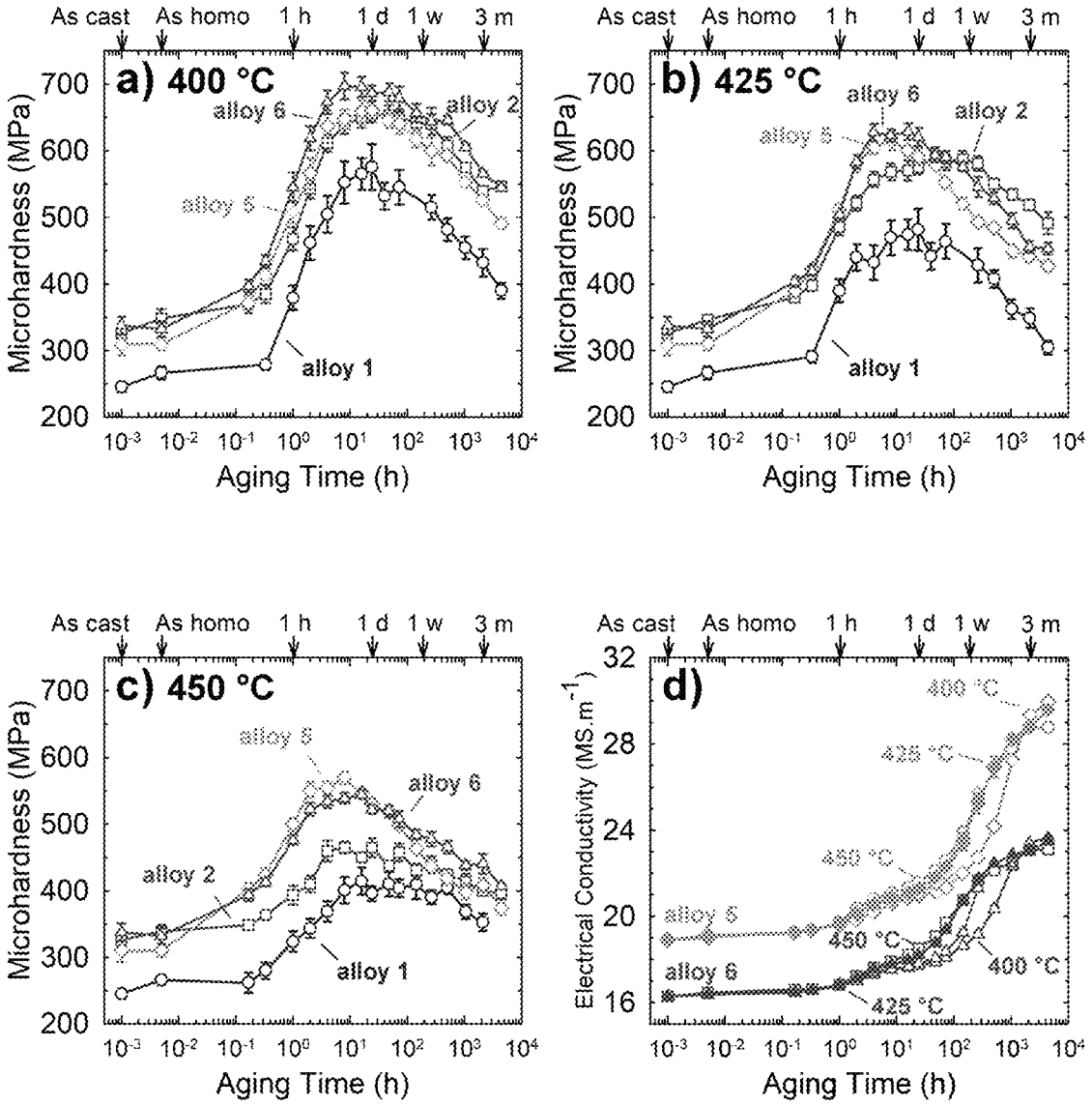
Figure 19:
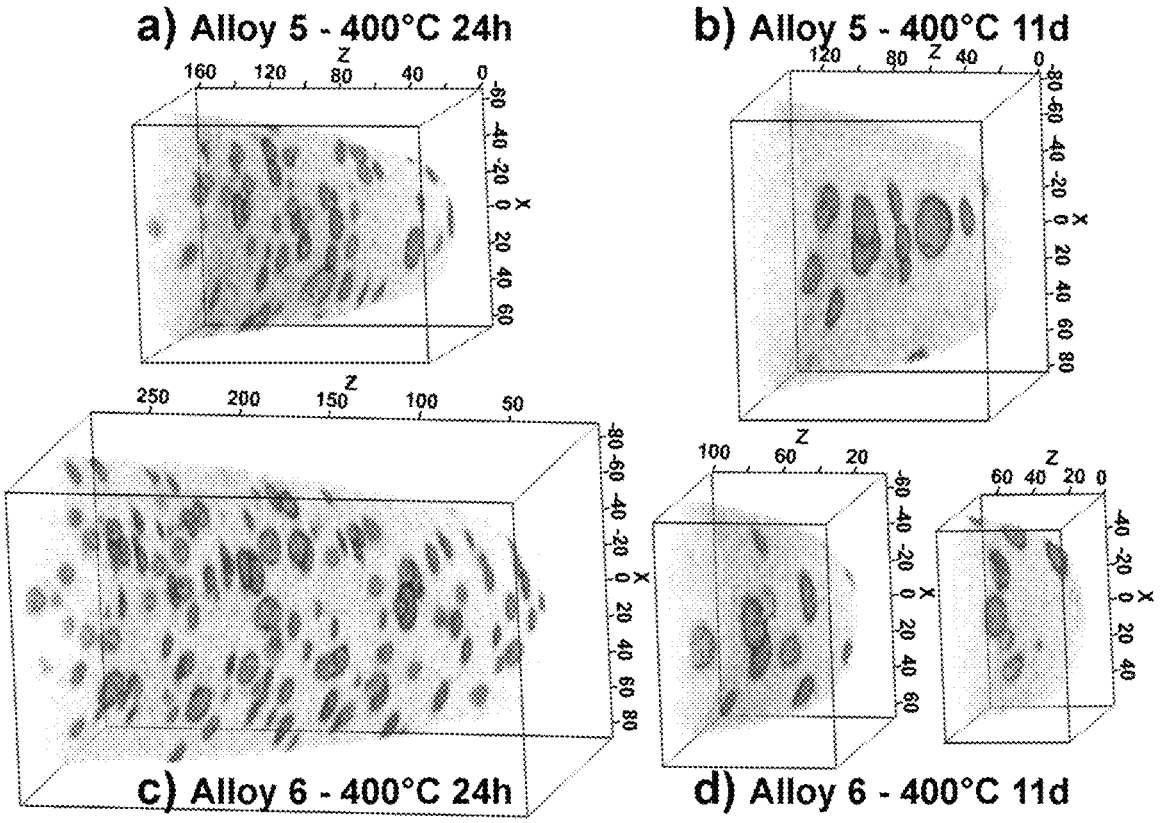
Figure 20:
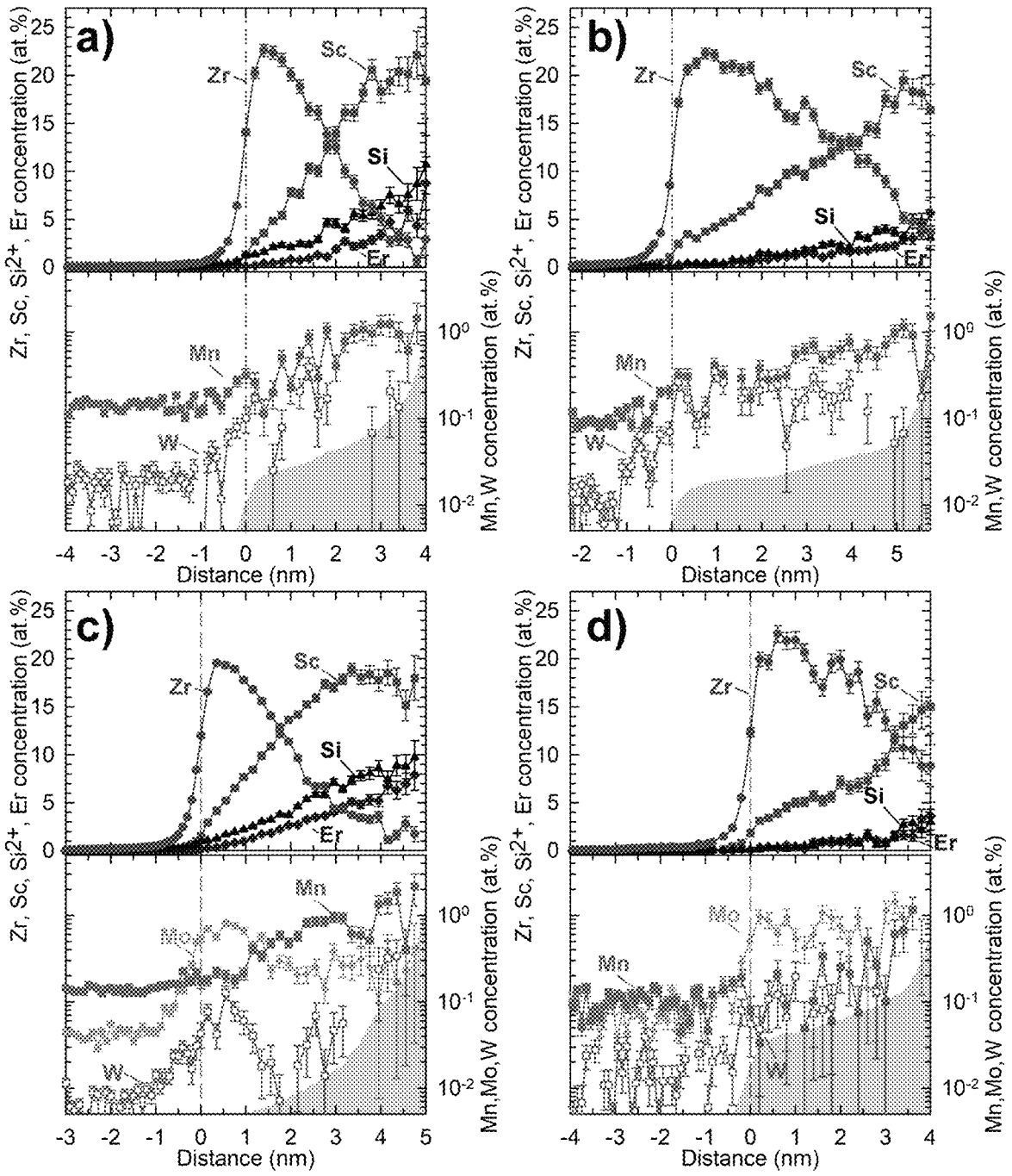
Figure 21:
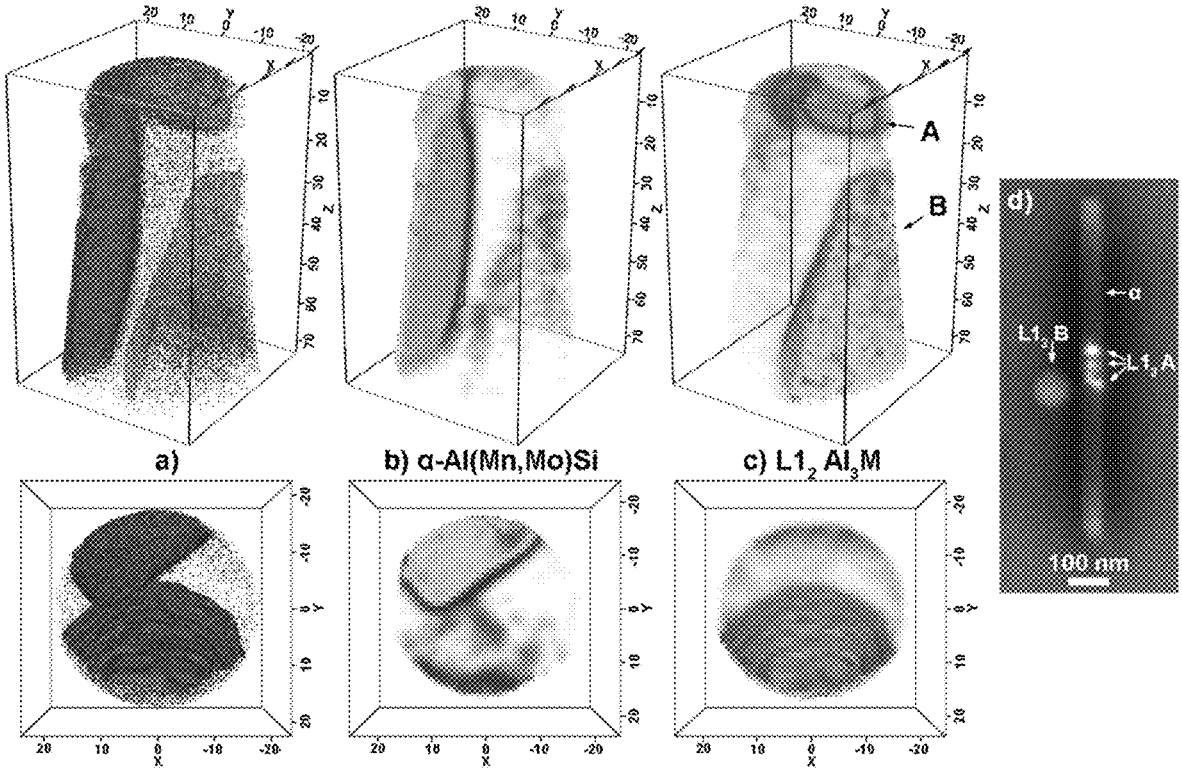
Figure 22:
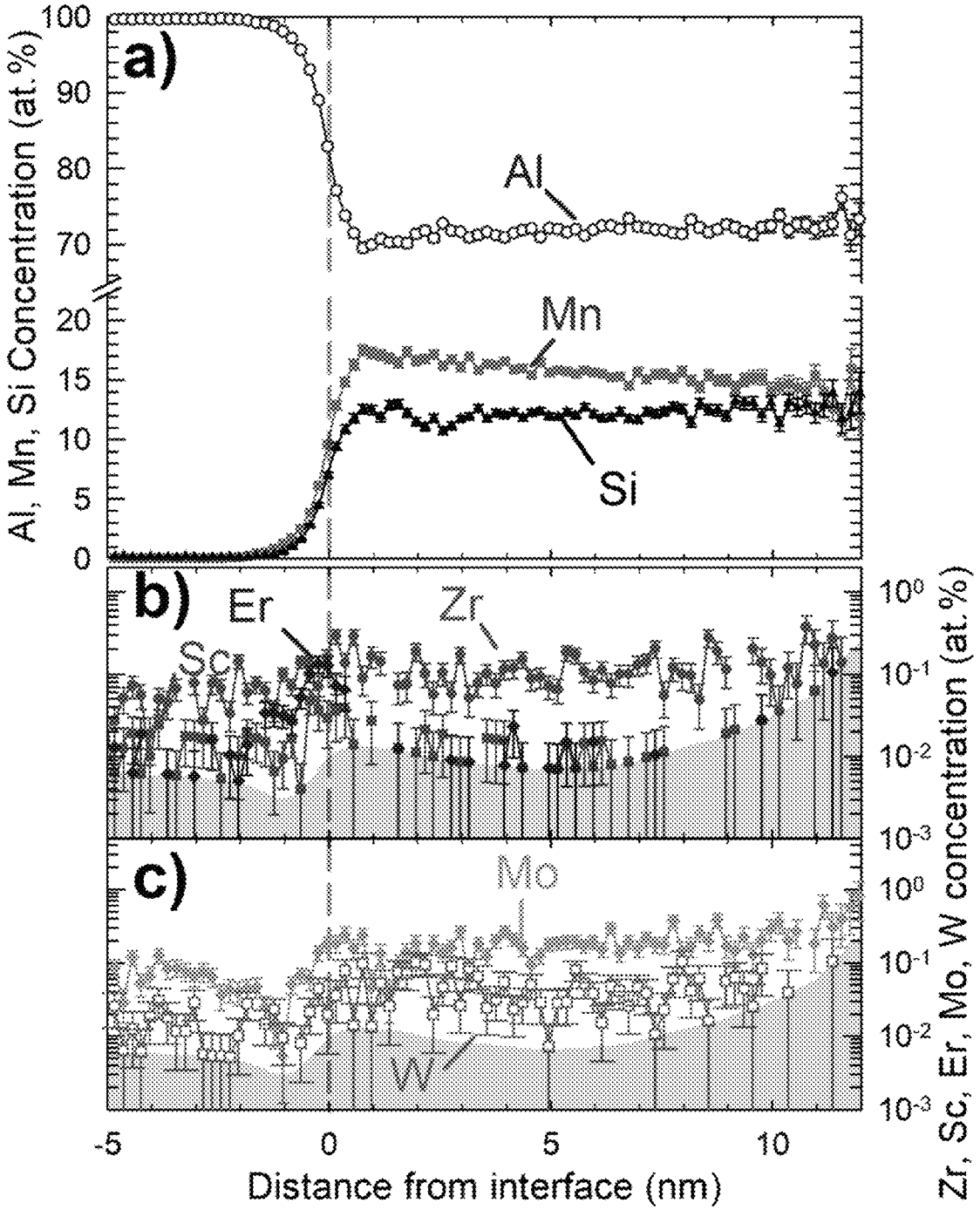
Figure 23:
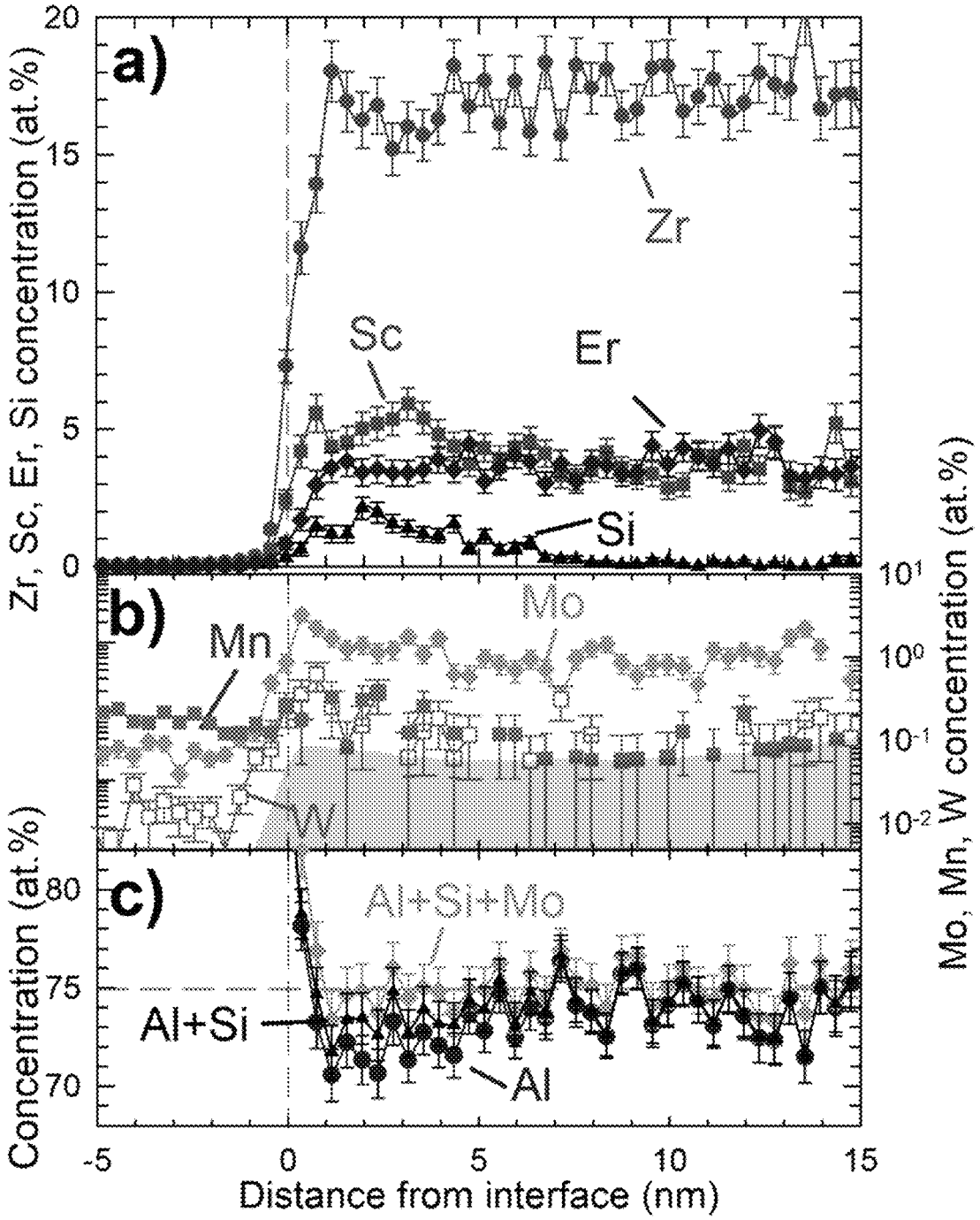

FIG. 15 is a pair of SEM images showing: (a) grain boundary (GB) precipitation in Alloy 1 after homogenization at 640° C. for 2 h where the GB precipitates are α-AlMnSi with a separation distance 1-2 μm and (b) GB precipitation in Alloy 4 after homogenization at 640° C. for 2 h alloy 4 where the GB precipitates are $DO_{23}Al_3$(Zr,Sc,Er) with separation distances between 10 to more than 100 μm;

FIG. 16 shows concentration profiles of Zr,Sc,Er,Si,Mn, Mo,W and Fe measured in Alloy 6 in: (a) the as-cast state; and (b) after homogenization at 640° C. for 2 h, with dashed lines indicating the overall concentration as measured by DCPMS and shown in Table 2;

FIG. 17 shows the temporal evolution of: (a) the Vickers microhardness during aging at 400° C. for Alloy 5; (b) the Vickers microhardness during aging at 400° C. for Alloy 6; and (c) the electrical conductivity during aging at 400° C. for Alloy 5 and Alloy 6;

FIG. 18 is a series of plots showing the evolution of: (a) Vickers microhardness for Alloys 1, 2, 5, 6 as a function of aging time at 400° C.; (b) Vickers microhardness for Alloys 1, 2, 5, 6 as a function of aging time at 425° C.; (c) Vickers microhardness for Alloys 1, 2, 5, 6 as a function of aging time at 450° C.; and (d) electrical conductivity for Alloy 5 and Alloy 6 as a function of aging time at 400° C., 425° C., and 450° C.;

FIG. 19 is a series of APT reconstructions of: (a) Alloy 5 aged at 400° C. for 24 h; (b) Alloy 5 aged at 400° C. for 11 days; (c) Alloy 6 aged at 400° C. for 24 h; and d) Alloy 6 aged at 400° C. for 11 days, where the 3D volume rendering represents the concentration of Sc+Er+Zr, highlights the $L1_2Al_3$(Zr,Sc,Er) precipitates and the scale units is nanometers (nm);

FIG. 20 is a series of concentration profiles across the matrix/$L1_2$-nanoprecipitate interface of: (a) Alloy 5 aged isothermally at 400° C. for 24 h; (b) Alloy 5 aged isothermally at 400° C. for 11 days; (c) Alloy 6 aged isothermally at 400° C. for 24 h; and (d) Alloy 6 aged isothermally at 400° C. for 11 days, with the proxigrams corresponding to volumes presented in FIG. 19;

FIG. 21 is a series of APT reconstruction of an Alloy 6 tip aged isothermally at 400° C. for 11 days and containing parts of α-Al(Mn,Mo)Si precipitates and small (A) and large (B) $L1_2Al_3M$ precipitates with: (a) showing 0.5% of aluminum atoms displayed (blue), Sc atoms are displayed in red, Zr atoms in green, Er atoms in blue, Si in black, Mo in orange and Mn in purple and W in pink; (b) showing Si+Mn atoms; (c) showing Sc+Er+Zr atoms and (d) showing an ADF-STEM image of a similar configuration observed in Alloy 4;

FIG. 22 is a series of concentration profiles across the matrix/α-Al(Mn,Mo)Si precipitate interface of Alloy 6 aged isothermally at 400° C. for 11 days where a composition of $Al_{12-x}(Mn,Mo,W)_{2.4+x}Si_2$ is estimated and (a) shows the concentration profiles of Al, Mn, Si; (b) shows the concentration profiles of Zr, Sc, Er; and (c) shows the concentration profiles of Mo and W, and where a composition of $Al_{12-x}(Mn,Mo,W)_{2.4+x}Si_2$ is estimated; and FIG. 23 is a series of concentration profiles across the type B $L1_2$ precipitate/matrix interface of Alloy 6 aged isothermally at 400° C. for 11 where: (a) shows the concentration profiles for Zr, Sc, Er, Si; (b) shows the concentration profiles for Mn, Mo, W; and (c) shows the concentration profiles of Al, Al+Si and Al+Si+Mo.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

The present disclosure generally relates to aluminum-zirconium-scandium-erbium-silicon (Al—Zr—Sc—Er—Si) alloys with micro-additions of Mn, Mo and/or W (also referred to herein simply as "the alloys"). In one form of the present disclosure the alloys have $L1_2$ (i.e., $Al_3M$) primary precipitates where 'M' is one or more rare earth elements and/or one or more early transition metals. In such variations the alloys include α-$Al_xM_y$ secondary precipitates. As used herein, the rare earth elements include cerium (Ce), dysprosium (Dy), erbium (Er), europium (Eu), gadolinium (Gd), holmium (Ho), lanthanum (La), lutetium (Lu), neodymium (Nd), praseodymium (Pr), promethium (Pm), samarium (Sm), scandium (Sc), terbium (Tb), thulium (Tm, ytterbium (Yb), and yttrium (Y) and the early transition metals include Sc, Y, La, titanium (Ti), zirconium (Zr), hafnium (Hf), (Rf), vanadium (V), niobium (Nb), tantalum (Ta), dubnium (Db), chromium (Cr), molybdenum (Mo), tungsten (W), seaborgium (Sg), manganese (Mn), technetium (Tc), rhenium (Re), and bohrium (Bh).

For example, in some variations of the present disclosure, the $L1_2$ primary precipitates are enriched with Sc, Er and Zr and the α-$Al_xM_y$ secondary precipitates are enriched with Fe, Mn, Si, Mo and/or W. In at least one variation, the α-$Al_xM_y$ secondary precipitates are Fe-free α-Al(Mn,M')Si secondary precipitates (i.e., $M_y$=Mn, M') where M' is Mo and/or W, despite a low Si content in the alloy. In another variation, the α-$Al_xM_y$ secondary precipitates are α-Al(Mn, M")Si secondary precipitates (i.e., $M_y$=Mn, M") where M" is Fe, Mo and/or W, despite a low Si content in the alloy. In still another variation, the α-$Al_xM_y$ secondary precipitates include $Al_6Mn$ secondary precipitates and/or $Al_{12}Mn$ secondary precipitates. In addition, the Si in the alloys enhances the precipitation kinetics of the $L1_2$ primary precipitates and is re-purposed upon aging to form the α-$Al_xM_y$ secondary precipitates which provide enhanced strength at elevated temperatures.

Not being bound by theory, the role and interaction of the alloying elements of the alloys taught in the present disclosure can be complex and the criticality of the range of one or more the alloying elements in the alloys is demonstrated. For example, in re-purposing the use of Si in the alloys, the effect of Si to increase the nucleation kinetics of the $L1_2$ precipitates is taken advantage of and the effect of Si on increasing the coarsening kinetics of the $L1_2$ precipitates is reduced. That is, Si enhances the nucleation rate of $L1_2$ precipitates and thereby increases the nucleation density of the $L1_2$ precipitates, but also enhances the coarsening of the $L1_2$ precipitates and thereby decreases the effect of such precipitates in providing strength to the alloy. However, the present disclosure teaches Al—Zr—Sc—Er—Si alloys that take advantage of the enhanced nucleation rate of the $L1_2$ precipitates provided by the presence of Si and then scavenge (remove) the Si from the matrix via precipitation of α-Al(Mn,M')Si precipitates such that the coarsening of the $L1_2$ precipitates is reduced. Also, the α-Al(Mn,M')Si precipitates provide enhanced high temperature strength and the additions of the Fe, Mn, Mg, Mo and/or W enhance the solid solution strengthening of the alloys.

It should be understood that Fe scavenges rare earth elements and has a detrimental effect on $L1_2$ precipitation hardening due to the consumption of Er thereby reducing the volume fraction of $L1_2$ precipitates. And the lower concentration of Er in the matrix after homogenization prevents or reduces the formation of the Er-enriched core in the $L1_2$ precipitates. The Er enrichment of the core in the $L1_2$ precipitates is important due to its effect on improving the creep resistance of the alloy due to the higher lattice mismatch it induces between $L1_2$ precipitates and the Al matrix.

Another point of concern is related to the consumption of Si to form the α-Al(Mn,M')Si phase. As previously noted, Si enhances diffusivity of Sc, Er and Zr and is needed to nucleate a higher density of $L1_2$ precipitates. If, however, the α-Al(Mn,M')Si precipitates are created first, Si is scavenged from the matrix and is not available in solid solution to aid accelerating the subsequent precipitation kinetics of the $L1_2$ precipitates. That is, premature scavenging of the Si from the matrix can increase the peak-aging time from ~1 day to ~1 week as observed in Si-free Al—Zr based alloys. Manganese has an intermediate diffusivity in Al, slower than Sc but faster than Zr, whereas Mo diffuses extremely slowly in Al, e.g., it is 200 times slower than Zr at 400° C. The α-Al(Mn, M')Si phase could possibly form before a stable $Al_3Zr$ shell is fully formed and encapsulates the $Al_3(Sc,Er)$ nuclei of the $L1_2$ precipitates, which would compromise their thermal stability and coarsening resistance. Alternatively, when Si atoms are removed from the matrix after, rather than before, the time at which the $L1_2$ precipitates achieve their optimal size, subsequent $L1_2$ coarsening-rate is reduced thereby negating the enhanced diffusivity of Zr. Accordingly, repurposing the role of Si is achieved. That is, Si is first used in solid solution within the matrix to enhance the nucleation and early growth of $L1_2$ precipitates, and then is removed from the matrix by precipitation of the α-Al(Mn,Mo,W)Si phase such that coarsening of the $L1_2$ precipitates is reduced and secondary precipitates that enhance the strength of the alloy are provided.

Six (6) alloys with nominal compositions in atom percent (at. %) and weight percent (wt. %) shown in Table 1 below were melted to determine the effect of micro-additions of Mn, Mo and Won the precipitation of Fe-free α-Al(Mn,M') Si precipitates after nucleation of the $L1_2Al_3$(Sc,Zr) precipitates in a Si-lean alloy (0.1 at. %). All compositions discussed and provided below, unless otherwise stated, are provided in atom percent.

TABLE 1

| | Composition (at. %) | Composition (wt. %) |
|---|---|---|
| Alloy 1 | Al—0.08Zr—0.02Sc—0.0045Er—0.1Si | Al—0.27Zr—0.03Sc—0.0278Er—0.1Si |
| Alloy 2 | Al—0.08Zr—0.02Sc—0.005Er—0.1Si—0.40Mn—0.08Mo | Al—0.27Zr—0.03Sc—0.031Er—0.1Si—0.81Mn—0.28Mo |
| Alloy 3 | Al—0.08Zr—0.02Sc—0.005Er—0.1Si—0.40Mn—0.08Mo—0.01Fe | Al—0.27Zr—0.02Sc—0.031Er—0.1Si—0.81Mn—0.28Mo—0.02Fe |
| Alloy 4 | Al—0.08Zr—0.02Sc—0.005Er—0.1Si—0.25Mn—0.08Mo | Al—0.27Zr—0.03Sc—0.031Er—0.1Si—0.51Mn—0.28Mo |
| Alloy 5 | Al—0.08Zr—0.02Sc—0.0045Er—0.1Si—0.25Mn—0.025W | Al—0.27Zr—0.02Sc—0.0315Er—0.1Si—0.51Mn—0.169W |
| Alloy 6 | Al—0.08Zr—0.014Sc—0.005Er—0.1Si—0.11Mo—0.25Mn—0.025W | Al—0.27Zr—0.023Sc—0.031Er—0.1Si—0.39Mo—0.50Mn—0.169W |

Alloy 1 was a control alloy, Alloy 2 was designed as Alloy 1 with additions of Mn and Mo. Particularly, the concentrations of Zr, Sc, Er, and Si in Alloy 2 were held as close as possible to the original concentrations of Zr, Sc, Er, and Si in Alloy 1 for comparative purposes, and 0.08 at. % Mo and 0.4 at. % Mn were added. Alloy 3 was designed as Alloy 2 with the addition of Fe to determine if Fe was needed to form the α-Al(Mn,M')Si phase. Alloy 4 was designed as Alloy 2 with a reduction in Mn, Alloy 5 was designed as Alloy 1 with additions on Mn and W, and Alloy 6 was designed as Alloy 1 with additions of Mn, Mo and W. As observed from Table 1, the total content of Zr+Er+Sc in the alloys is greater than or equal to 0.1 at. %, for example between 0.1 at. % and 0.5 at. %, or between 0.1 at. % and 0.3 at. %, or between 0.1 at. % and 0.2 at. %.

Experimental Procedures

Alloy 2 (Fe-free) and Alloy 3 (0.1Fe) were arc-melted in an AM0.5 Arc Metter, using 99.99 at. % pure Al, and appropriate amounts of Al-8 wt. % Zr, Al-2 wt. % Sc, Al-3.9 wt. % Er and Al-12.6 wt. % Si master alloys, as well as pure Mo (99.97%), Mn (99.99%) and Fe (99.995%). The master alloys and aluminum were wrapped, utilizing 99.8% pure Al foil prior to melting, which caused additional Fe contamination (from the foil) of the arc-melted buttons. The buttons, each weighting 7 g, were flipped ten times during the arc melting process to improve homogeneity. Arc melting is associated with fast solidification of the alloy, due to the water-cooled copper hearth and the small alloy quantities. After initial testing of arc-melted alloy 2 and 3, a new alloy formulation was conventionally casted in order to confirm that arc melting of the alloy is not mandatory. For comparison, alloy 2 was also conventionally casted and named alloy 2b (Al-0.08Zr-0.02Sc-0.005Er-0.10Si-0.40Mn-0.08Mo at. %). In a further conventionally cast alloy (alloy 4), the Mn concentration was reduced (nominal Al-0.08Zr-0.02Sc-0.005Er-0.10Si-0.25Mn-0.08Mo at. %). Both alloys were conventionally cast in amounts of ~200 g, using 99.99 at. % pure Al, appropriate amounts of Al-8 wt. % Zr, Al-2 wt. % Sc, Al-3.9 wt. % Er, Al-12.6 wt. % Si, Al-10 wt. % Mn and Al-4 wt. % Mo master alloys. The Al—Si master alloy was preheated at 450° C. while all the other ones were preheated at 640° C. The alloys were melted in an alumina crucible at 800° C. and the melt was maintained in air for 1 hour to ensure full dissolution of the master alloys, regularly stirred, and then cast into a graphite mold. The mold was preheated to 200° C. and placed on an ice-cooled copper platen immediately before casting to enhance directional solidification. The two W containing alloys, with nominal compositions of Al-0.014Sc-0.005Er-0.08Zr-0.1Si-0.25Mn-0.025W (alloy 5) and Al-0.014Sc-0.005Er-0.08Zr-0.1Si-0.11Mo-0.25Mn-0.025W (alloy 6) were arc-melted in a water-cooled Cu hearth MAM-1 Arc Metter, using the previously indicated master alloys and using a 99.99% pure W wire and 99.99% pure Al foil to prevent iron contamination. Each buttons were flipped 10 times and had a weight of 30 g. The chemical compositions of the alloys were measured by Direct-Current Plasma Mass-Spectroscopy (DCPMS) at ATI Wah Chang (Albany, Oreg.) and are compared to the nominal compositions of the alloys in Table 2 below. As noted above, Alloy 1 is the control alloy on which the new alloys compositions are based. All reference to alloy compositions will use the DCPMS composition.

TABLE 2

| Alloy | | Zr | Sc | Er | Si | Mn | Mo | W | Fe |
|---|---|---|---|---|---|---|---|---|---|
| Alloy 1 | Nominal | 0.08 | 0.02 | 0.0045 | 0.1 | — | — | — | — |
| | DCPMS | 0.075 | 0.014 | 0.0075 | 0.094 | — | — | — | <0.005 |
| Alloy 2 | Nominal | 0.08 | 0.014 | 0.005 | 0.1 | 0.4 | 0.08 | — | — |
| | DCPMS | 0.099 | 0.01 | 0.0072 | 0.097 | 0.4 | 0.088 | — | 0.008 |
| Alloy 3 | Nominal | 0.08 | 0.014 | 0.005 | 0.1 | 0.4 | 0.08 | — | 0.01 |
| | DCPMS | 0.093 | 0.01 | 0.0073 | 0.0853 | 0.39 | 0.085 | | 0.015 |
| Alloy 2b | Nominal | 0.09 | 0.01 | 0.005 | 0.1 | 0.4 | 0.088 | — | — |
| | DCPMS | 0.08 | 0.023 | 0.009 | 0.107 | 0.4 | 0.114 | — | <0.005 |
| Alloy 4 | Nominal | 0.09 | 0.01 | 0.005 | 0.1 | 0.25 | 0.088 | — | — |
| | DCPMS | 0.08 | 0.024 | 0.009 | 0.107 | 0.25 | 0.108 | — | <0.005 |
| Alloy 5 | Nominal | 0.08 | 0.014 | 0.005 | 0.1 | 0.25 | — | 0.025 | — |
| | DCPMS | 0.086 | 0.03 | 0.0076 | 0.09 | 0.26 | — | 0.028 | <0.005 |

TABLE 2-continued

| Alloy | | Zr | Sc | Er | Si | Mn | Mo | W | Fe |
|---|---|---|---|---|---|---|---|---|---|
| Alloy 6 | Nominal | 0.08 | 0.014 | 0.005 | 0.1 | 0.25 | 0.11 | 0.025 | — |
| | DCPMS | 0.084 | 0.024 | 0.0077 | 0.107 | 0.26 | 0.119 | 0.028 | 0.006 |
| | EPMA | 0.084 | 0.023 | 0.0078 | 0.10 | 0.26 | 0.115 | 0.025 | 0.004 |

Compositions (at. %) of the Mo/Mn/W-containing alloys, as measured by Direct Plasma Emission Spectroscopy (DCPMS).

The alloys were homogenized in air for 0 h (alloy 5 and 6) or 2 h (alloy 2/3/2b/4/5/6 at 640° C. followed by water quenching. Isothermal aging experiments were performed at 400, 425 and 450° C., for durations ranging from 10 min and up to 6 months. Isochronal aging heat experiments on alloy 4 were performed after homogenization, with steps of 25° C. for 3 h, starting at a temperature of 100° C. and through 575° C. All heat treatments were performed in air and terminated by water quenching.

Vickers microhardness measurements were performed with a Duramin-5 microhardness tester (Struers) utilizing an applied load of 200 g for 5 s on samples polished to at least a 1 μm surface finish. A minimum of ten and up to twenty indentations, on different grains, were made for each specimen. Due to the small amount of material available in the arc-melted buttons, individual samples were repeatedly aged and their microhardnesses measured at each step. For the arc melted alloys, in the later isothermal aging curves, the data points from said samples are connected by a straight line. Several samples were aged at 400° C. for different durations (i.e., from 10 min to 3 months, 24 h to 11 day, and 6 day to 6 months in the case of alloy 2/3), resulting in overlapping data points among samples.

Specimens for three-dimensional local-electrode atom-probe (LEAP) tomography were prepared by cutting with a diamond saw ~0.35×0.35×10 $mm^3$ blanks, which were electropolished at 20-25 V DC using a solution of 10% perchloric acid in acetic acid, followed by electropolishing at 12-18 V DC utilizing a solution of 2% perchloric acid in butoxyethanol, both at room temperature. Pulsed-laser atom-probe tomography (APT) was performed using a LEAP 4000X Si tomograph (Cameca, Madison, Wis.) at a specimen temperature of 30 K. Focused picosecond ultraviolet laser pulses (wavelength=355 nm) with a laser beam width of <5 μm at the $e^{-2}$ diameter were employed. Analyses was performed utilizing a pulse repetition rate of 500 kHz while maintaining a detection rate of 1 or 2%. To minimize the background noise in the mass spectra for the $Zr^{3+}$ ions due to the thermal tail of the $Al^{1+}$ ions, the laser energy was adjusted for each experiment, and it ranged between 50 to 60 pJ $pulse^{-1}$. This adjustment was utilized to obtain a compromise between a smaller $Al^{1+/2+}$ ratio and small overall background noise in the mass spectra (9-15 ppm/nsec). LEAP tomographic data were analyzed employing IVAS v3.8.0 (Cameca Instruments Inc., Madison, Wis.). LEAP datasets were reconstructed in the voltage mode and the initial nanotip radius was adjusted to obtain the correct aluminum atomic interspacing for observed crystallographic directions. To improve the analyses accuracy, background subtraction has been performed on all the composition related data, i.e. proxigrams and precipitate composition. The microstructure for samples polished using a 0.06 μm colloidal silica suspension, was investigated using a Hitachi SU8030 scanning electron microscope (SEM), equipped with an Oxford X-max 80 mm detector for energy-dispersive x-ray spectroscopy (EDS) measurements, permitting us to detect larger precipitates and to estimate qualitatively their compositions.

Constant-load compressive creep experiments were performed at 300 and 400° C., with a thermal fluctuation of ±1° C. Cylindrical creep specimens with a 10 mm diameter and 20 mm height, were placed between boron-nitride-lubricated alumina platens, and heated in a three-zone furnace. Sample displacement was measured with a linear variable displacement transducer (LVDT) with a resolution of 10 μm. Minimum strain rates at a given stress were determined by measuring the slope of the strain vs. timeline in the steady-state creep regime. The applied load was increased when a clear steady-state (minimum) strain rate was observed, following primary creep. The total accumulated creep strain for each specimen was maintained below 10% to guarantee that the shape of the specimens remained cylindrical (no barreling) and the applied stress uniaxial. In order to correlate diffusional creep at 400° C. to grain size, selected samples were cut in half and their cross section polished to 1 μm finish. The grain and dendritic structure were revealed using Tucker's reagent ($HCl:HF:HNO_3:H_2O$ 9:3:3:5).

Alloys 2 and 3—Effects of Mo and Mn Micro-Additions on Strengthening and Over-Aging Resistance of Nanoprecipitation-Strengthened Al—Zr—Sc—Er—Si Alloys As-cast and homogenized characterizations were performed on Alloys 2 and 3 to identify primary precipitates and observe their possible dissolution. The alloys were later isothermally aged at 400° C., 425° C. and 450° C. To understand the improved microhardness and coarsening resistance, observed during aging, select samples were analyzed by APT. These results are discussed to identify the mechanism responsible for the improved properties.

As-Cast and Homogenized Microstructure

SEM observations were performed on selected samples. FIGS. 1*a* and 1*b* show the as-cast and homogenized microstructures of Alloy 2. Primary precipitates, 1-10 μm in length, are detected throughout the as-cast sample. Two families of primary precipitates were observed, see the insets. Type A (bright) precipitates are Er- and Si-rich, whereas type B (gray) are Mn-, Si- and Fe-rich. Fe-modified Alloy 3 displays a similar microstructure, but with a higher number density of type B Fe-rich precipitates (not displayed). After homogenization, the areal number density of precipitates has been reduced. At 2 h at 640° C., only a few of type A Er—Si-rich precipitates are observed but type B Mn—Si—Fe-rich precipitates still mainly remain (inset FIG. 1*a*). A homogenization step is nevertheless desirable to dissolve the primary Er—Si precipitates.

Formation of large spherical precipitates, approximately 25 to 50 nm radius, were observed in the homogenized samples, and they follow a dendritic-like structure, with the interdendritic channels free of them (cf. FIG. 1*b*). Due to their small size, compared to the electron-beam interaction volume, accurate measurements of their compositions by EDS was not possible, but they displayed an enrichment in Zr, Sc and Er and are thus assumed to be of the type $Al_3M$ and are marked as such in FIG. 1*b*. Given their relatively large size and small volume fraction, these precipitates do not induce strengthening and only consume solute atoms (Zr, Sc, Er), which is not available for the later formation of nanoscale $L1_2$ precipitates. These precipitates are unavoidable given that Zr segregates on solidification of the alloy into the Zr-rich dendrites, which has also been observed in prior studies.

Isothermal Aging at 400° C.

Figure 2:
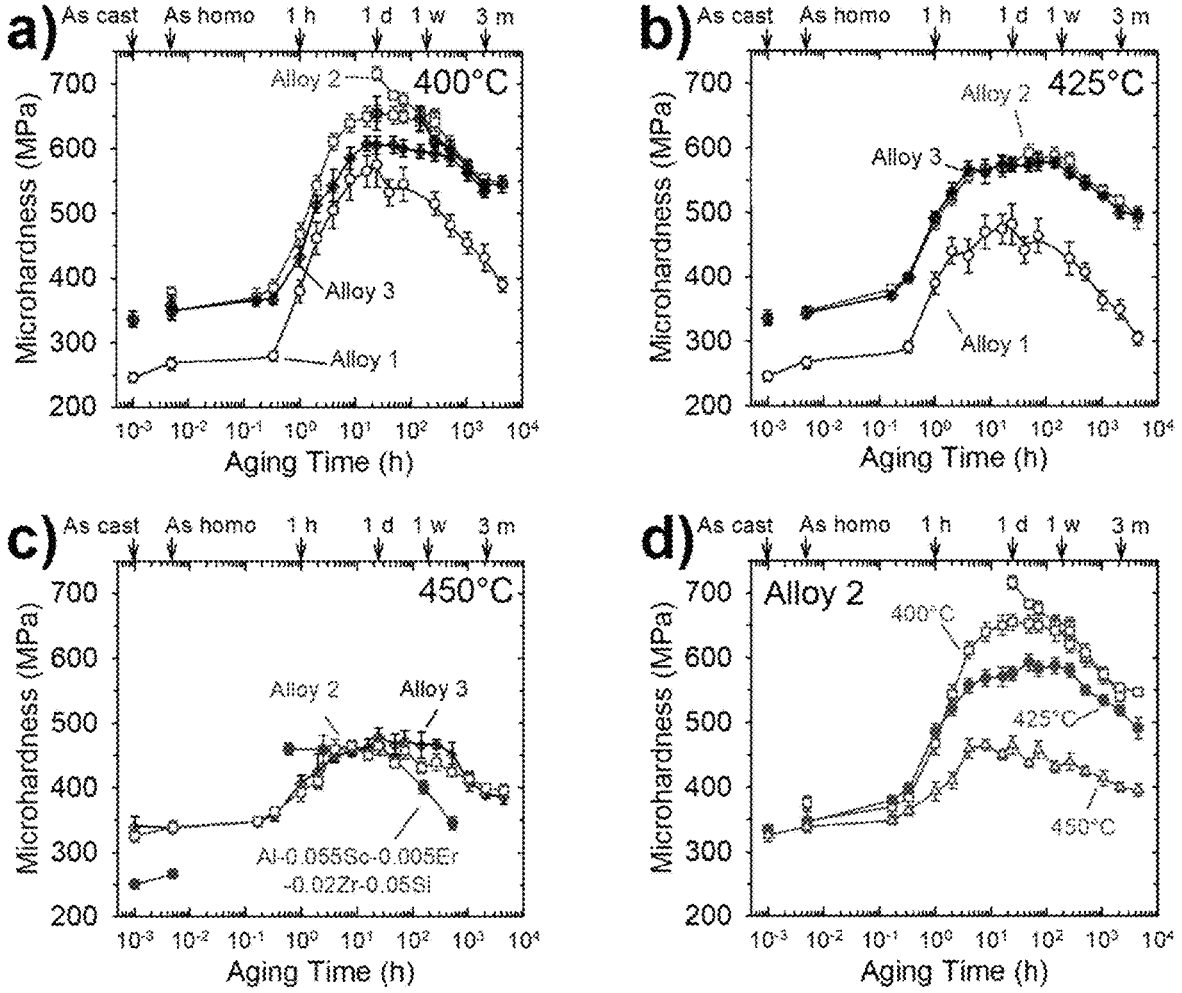

Referring to FIG. 2*a*, a plot of the change in the Vickers microhardness as a function of aging time at 400° C. for the two new alloys. Both Alloys 2 and 3 display similar as-cast and homogenized Vickers microhardness values, 335±7 and 349±15 MPa, respectively, but some variability among samples is observed after homogenization, implying a possible inhomogeneous distribution of solute atoms in the button. The precipitation hardening of both alloys are similar and therefore it will be described together. Similarly, to the control alloy (Alloy 1), the Alloys 2 and 3 exhibited an incubation time of 20 min at 400° C. before displaying a significant change in the Vickers microhardness and reached peak Vickers microhardness values at about 24 hours. This is an indication that Mn and Mo do not have a noticeable effect on the growth of the $L1_2$ precipitates, and that the α-precipitates are not forming for this short aging duration. That is, Mo affects the coarsening rate of the $L1_2$ precipitates and Mn affects the number density of $L1_2$ precipitates (as shown by the APT data), however the overall effect of Mn and Mo does result in an accelerated/delayed peak aging duration. Similar to the homogenized samples, a difference in the peak Vickers microhardness values were observed among samples. Very large variations from sample-to-sample could be observed at the peak aging time, between 606±14 MPa to 716±11 MPa, with an overall mean Vickers microhardness of 659±47 MPa. Despite this variability, similar Vickers microhardnesses values were obtained among all samples for durations longer than 21 days (603±14 MPa), indicating repeatable overaged strength. This is noteworthy, since overaged strength is more critical than the peak aging strength in increasing the lifetime of the alloy. After 3 months at 400° C., both alloys achieved a Vickers microhardness value of 554±7 MPa, which plateaued up to 6 months.

As a comparison, the aging behaviors of Alloys 2 and 3 are compared with Alloy 1 in FIG. 2*a*. Alloy 1 displayed as-cast and homogenized Vickers microhardness values, respectively, of 245±7 MPa and 266±10 MPa, i.e., about 90 MPa lower than Alloys 2 and 3. During aging at 400° C., a peak Vickers microhardness value of 575±34 MPa was achieved after 24 h. The Vickers microhardness then decreased progressively to 390±12 MPa after 6 months of aging. Accordingly, Alloys 2 and 3 exhibited higher microhardness values than Alloy 1.

Isothermal Aging at 425° C.

Referring to FIG. 2*b*, the evolution of the Vickers microhardness as a function of aging time at 425° C. for Alloys 1-3 is shown with Alloys 2 and 3 exhibiting nearly identical Vickers microhardness evolution. At this aging temperature, 10 min of aging already induces observable additional nanoprecipitation strengthening of about 30 MPa, compared to the homogenized microhardness value. The Vickers microhardness then increases rapidly, achieving a plateau after 4 h. The beginning of the plateau displays a Vickers microhardness value of 557±11 MPa. The Vickers microhardness value of the alloy increases slowly with increasing aging time, achieving 588±12 MPa after 6 day at 425° C., which is the end of the plateau. The Vickers microhardness decreases to 495±8 MPa after aging for 6 months, which is only 60 MPa lower than at 400° C. for the same aging duration, demonstrating that the precipitates are remarkably stable and coarsening resistant even at 425° C.

By comparison, Alloy 1 displayed a similar incubation time of 20 min before displaying a rapid increase of the Vickers microhardness, peaking at 481±31 MPa after 24 h. The Vickers microhardness decreases slowly, and achieves 305±11 MPa after 6 months. Accordingly, and compared to the homogenized Vickers microhardness (266±10 MPa), most of the nanoprecipitation-induced strengthening is lost due to coarsening of the $L1_2$ precipitates in Alloy 1, while strengthening is maintained Alloys 2 and 3. Similarly to the aging temperature of 400° C., Alloys 2 and 2 display a higher Vickers microhardness at 425° C. when compared to Alloy 1 at any given time.

Isothermal Aging at 450° C.

Referring to FIG. 2*c*, evolution of the Vickers microhardness as a function of aging time at 450° C. for Alloys 2 and 3 is shown. Compared to the strengthening response at 400 and 425° C. shown in FIG. 2*d*, aging at 450° C. does not exhibit a fast increase of the Vickers microhardness and it yields a significantly lower peak Vickers microhardness value. The Vickers microhardness of Alloy 2 increases slowly to a plateau of about 460 MPa after 4 h. This plateau region is maintained for 3 days before a slow but measurable loss of the Vickers microhardness value occurred. The Fe-containing Alloy 3 achieves a slightly higher peak Vickers microhardness of 479±13 MPa after 24 h and, like Alloy 2, displays a slow decrease of the Vickers microhardness during aging. Both alloys achieve a Vickers microhardness value of ~400 MPa after 88 days of aging with a plateau existing to 6 months.

Data are not available on the strengthening response of Alloy 1 aged at 450° C. and data from a Sc-rich Al-0.055Sc-0.005Er-0.02Zr-0.05Si alloy aged at 450° C. is shown for comparative purposes in FIG. 2*c*. This alloy displays a similar Vickers microhardness value of 460±10 MPa as Alloys 2 and 3 after 40 min of aging. This Vickers microhardness value was, however, maintained for only 24 h before decreasing rapidly to 345±10 MPa after 22 days. Alloys 2 and 3 therefore do not display higher microhardness values at 450° C. when compared to the Sc-rich alloy. However, Alloys 2 and 3 do display improved coarsening resistance at 450° C. Although direct aging at this temperature result in Vickers microhardness values much lower than when aged at 400 or 425° C., the observed slow decrease of the Vickers microhardness values highlights the resistance of the Mn- and Mo-modified alloys (i.e., Alloys 2 and 3) to short extreme temperature excursions, which can certainly happen during the lifetime of an alloy.

Change in Microstructure During Aging

Based on the isothermal aging results, two samples aged at 400° C. were selected to perform APT analyses and SEM observations; a peak-aged sample (24 h at 400° C.), with the highest Vickers microhardness of 716 MPa, and an overaged sample, aged for 11 days (641 MPa). These durations were chosen because APT datasets were previously obtained for the Al—Zr—Sc—Er—Si alloy (alloy 1) and are thus comparable directly with it.

Peak Aged Condition (24 h at 400° C.)

Figure 3:
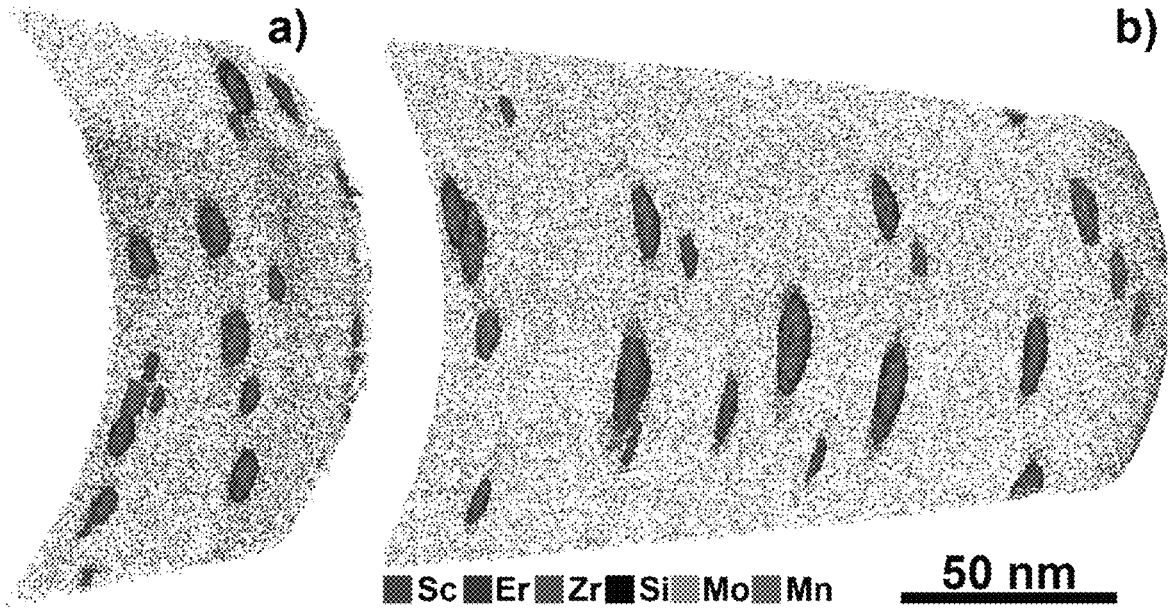

SEM observations of the peak-aged samples did not reveal significant changes in the large-scale microstructure when compared to the homogenized microstructure (FIG. 1*b*) and the primary precipitates did not further dissolve and the large spherical $Al_3M$ precipitates did not grow. However APT analyses demonstrated that an extremely high number density of nano-size $L1_2$ precipitates formed upon aging as shown in FIG. 3*a*. The sample used for the APT experiments displayed a Vickers microhardness value of 716±11 MPa, which is the highest peak microhardness achieved (FIG. 2*a*), i.e., 140 MPa higher than for Alloy 1.

Nanoprecipitate number density ($N_V$), mean radius ⟨R⟩, volume fraction, ϕ, and Vickers microhardness (HV) Alloys 1, 2, 5 and 6 are shown in Table 3 below and the nanoprecipitate and matrix compositions as determined by APT is shown in Table 4.

TABLE 3

| Alloy | Aging | $N_V$ ($\times 10^{22}$ $m^{-3}$) | ⟨R⟩ (nm) | ϕ (%) | HV (MPa) |
|---|---|---|---|---|---|
| Alloy 1 | 400° C./24 h | 3.56 ± 0.34 | 2.66 ± 0.55 | 0.33 ± 0.03 | 575 ± 35 |
| | 400° C./11 days | 1.69 ± 0.44 | 3.37 ± 0.66 | 0.37 ± 0.09 | 515 ± 18 |
| Alloy 2 | 400° C./24 h | 8.57 ± 0.86 | 2.07 ± 0.34 | 0.22 ± 0.02 | 716 ± 11 |
| | 400° C./11 days | 2.52 ± 0.41 | 3.09 ± 0.63 | 0.35 ± 0.06 | 641 ± 15 |
| Alloy 5 | 400° C./24 h | 3.93 ± 0.52 | 2.39 ± 0.31 | 0.38 ± 0.05 | 660 ± 12 |
| | 400° C./11 days | 0.94 ± 0.14 | 3.85 ± 0.51 | 0.41 ± 0.06 | 599 ± 21 |
| Alloy 6 | 400° C./24 h | 3.18 ± 0.22 | 2.50 ± 0.45 | 0.38 ± 0.03 | 687 ± 12 |
| | 400° C./11 days | 1.49 ± 0.22 | 3.80 ± 0.39 | 0.49 ± 0.07 | 644 ± 20 |

Mean values of all the analyzed datasets for the $L1_2$ Nanoprecipitate number density, $N_V$, mean radius⟨R⟩, volume fraction, ϕ, and Vickers microhardness (HV), for Al—0.08Zr—0.014Sc—0.008Er—0.10Si at. % (Alloy 1) homogenized for 8 h at 640° C. and Al—0.10Zr—0.01Sc— 0.007Er—0.10Si—0.40Mn—0.09Mo (Alloy 2), Al—0.09Zr—0.03Sc—0.008Er—0.09Si—0.26Mn—0.028W (Alloy 5) and Al—0.08Zr—0.024Sc—0.008Er—0.11Si—0.26Mn—0.12Mo—0.028W (Alloy 6) homogenized for 2 h at 640° C. All samples aged isothermally at 400° C. for 24 h and 11 days.

TABLE 4

| | | Precipitates' mean composition (at. %) | | | | | | | Matrix composition (at. ppm) | | | | | |
|---|---|---|---|---|---|---|---|---|---|---|---|---|---|---|
| Alloy | Aging | Al | Sc | Er | Zr | Si* | Mo | Mn | Sc | Er | Zr | Si* | Mo | Mn |
| Alloy 1 | 400° C./24 h | 72.75 | 7.03 | 1.59 | 17.45 | 1.17 | — | — | 10 | ND | 154 | 763 | — | — |
| | 400° C./11 days | 73.54 | 4.69 | 0.83 | 19.77 | 1.16 | — | — | 5 | ND | 30 | 917 | — | — |
| Alloy 2 | 400° C./24 h | 72.90 | 3.79 | 2.49 | 17.49 | 1.90 | 0.95 | 0.49 | 9 | ND | 339 | 657 | 582 | 2169 |
| | 400° C./11 days | 74.98 | 2.53 | 1.25 | 20.32 | 0.15 | 0.62 | 0.15 | 9 | ND | 146 | 54 | 598 | 453 |

Composition of the $L1_2$ precipitates and matrix in the alloys reported in Table 2.
*Concentration of $^{28}Si^{2+}$ in LEAP4000X Si tomographic mass spectrum.

Compared to Alloy 1, for the same aging duration, the addition of Mo and Mn to the alloy induced the nucleation of a number density of $L1_2$ precipitates that is twice as large (~8.57 vs $3.56\times10^{22}$ $m^{-3}$) with smaller radii (~2.0 vs ~2.7 nm), producing a higher level of precipitation strengthening than that of the Mn/Mo-free alloy. As shown in Table 4 the nanoprecipitate composition is not affected strongly by the Mn and Mo additions, with Zr being the main constituent at 17.5 at. %. Due to the smaller amount of Sc in Alloy 2 compared to Alloy 1, a smaller Sc:Er ratio (in at. %) is measured in the precipitates. A small amount of Mo and Mn partitions to the precipitates, respectively about 1 at. % and about 0.5 at. %, compared to 0.06 and 0.22 at. % detected in the matrix. This is highly relevant to the coarsening resistance of the precipitates, and a central aspect of the new alloys. FIGS. 4*a* and 4*b* presents the concentration profiles of the $L1_2$ precipitates as measured by APT for: (a) Zr, Sc, Er and Si; and (b) Mo and Mn. Similar to Alloy 1, the precipitates display a core-shell structure, with the core enriched in Sc, Er and Si, and a shell highly enriched in Zr. Manganese partitions to the core of the precipitates (max ~3 at. %), whereas Mo partitions to the shell of the precipitates (max ~2 at. %). However, it was not possible to estimate from the concentration profiles which sublattice sites Mo and Mn occupy in the $Al_3M$ structure and Ab-initio calculations are needed to identify and estimate their effects on the lattice parameter of the $L1_2$ precipitates.

Overaged Condition (11 Days at 400° C.)

Figure 5:
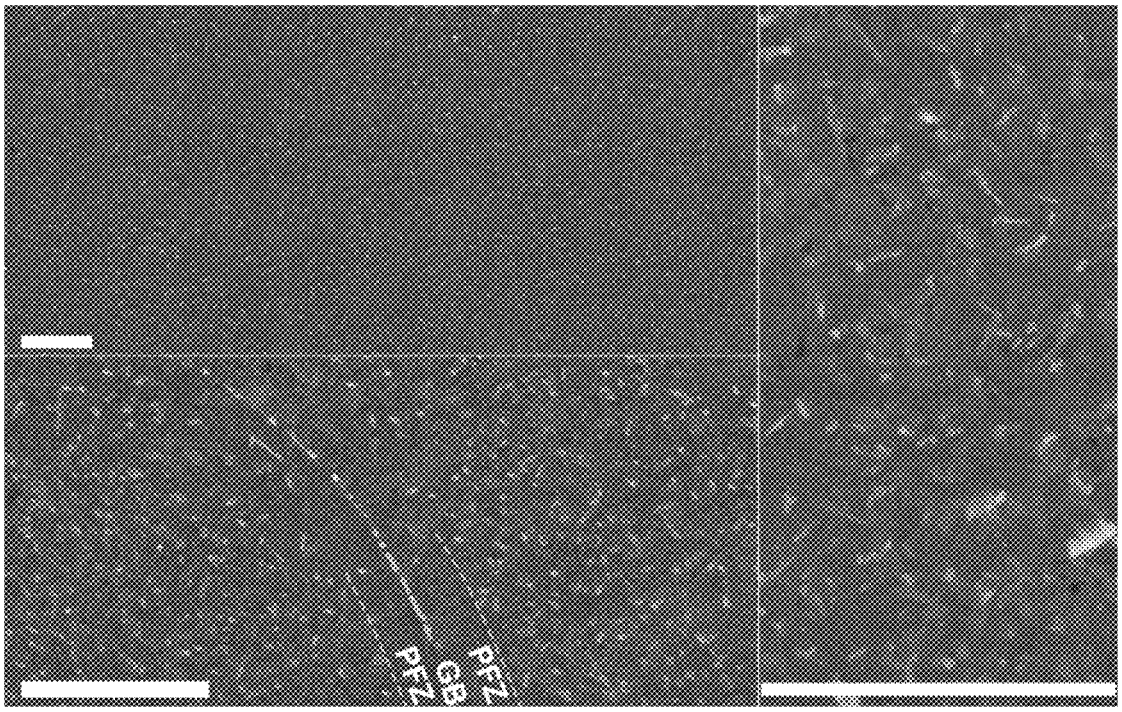

SEM and APT observations were performed on Alloy 2 aged for 11 days at 400° C. SEM revealed that, for long-time aging, a high areal number density of elongated submicron precipitates formed in the matrix (FIG. 5). Rod- and platelet-like precipitates are observed throughout the sample. The rod-like precipitates are, however, probably platelets, which are aligned with the electron beam so that the edges of the platelets are visible. Due to the large interaction volume of the electron beam, it is difficult to measure precisely the dimensions and composition of the precipitates but the overall morphology and number density are consistent with the expected α-Al(Mn,Mo)Si phase, and similar in size and shape to the α-Al(Fe,Mn,Mo)Si platelets reported in the literature. These precipitates are about 0.5-1.4 μm long and have a thickness of <100 nm. Due to their small sizes, it was not possible to measure precisely their dimensions. TEM characterization of Alloy 4 allowed identification of the crystal structure, simple cubic Pm α-AlMnSi, and to determine that there is semi-coherency with the matrix. The precipitates are homogeneously distributed throughout the sample, and strong dendritic segregation was not observed, as demonstrated by the low-magnification SEM micrograph shown in FIG. 5. Grain-boundary (GB) precipitates are observed, surrounded by narrow precipitate-depleted zones (PDZs) (1 to 3 μm wide). A similar microstructure was observed in the sample aged for 11 days at 425° C., with approximately the same precipitate dimensions but with a smaller areal number density. The same microstructure was observed in Fe-containing alloy 3 at both aging temperatures. The observation of α-Al(Mn,Mo)Si precipitation upon aging of Alloy 2 confirms that Fe is not necessary to their formation. The addition of 150 at.ppm Fe in Alloy 3 did not produce significant effect on α-precipitation strengthening, as expected if precipitate number density and/or volume fraction was increased, as evidenced on the isothermal aging curves of Alloy 2 and 3 (cf. FIG. 2). It rather increases the volume fraction of the Mn—Si—Fe-bearing primary precipitates that do not affects microhardness.

Although the number density of the elongated precipitates is relatively high, the small volume analyzed by APT did not permit a dataset on one of these precipitates to be obtained (typically, nanotip dimensions: 100 nm diameter, 200 nm long). FIG. 3*b* presents a volume collected in a sample aged for 11 days at 400° C. Only $L1_2$ precipitates were detected, with the nanoprecipitate distribution given in Table 3 and their mean composition in Table 4 The measured dataset yielded concentration of Sc, Er, Zr and Mo atoms comparable to the dataset obtained in the sample peak aged shown in Table 5 below.

TABLE 5

| | | Tip composition (at. ppm) | | | | | |
|---|---|---|---|---|---|---|---|
| Alloy | Aging | Sc | Er | Zr | Si* | Mo | Mn |
| Alloy 2 | 400° C./24 h | 77 | 40 | 889 | 705 | 608 | 2182 |
| | 400° C./11 days | 77 | 36 | 844 | 58 | 598 | 455 |

Overall nanotip compositions measured in the APT volumes of alloy 2.
*Concentration of $^{28}Si^{2+}$ in LEAP4000X Si tomographic mass spectrum.

The large difference in terms of Si and Mn between the two datasets and its implications are discussed later. Similarly to the peak-aging condition, compared to Alloy 1 after 11 days of aging, the number density per unit volume of $L1_2$ precipitates is higher (~2.52 vs $1.69\times10^{22}$ $m^{-3}$) and their mean radius is smaller (~3.09 vs 3.37 nm). Due to further precipitation of Zr from the matrix, the volume fraction has increased to 0.35%, similar to its value in Alloy 1. Since the $L1_2$ precipitates consumes Zr, this caused an increase of the relative amount of Zr per precipitate, with an overall Zr concentration of ~20% and with Sc and Er accordingly decreasing. FIGS. 4*c* and 4*d* present the concentration profiles in the $L1_2$ precipitates. As was previously observed in Alloy 1, the core-shell structure is partially homogenized during long-term aging. The core is, however, still enriched in Sc and Er, compared to the shell. Although the overall Mo content is reduced (0.62 at. % vs. 0.95 at. % at peak aging) the Mo is homogeneously distributed in the precipitates, consistent with diffusion within the $L1_2$ structure.

Estimation of the α-AlMnMoSi Phase Composition

LEAP tomographic analyses of the Si and Mn present in the overaged sample (400° C./11 days) demonstrates that Si is extremely depleted, more so than Mn (Table 5). For the entire analyzed volume, only 58 at. ppm Si and 455 at. ppm Mn were detected. One hypothesis is that this Si and Mn depletion is a statistical anomaly solely related to an inhomogeneous distribution of these two elements, following the dendritic distribution originating from solidification of the alloy and the random sampling performed in a Si/Mn depleted region. Due, however, to the very high diffusivity of Si in Al, it is improbable that Si would not be distributed homogeneously after the homogenization anneal. Additionally, after aging at 400° C. for 11 days, the root-mean square (RMS) diffusion distance for Si is 100 μm, which is significantly larger than the dendritic structure. Among the 12 nanotips analyzed at the peak- and overaged-times for Alloy 1, and 2 additional nanotips for Alloy 2 at the peak aging time, an overall concentration of ~700 at. ppm $Si^{2+}$ was the smallest value we detected, even in volumes containing interdendritic channels and much higher than what was found in the overaged alloy 2 (58 at. ppm). Similarly, RMS diffusion distance for Mn is about 1 μm, which is larger than the mean distance between the α-precipitates (0.5-1 μm), estimated employing SEM as shown in FIG. 5.

Accordingly, the depletion of Si and Mn upon overaging is assumed to involve the formation of the α-Al(Mn,Mo)Si precipitates, observed by SEM, which were not captured by APT. According to the literature precipitates forming at a high temperature (540° C.) have the composition $\alpha\text{-}Al_{22}(Fe_{1-3}Mn_{4-6}Mo)Si_4$, with Fe, Mn and Mo replacing each other in the b.c.c. structure. Considering the overall nanotip compositions, as measured by APT, at peak- and overaging-times (1 and 11 days) as shown in Table 5, the Si and Mn concentrations decreased from 705 to 58 at. ppm and from 2182 to 455 at. ppm, respectively. Molybdenum, being an extremely slow diffuser, it is estimated to have only diffused ~10 nm in 11 days at 400° C. Thus, only Mo atoms near the α-precipitates are expected to be incorporated into them, making it impossible to confirm indirectly its co-precipitation in the α-Al(Mn,Mo)Si phase utilizing the obtained APT datasets. Considering the changes in the Si and Mn concentrations between 24 h and 11 days at 400° C., ~650 and 1700 at. ppm, respectively, a ratio of 5.4 Mn atoms per 2 Si atoms is obtained and confirms a ratio found in $\alpha\text{-}Al_{12}(Fe,Mn)_3Si_{1.2\text{-}2}$. By counting the number of Si and Mn atoms consumed by the formation of the $\alpha\text{-}Al_{12}Mn_{54}Si_2$-phase and utilizing an atomic density of 68.29 at/$nm^3$ (138 atoms per unit cell, α=12.643 Å), a volume fraction of ~0.55% is estimated. Due to the aforementioned issue associated with the undirect estimation of the precipitate composition, the effect of Mo on volume fraction is not considered. The volume fraction should however be increased if Mo co-precipitates in the α-phase along Mn and Si. If we consider the total amount of Si in the alloy (1000 at. ppm) and the same 5.4:2 consumption ratio for Mn, the maximum volume fraction of α-precipitates is calculated as ~0.86%. This phase is, however, non-stoichiometric and thus may contain more Mn, which would further increase the volume fraction of α-precipitates.

The Mn tip concentration of 0.22 at. % (Table 5), as measured in the matrix by LEAP after aging at 400° C. for 24 h, when the $L1_2$ precipitation is finished but the α-precipitation has not yet started—must be close to the maximum Mn solid solubility at that temperature. The difference with respect to the nominal composition (0.40 at. %) must be accounted for in the primary type B Mn—Si—Fe-rich precipitates (FIG. 1) which are too coarse to provide significant precipitation strengthening. Thus, the amount of Mn in the alloy can be reduced in future iterations to ~0.22 at. % to eliminate type B Mn—Si—Fe-rich precipitates formed during casting, while providing the highest possible Mn amount for α-phase precipitation on aging.

$L1_2$ Nano-Precipitates' Concentration Profiles

Similarly to Alloy 1, the peak-aged, the $L1_2$ precipitates of Mn/Mo modified Alloys 2 and 3 display a core-shell structure, with a core enriched in Er, Sc and Si, and a shell enriched in Zr. Furthermore, Mn partitions to the core and Mo to the shell. The partitioning of Mn to the cores, associated with the higher precipitate number density per unit volume when compared to alloy 1 (cf. Table 3), suggests that Mn is aiding the nucleation of the $L1_2$ precipitates. Alternatively, the partitioning of the extremely slowly-diffusing Mo to the shell may decrease the coarsening rate of the $L1_2$ precipitates, as the coarsening kinetics is limited by the slowest diffusing species in a multicomponent alloy. This explains the smaller mean nanoprecipitate radius measured, when compared to the Mo-free Alloy 1 for the same aging duration (cf. Table 3). The slower growth/coarsening kinetics is further emphasized by the higher amount of Zr remaining in the matrix at the peak aging time: 339 at. ppm for alloy 2 vs. 154 at. ppm for Alloy 1 (Table 4). Although some partitioning of Si, Mo and Mn to the $L1_2$ precipitates is observed, these species remain mainly in solid-solution in the matrix, as demonstrated by comparing the matrix's composition (Table 4) to the overall nanotip's composition (Table 5).

For long-aging times, the core-shell structure of the $L1_2$ precipitates homogenizes, with a thicker $Al_3Zr$-shell forming. This phenomenon was observed for Alloy 1 and its effect on mechanical properties is unknown. A significant segregation of Mo to $Al_3Zr$ precipitates is, however, observed. Due to the extremely small diffusivity of Mo in Al, the formation of a Mo-enriched shell surrounding the $L1_2$ precipitate would be expected, as is case for Zr atoms enveloping $Al_3(Sc,Er)$-precipitates. Initially, Mo is segregated in the outer-shell for the peak aging condition. Molybdenum is homogeneously distributed, within the precipitates, after over-aging for 11 day, throughout the $L1_2$ precipitates, at a concentration of 1-2 at. %. This nearly flat concentration profile is consistent with a significant diffusivity and solubility of Mo in $Al_3Zr$-precipitates. This substantial Mo solubility in $Al_3Zr$ may affect the lattice parameter of the $L1_2$-precipitates and thus their lattice parameter mismatch with the matrix, which further affects the creep properties at high temperatures.

Figure 4:
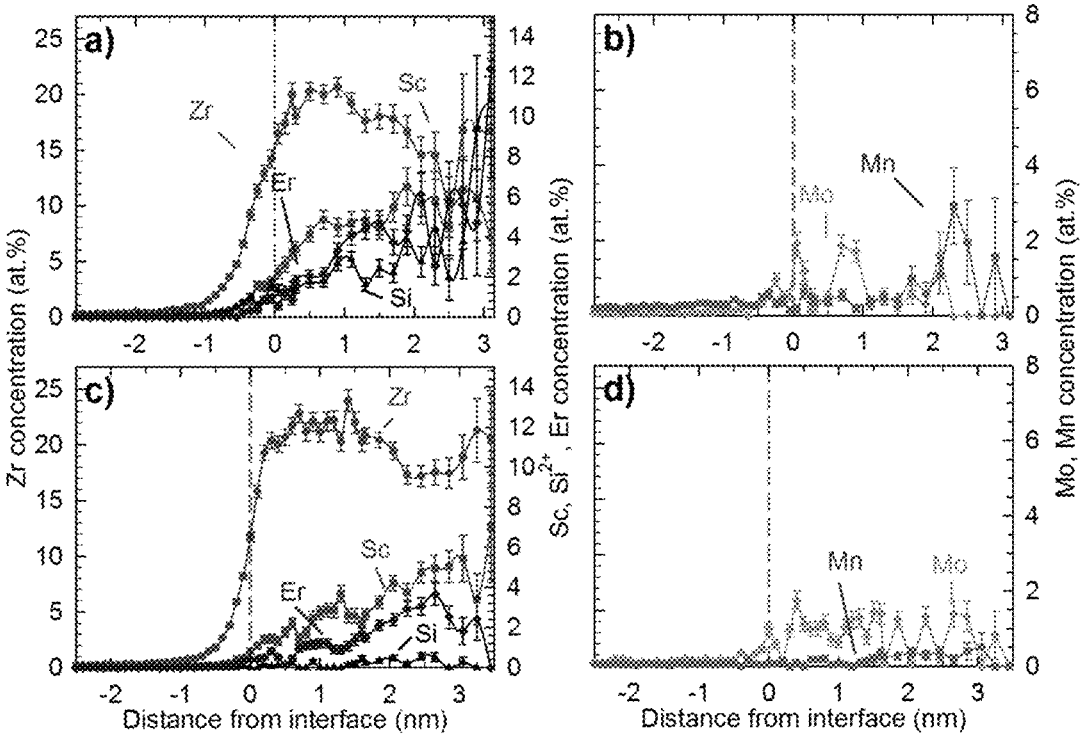

Unlike molybdenum, Mn and Si are essentially absent from the $L1_2$-precipitates after overaging for 11 day, despite the high concentrations of 10 at. % Si and 3 at. % Mn in the core of peak-aged precipitates (FIG. 4). A likely hypothesis is related to the formation of the α-Al(Mn,Mo) Si-phase during over-aging, which consumes most of the Si- and Mn-solute atoms from the matrix, as indirectly confirmed by the measured matrix composition. As the matrix becomes depleted in Si and Mn, these elements diffuse out of the $L1_2$ precipitates and re-precipitate in the α-phase.

Modeling of Strength

The strength increment induced by order strengthening ($\Delta\sigma_{ord}$) coherency and modulus mismatch strengthening ($\Delta\sigma_{coh}+\Delta\sigma_{mod}$), and Orowan dislocation looping ($\Delta\sigma_{oro}$) The expression for order strengthening, $\Delta\sigma_{ord}$, is given by:

$$\Delta\sigma_{ord} = 0.81M\frac{\gamma_{APB}}{2b}\left(\frac{3\pi\phi}{8}\right)^{1/2} \tag{A1}$$

where M=3.06 is the mean matrix orientation factor for Al, b=0.286 nm is the magnitude of the matrix Burgers vector, ϕ is the volume fraction of the precipitates, and $\gamma_{APB}=0.5\ Jm^{-2}$ is an average value of the $Al_3Sc$ anti-phase boundary (APB) energy for the (111) plane. The coherency strengthening $\Delta\sigma_{coh}$ is given by:

$$\Delta\sigma_{coh} = M\alpha_\varepsilon(G\theta)^{3/2}\left(\frac{\langle R\rangle\phi}{0.5\,Gb}\right)^{1/2} \tag{A2}$$

where $\alpha_\varepsilon=2.6$ is a constant, G is the shear modulus of Al, ⟨R⟩ is the mean nanoprecipitate radius, and θ is the constrained lattice parameter mismatch at room temperature, calculated using Vegard's law, and based on the precipitates' mean composition as measured by APT (Table 4). Strengthening by the modulus mismatch is given by $\Delta\sigma_{mod}$:

$$\Delta\sigma_{mod} = 0.0055\,M(\Delta G)^{3/2}\left(\frac{2\phi}{Gb^2}\right)^{1/2} b\left(\frac{\langle R\rangle}{b}\right)^{(3m/2-1)} \tag{A3}$$

where ΔG=42.5 GPa is the shear modulus mismatch between the matrix and the $Al_3Sc$ precipitates, and m is a constant taken to be 0.85. Finally, strengthening due to Orowan dislocation looping $\Delta\sigma_{Or}$ is given by:

$$\Delta\sigma_{Or} = M\frac{0.4}{\pi}\frac{Gb}{\sqrt{1-\nu}}\frac{\ln\left(\frac{2\sqrt{2/3}\langle R\rangle}{b}\right)}{\lambda} \tag{A4}$$

where ν=0.345 is Poisson's ratio for Al. The edge-to-edge inter-nanoprecipitate distance, λ, is taken to be the square lattice spacing in parallel planes, which is given by:

$$\lambda=[1.538\phi^{-1/2}-1.643]\langle R\rangle \tag{A5}$$

In Alloy 1 (without Mo and Mn), strengthening is only due to the precipitation of the $L1_2$-phase, which is solely controlled by their mean precipitate radius, volume fraction and lattice parameter mismatch. A strength increment is defined as ΔHV/3, where ΔHV is the difference between the measured Vickers microhardness of the precipitation strengthened alloy and the microhardness of pure Al, 200 MPa. For small precipitate radii (<2 nm), the strengthening is controlled by a shearing mechanism; the strength increment is given by taking the maximum value between ordering strengthening ($\sigma_{ord}$) and coherency and modulus strengthening ($\sigma_{coh}+\sigma_{mod}$). As the precipitates grow larger, Orowan dislocation looping ($\sigma_{oro}$) becomes the limiting mechanism, reducing the alloy's strength. The strengthening mechanism thus changes during the aging of the $L1_2$-precipitates. In the Mo/Mn-modified Alloys 2 and 3, a second precipitating phase is present, which is in addition to solid-solution strengthening. Due to their large sizes when compared to the $L1_2$-precipitates, the α-Al(Mn,Mo)Si precipitates are assumed to induce strengthening via the Orowan dislocation bypassing mechanism. The following relationships have been proposed to account for the strengthening of an alloy with multiple phases with distinct strengths:

$$\Delta\sigma_{ppt}^{n1}=\Delta\sigma_{L12}^{n1}+\Delta\sigma_{\alpha}^{n1} \tag{1}$$

where $n_1$ is between 1 and 2. Furthermore, the solid-solution strengthening ($\Delta\sigma_{ss}$) of a multicomponent alloy is described by:

$$\Delta\sigma_{ss}^{q} = \sum_i \Delta\sigma_i^q \text{ with } i = 1 \ldots U \tag{2}$$

where q is a concentration exponent, which is independent of the solute. The resulting strengthening effect depends on the constant q and can be smaller than, equal to or greater than the sum of the separate strengthening effects. The superposition of solid-solution ($\Delta\sigma_{ss}$) and nanoprecipitate strengthening ($\Delta\sigma_{ppt}$) is expressed by:

$$\Delta\sigma_{total}=(\Delta\sigma_{ss}^{n2}+\Delta\sigma_{ppt}^{n2}))^{1/n2} \tag{3}$$

where $n_2$ lies between 1 and 2, which implies that the linear superposition of strengthening effects is an upper bound of the alloy's strength. By using the 400° C. Vickers microhardness curve and the LEAP tomographic data at 24 h and 11 days for both alloys 1 and 2, the q and $n_2$ exponents can be determined and the strengthening associated with the solid-solution of Mo and Mn, and the $L1_2^-$ and α-precipitates estimated.

strength increment $\Delta\sigma_{L12}$ is calculated using the equations in Appendix A, which are shown in Table 6 below, while FIG. 6 displays its evolution as a function of the mean nanoprecipitate-radius. Data points from Alloy 1 are indicated for comparison.

TABLE 6

| | | Strength Increment (MPa) | | | | |
|---|---|---|---|---|---|---|
| Alloy | Aging | $\Delta\sigma_{ss}$ | $\Delta\sigma_{ord}$ | $\Delta\sigma_{coh}+\Delta\sigma_{mod}$ | $\Delta\sigma_{Or}$ | ΔHV/3 |
| Alloy 1 | 375° C./24 h | | 131 ± 13 | 150 ± 15 | 168 ± 17 | 142 ± 7 |
| | 375° C./21 days | | 137 ± 14 | 174 ± 17 | 143 ± 14 | 122 ± 7 |
| | 400° C./24 h | | 134 ± 13 | 168 ± 17 | 141 ± 14 | 125 ± 12 |
| | 400° C./11 days | | 142 ± 14 | 186 ± 19 | 129 ± 13 | 105 ± 6 |
| Alloy 2 | 400° C./24 h | 30 | 110 ± 11 | 130 ± 13 | 136 ± 14 | 172 ± 4 |
| | 400° C./11 days | 26.7 | 138 ± 14 | 178 ± 18 | 132 ± 13 | 147 ± 5 |
| Alloy 5 | 400° C./24 h | 15 | 145 ± 14 | 174 ± 17 | 164 ± 16 | 153 ± 8 |
| | 400° C./11 days | 5 | 151 ± 15 | 210 ± 21 | 125 ± 13 | 133 ± 7 |
| Alloy 6 | 400° C./24 h | 30 | 145 ± 14 | 177 ± 18 | 160 ± 16 | 162 ± 4 |
| | 400° C./11 days | 27.1 | 165 ± 14 | 229 ± 18 | 139 ± 13 | 148 ± 7 |

Experimental (ΔHV/3) and calculated strength increments (Eqns. A1-A4) from the $L1_2$ precipitates as estimated using LEAP tomographic datasets (Table 3). Data from Alloy 1 are included for comparative purposes.

The initial increase in the Vickers microhardness in the as-cast and homogenized states compared to the base alloy, 90±25 MPa, is due solely to the solid-solution strengthening produced by the Mn and Mo solute-atoms. Considering the measured matrix's composition of 0.22 at. % Mn and 0.088 at. % Mo (in solid-solution) these elements induce, separately, a strengthening of ~40 MPa and ~80 MPa, respectively. Therefore, per atom, Mo is a much more potent strengthener than is Mn. Using the measured value $\Delta\sigma_{ss}$=90 MPa in Eg. (2) yields an exponent q=2, which corresponds to a Pythagorean sum.

TEM investigations on a peak-aged sample (400° C., 24 h) did not reveal the presence of the α-Al(Mn,Mo) Si-phase, only $L1_2$-precipitates were detected. Thus, for this aging condition, $\Delta\sigma_{ppt}$ is equal to $\Delta\sigma_{L12}$. LEAP tomography on a sample aged to this same condition yielded the nanoprecipitate's parameters ($N_V$, ⟨R⟩, ϕ) (Table 3), which are comparable to the distribution measured previously in Alloy 1, aged 24 h at 375° C. Assuming that Mo and Mn do not change the type of nanoprecipitate strengthening-mechanism, then the precipitation strengthening contribution $\Delta\sigma_{ppt}$ in both alloys should be comparable. For this aging condition, alloy 1 displayed a Vickers microhardness of 628±20 MPa, which is ~90 MPa lower than alloy 4, and this is equal to the solid-solution strengthening contribution. Using Eq. (3) yields an exponent $n_2$=1, implying linear superposition of the strengthening effects of solid-solution and precipitation-strengthening. The exponent $n_2$=1 is in agreement with the estimation made for solid-solution strengthening of a precipitation strengthened Al—Sc alloy by Li (Al-2.9Li-0.11Sc) or Mg (Al-2.2 Mg-0.12Sc).

Upon over-aging at 400° C. for 1 to 11 days, the concentration of Mn in solid-solution in the matrix decreases from 0.22 to 0.045 at. %, while the Mo concentration does not change significantly (Table 4). The strength increment from the Mn solid-solution decreases from ~40 to ~8 MPa. Using the constant q=2 a value $\Delta\sigma_{ss}$=80 MPa is determined for the 11 day overaged sample, employing Eq. (1). This small MPa decrease demonstrates that solid-solution strengthening from Mn is overshadowed by Mo. Due to the extraordinarily small diffusivity of Mo in Al, $\Delta\sigma_{ss}$ is not anticipated to decrease further upon additional aging at 400° C.

Figure 6:
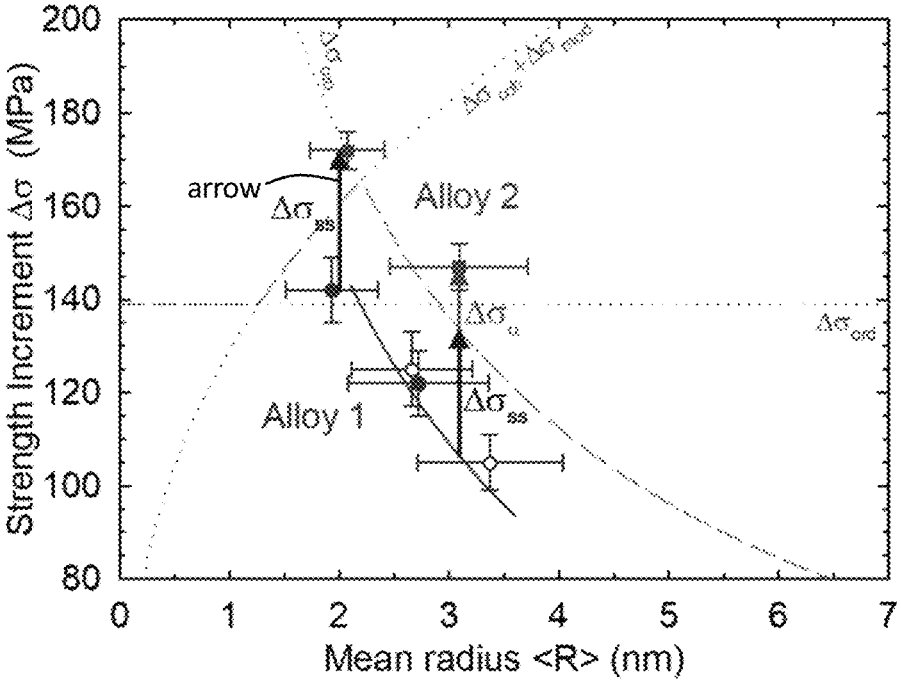

Based on the L12 nanoprecipitate distribution, as measured by LEAP tomography (Table 3), their associated The dot/dashed lines in FIG. 6 represent the strength increment from the $L1_2$ precipitates, with a volume fraction of 0.35%, which was estimated using LEAP tomography for both overaged alloys. Due to the strong dendritic segregation of solute atoms and small LEAP tomographic-dataset volume sizes, the effective volume fraction of precipitates in the sample is smaller than what is measured by LEAP tomography, resulting in an overestimation of the $L1_2$ nanoprecipitation strengthening mechanism. This should affect equally both alloys 1 and 2 and is thus not of concern for further comparisons. With a precipitate median radius of 2 nm, the alloy strengthening mechanism at the peak aging time is at the intersection point between the shearing and Orowan bypassing mechanisms (FIG. 6), the latter mechanism becomes dominant beyond the peak aging time.

As previously discussed, the difference in the Vickers microhardnesses between Alloys 1 and 2, both with precipitate mean radii of ~2 nm, can be explained by the solid-solution strengthening mechanism ($\Delta\sigma_{ss}$/3=30 MPa) as indicated by the arrow (FIG. 6). For overaged Alloy 2, with an $L1_2$-nanoprecipitate mean radius of ~3.1 nm, the solid-solution strengthening effect is slightly smaller due to the loss of Mn from the matrix ($\Delta\sigma_{ss}$/3=26.7 MPa). The overaged alloy 2 displays, however, a strength increment higher by ~13.5 MPa (microhardness+40.5 MPa) than what the $L1_2$-precipitates alone should contribute for the measured volume fraction (FIG. 6). Although Mo dissolves significantly in the $L1_2$-precipitates (up to 2 at. %) and its effect is unknown on the lattice parameter mismatch (but possibly affecting its shearing resistance); it is, therefore, unlikely that it would affect the Orowan bypassing strengthening mechanism. The additional strengthening is most probably due to the α-Al(Mn,Mo)Si precipitate strengthening, which superposes over the $L1_2$ strengthening. It is not possible, however, to determine from the available data the value of the $n_1$ exponent in Eg. (1), which applies to our situation. Since $1<n_1<2$ and employing the reported results from FIG. 6, we estimate $\Delta\sigma_\alpha$ to lie between 13.53 and 61 MPa. Casting and aging an Al-0.10Si-0.40Mn-0.09Mo-alloy free of $L1_2$-forming elements would allow one to measure the precipitation strengthening associated with the α-Al(Mn, Mo) Si-phase alone and to estimate $n_1$. We can expect, however, that the precipitation of the submicron α-Al(Mn, Mo)Si phase produces a stronger strengthening effect than when the Mn is in solid-solution.

Mo—Mn Effect on Alloy's High-Temperature Stability

The improvements in mechanical properties and high-temperature stability achieved employing Mo and Mn additions are due to multiple effects. Analyses of the Vickers microhardness curves in conjunction with the SEM and LEAP tomographic observations permit us to determine the mechanisms causing the improvements. As discussed, Mo and Mn produce solid-solution strengthening, $\Delta\sigma_{ss}$ of 90±25 MPa. This does not, however, explain the observed high temperature stability at 400 and 425° C. To highlight this difference, FIG. 7 displays the change of Vickers microhardness of Alloy 2 when aged at 400 and 425° C. and is compared to the Vickers microhardness of Alloy 1 onto which $\Delta\sigma_{ss}$=90 MPa is added (dashed lines).

As explained, for at least 24 h at 400° C., no α-Al(Mn,Mo)Si precipitates are observed and hence no change in solid-solution strengthening is anticipated. Variations in the peak Vickers microhardness was observed among samples (FIG. 2*a*), probably due to small changes in concentrations and/or cooling-rates across the arc-melted button. Taking the average Vickers microhardness curve, the increased microhardness shown in FIG. 7 can be explained considering only the solid-solution strengthening effect up to 24 h. Also, the sample displaying a Vickers microhardness of 720 MPa in FIG. 2*a* is clearly an outlier. As some regions in the ingot may have larger nanoprecipitate radii than the reported LEAP tomography results. The long-time Vickers microhardness values are consistent among samples. The much higher number-density of precipitates ($8.57\times10^{22}$ $m^{-3}$) is associated with the presence of Mn, while their smaller radii is associated with Mo inhibiting both the growth and the coarsening kinetics. Beyond 24 h, adding the solid-solution strengthening to Alloy 1 does not suffice to explain the higher Vickers microhardness values in Alloy 2, which has discrepancies as high as 120±20 MPa. As discussed, $\Delta\sigma_{ss}$ was estimated to be at least 80 MPa after the formation of the α-Al(Mn,Mo)Si phase. This difference can be associated with multiple effects; the better coarsening resistance of the $L1_2$-precipitates induced by the partitioning of the extremely slow-diffusing Mo atoms; to precipitation strengthening from the submicron α-Al(Mn,Mo)Si precipitates; and to the concomitant consumption of Si, which is nearly fully scavenged from the Al-matrix. Silicon is known to enhance solute diffusion, particularly for M=Sc, Zr or Er, due to the formation of Si-vacancy-M trimers. The removal of Si from the matrix decelerates indirectly the diffusion-limited Ostwald ripening process by vitiating Si's accelerating effect on the diffusivities of Sc, Zr and Er.

Figure 7:
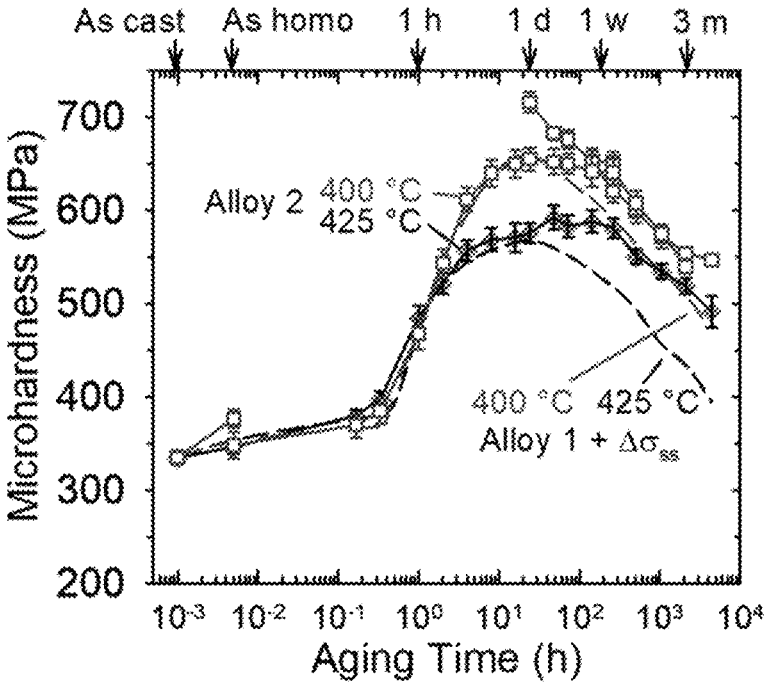
FIG. 7 is a graph illustrating temporal evolution of the Vickers microhardness for Alloy 2 for an aging temperature of 400° C. (open squares) and 425° C. (solid diamonds), after homogenization where dashed lines represent the estimated Vickers microhardness by adding the solid-solution strengthening contribution ($\Delta\sigma_{ss}$) to the microhardness of Alloy 1.

Still referring to FIG. 7, the improvement in high-temperature stability is most noticeable at 425° C. An additional strengthening contribution greater than the solid-solution strengthening contribution is evident after only 4 h of aging, and further increases with aging time. Alloy 2 achieves a Vickers microhardness up to 170±15 MPa greater than that of Alloy 1 during aging, and up to 80 MPa greater than what solid-solution strengthening can contribute. The Vickers microhardness of Alloy 2 after aging 88 days at 425° C. is higher than the peak microhardness achieved after 24 h by the base alloy, again indicating an improved coarsening resistance at high-temperature and establishing a high-temperature stability of Alloy 2. The stronger coarsening resistance at 425° C. than at 400° C. may be related to the higher mobility of Mo at this temperature, which may permit stronger partitioning to the $L1_2$-precipitates, thereby further improving the resistance to coarsening (Ostwald ripening). This effect is anticipated to prevent the fast coarsening of the α-Al(Mn,Mo)Si precipitates. Although the precipitation strengthening capabilities of these submicron precipitates is unknown in detail, it appears to be significant. The homogeneous distribution of submicron α-Al(Mn,Mo)Si precipitates throughout the dendritic structure should also strengthen the $L1_2$-depleted interdendritic channels.

Figure 1:
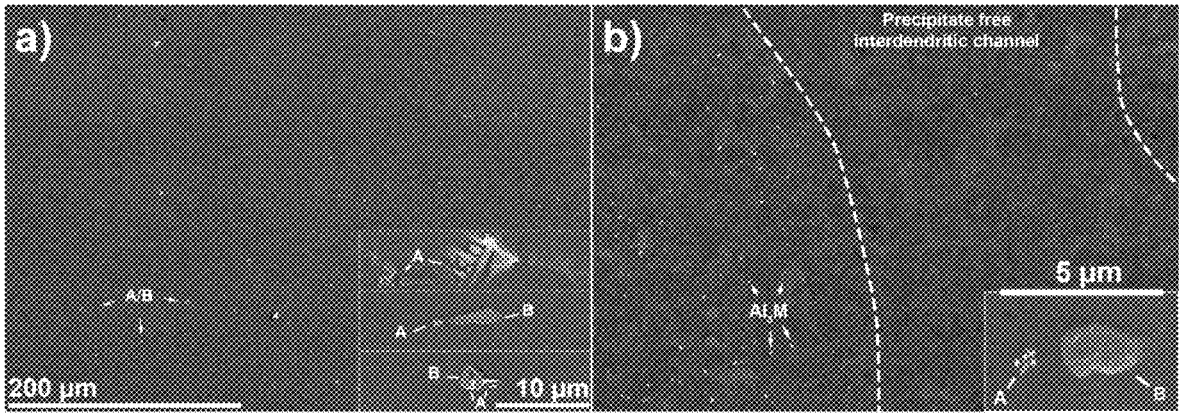

Accordingly, the combined Mo and Mn additions to the Alloy 1 increase both the peak-aging strength and the coarsening resistance at high temperatures, thereby improving the operating temperature and the service time. SEM observations reveal the formation of two types of micrometer-size primary precipitates: Er—Si-rich and Mn—Si—Fe-rich. A 2 h homogenization step at 640° C. dissolves most of the former but not the latter primary precipitates, indicating that the amount of Mn in the alloy can be reduced without a loss of strength (FIG. 1). APT measurements of matrix composition performed on a sample aged at 400° C., where the maximum amount of Mn is in solid solution, permits an estimation of the optimal concentration of Mn of 0.22 at. % (Table 5) to prevent Mn—Si—Fe-rich precipitation.

In the homogenized state, a 90 MPa increase in Vickers microhardness is observed by Alloy 2 over Alloy 1, which is assigned to solid solution strengthening.

Alloy 2 exhibits a very high peak Vickers microhardness, 720 MPa, when aged at 400° C., due to $L1_2Al_3$(Zr,Sc,Er)-precipitates. Manganese and Mo do not affect the early Vickers microhardness response. The incubation time and the time to achieve the peak Vickers microhardness are unchanged, verifying that the accelerating effect of Si on the diffusion kinetics enhancement is still active. Moreover, the Vickers microhardness decreases more slowly during overaging at 400° C., when compared to the base alloy, indicating an improved high-temperature stability which is even more pronounced at 425° C. (FIG. 2*b*).

In addition to the initial solid-solution strengthening, the origin of the improved strength and coarsening resistance of this new alloy are revealed by LEAP tomographic observations:

For the same aging duration, as compared to the base alloy, the new alloy exhibits a doubling in number density of $L1_2$ precipitates (close to $10^{23}$ $m^{-3}$ at peak aging), while their radius is smaller and both changes strengthen the alloy (Table 3).

Similar to Alloy 1, these $L1_2$ precipitates exhibit initially a core-shell structure, with a Sc, Zr, Er and Si-rich core surrounded by a Zr-rich shell. Furthermore, Mn is found to partition slightly to the core of the precipitates, while Mo partitions to the shell. The partitioning of the slow-diffusing Mo atoms is anticipated to decrease the coarsening rate of the precipitates (FIG. 4).

During aging, the core-shell structure becomes partially homogenized. The mean nanoprecipitate composition shows that Zr accounts for ~20 at. %. Molybdenum is found to be more homogeneously incorporated in the core-shell structure, while Si and Mn are scavenged from the $L1_2$ precipitates by coarser submicron α-Al(Mn,Mo)Si precipitates as described in greater detail below.

Beside the $L1_2Al_3$(Zr,Sc,Er) equiaxed precipitates, platelet-shaped precipitates with submicron size (0.5-1.4 μm in length and <100 nm in thickness), identified as α-Al(Mn,Mo)Si, are observed by SEM after overaging at 400/425° C. for 11 days. Thus, 0.1 at. % Si is sufficient to induce the formation of the α-Al(Mn,Mo)Si phase (FIG. 5).

Iron, a common contaminant in aluminum, can be tolerated at a level of 150 at. ppm. Its addition does not improve hardness (FIG. 2) (e.g., by replacing some Mn in the α-phase thus creating α-Al(Fe,Mn,Mo)Si precipitates at higher number density and/or volume fraction), but rather increases the volume fraction of the Mn—Si—Fe-rich primary precipitates.

The α-precipitates are homogeneously distributed across the dendritic structure except for precipitate-free zones along grain boundaries (FIG. 5). These submicron α-precipitates within the grains induce strengthening of the interdendritic channels, which are depleted in $L1_2$ precipitates. This precipitation strengthening is expected to compensate for the reduced solid-solution strengthening related to the associated consumption of Mn and Mo.

The compositional evolution of the matrix during overaging, as measured by APT tomography, confirms the depletion of Si and Mn from the Al-matrix (Table 4). These elements are scavenged by the α-Al(Mn,Mo)Si phase after the formation of the $L1_2$ precipitates, whose coarsening rate is thus indirectly reduced by removing Si from the solid-solution. The α-Al(Mn,Mo)Si phase was indirectly estimated to be $Al_{19}Mn_{5.4}Si_2$. The Mo content could not be estimated.

Alloy 4—Effects of Mo and Mn Micro-Additions on High Temperature Mechanical Properties A conventional casting of Alloy 2 was produced (referred to herein as "Alloy 2b") for study and the concentration of Mn was reduced from 0.4 at % in Alloy 2 to 0.25 at. % in Alloy 4. As cast and homogenized characterization were performed to identify primary precipitate and observe their possible dissolution. After initial testing, it was found that Mn-lean Alloy 4 exhibited comparable hardness to Mn-rich Alloy 2b. Alloy 4 was isochronally aged to identify the temperature at which the precipitates dissolves and to compare any delayed kinetic with Alloy 1. To measure the high temperature mechanical properties of the alloy, compressive creep experiments at 300° C. and 400° C. were performed on samples aged at 400° C. for 24 h and 11 days. Alloy 1 was also crept at 400° C. for comparison.

As Cast Microstructure and Homogenization

Figure 8:
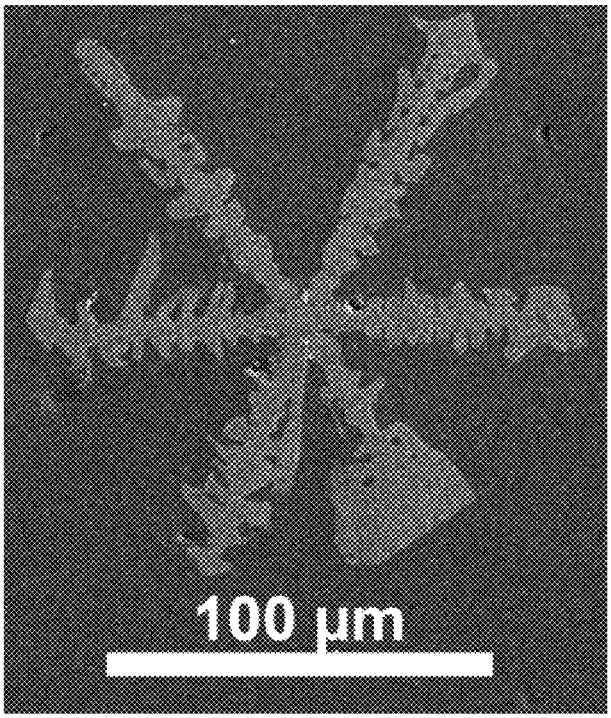
FIG. 8 is an SEM image of a snowflake-shaped primary precipitate observed in as-cast Alloy 2b.
Figure 9:
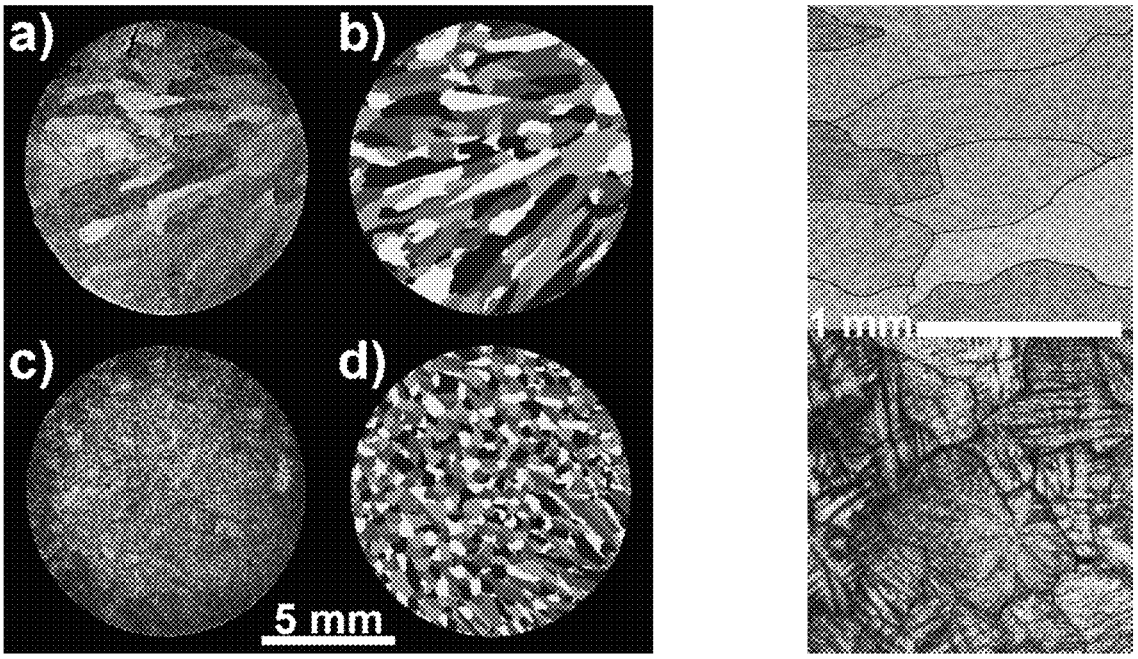
FIG. 9 shows optical microscopy images of post-creep samples subjected to creep testing at 400° C. and etched with Tucker's reagent where: (a) is the microstructure of Alloy 1; (b) is the microstructure of Mo—Mn-modified Alloy 4; (c) is the microstructure of Alloy 1 with grains manually colored for clarity; and (d) is the microstructure of Alloy 4 grains manually colored for clarity.

Similar to Alloys 1-3 (cf. FIG. 1), Er—Si rich primary precipitates were detected in the as-cast state for both Alloy 2b and Alloy 4. These precipitates readily dissolve upon homogenization annealing at 640° C. Optical microscopy and SEM observations on Alloy 2b revealed, however, formation of snowflake-shaped primary precipitates, >100 μm in size as shown in FIG. 8. Such snowflake-shaped primary precipitates were not observed in the arc melted Alloy 2 due to a different cooling rate. These snowflake-shaped primary precipitates were observed across the ingot, usually in a dozen locations per 1 $cm^2$ samples. The composition was estimated by EDS as $Al_{12}$(Mn,Mo). These snowflake-shaped primary precipitates were also not found in the Mn-leaner Alloy 4. Some grain-boundary (GB) primary Mn—Si rich phases were detected in Alloy 4, but to a much lower extent than in the arc melted Alloy 2 with increased Mn. To investigate possible effect of Mo and Mn on grain sizes, cross sections of 1 cm diameter post-creep samples were prepared metallographically and imaged by optical microscopy as shown in FIG. 9. While Alloy 1 displays extremely elongated grains, sometimes up to 6 mm long, Alloy 4 exhibit an equiaxed structure of smaller grains. Average grain sizes of 0.6±0.4 mm and 0.35±0.2 mm are measured in Alloy 1 and Alloy 4, respectively. The addition of Mo and Mn to Alloy 4 thus induces grain refinement, which is normally associated with poorer diffusional creep properties.

Figure 10:
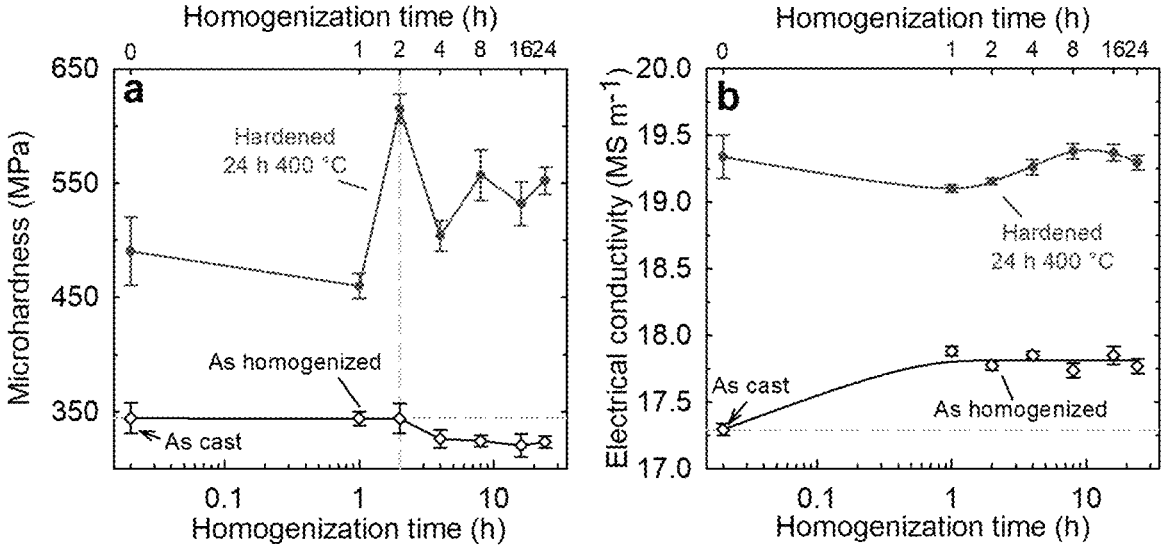
FIG. 10 is a pair of plots showing: (a) Vickers microhardness verses homogenization time for homogenization of Alloy 4 at 640° C. with and without a hardening treatment at 400° C. for 24 hours; and (b) electrical conductivity versus homogenization time for homogenization of Alloy 4 at 640° C. with and without a hardening treatment at 400° C. for 24 hours.

The conventionally casted Alloy 2b with 0.40 at. % Mn and Alloy 4 with 0.25 at. % Mn displayed as cast microhardnesses of 407±28 MPa and 344±13 MPa, respectively. Upon homogenization (2 h at 640° C.), the microhardness of Alloy 2b decreased to 367±10 MPa. This decrease is associated with an increase in electrical conductivity from 14.84±0.05 $MS \cdot m^{-1}$ to 15.17±0.12 $MS \cdot m^{-1}$. In the case of Alloy 4, the microhardness is stable up to 2 hours at 640° C. before decreasing slightly to 323±7 MPa after 4 h. The microhardness is then stable for at least 24 h as shown in FIG. 10*a*. For Alloy 4, the electrical conductivity curve in FIG. 10*b* shows an increase of conductivity from 17.29±0.05 $MS \cdot m^{-1}$ in the as-cast state to 17.8±0.08 $MS \cdot m^{-1}$ after homogenization. The decrease of microhardness after homogenization and the increase of electrical conductivity can be associated to the loss of supersaturated Mn which is higher in the Mn-richer Alloy 2b. This homogenization step is however needed to dissolve the Er—Si rich primary precipitates so as to increase number density of $L1_2$ nuclei and increase the $Al_3M$ lattice mismatch. To assess the precipitation hardening capabilities of Alloy 4, the alloy was aged for 24 h at 400° C. following the homogenization annealing. FIG. 10*a* shows the hardness curve associated response to this peak-aging treatment for Alloy 4.

Based on these data, 2 h at 640° C. was identified as the optimal homogenization time for Alloy 4 which is long enough for dissolution of the Er—Si primary precipitates, but short enough to prevent excessive loss of solute by formation of large spherical $Al_3M$ precipitates (FIG. 1*b*) and loss of solid solution strengthening, as evidenced by the reduced homogenized microhardness beyond 2 h (FIG. 10*a*). Alloy 2b displayed the same microhardness values as Alloy 4 after being homogenized 2 h at 640° C. and aged at 400, 425 and 450° C., from 10 min to 44 days (not shown). Considering that both alloy displays similar peak microhardnesses upon aging and that the lower Mn concentration prevent formation of primary $Al_{12}$(Mn,Mo) the Mn-leaner Alloy 4 was studied in greater detail.

Isochronal Aging

The thermal stability of the precipitates in Alloy 4 were studied via isochronal aging experiments after homogenization for 2 h. The data are compared in FIG. 11 with Alloy 1 homogenized for 8 h. Due to the very large difference in electrical conductivity between the two alloys, stemming from the addition of Mn and Mo, the alloys are displayed on different axes in FIG. 11*b*, the left axis for Alloy 1 and the right axis for Alloy 4. Both axes are scaled over the same range of 6 $MS \cdot m^{-1}$, so that the homogenized EC curves can be compared directly.

For Alloy 1, between 100 and 200° C., the microhardness and electrical conductivity curves show a small linear increase of microhardness. The slope increases between 200 and 300° C. and this is associated with the co-precipitation of Er and Sc, which happens at such temperatures. At 300° C., a microhardness of 286±6 MPa is obtained. Starting with 325° C. and up to 400° C., the electrical conductivity sharply increases due to the precipitation of Zr from the matrix. This induces a drastic increase in microhardness, which peaks at 400° C. at 587±20 MPa. At higher temperatures, the microhardness first decreases due to precipitate coarsening, since no decrease in electrical conductivity is observed up to 475° C. At even higher temperatures, the electrical conductivity decrease is also associated with precipitate dissolution. Alloy 1 shows a homogenized conductivity of 30.55±0.05 $MS \cdot m^{-1}$, which increased to 33.8±0.10 $MS \cdot m^{-1}$ at 450° C.

and stayed constant through 475° C. The precipitation of the $L1_2$ precipitates for this alloy thus induced a change of 3.25 $MS \cdot m^{-1}$.

For Alloy 4, the homogenized electrical conductivity was 17.8±0.03 $MS \cdot m^{-1}$, illustrating the strong effect on conductivity of Mn and Mo in solid solution. Similar to Alloy 1, from 100 to 200° C., the electrical conductivity and microhardness only slightly increase. The rate of change of electrical conductivity and microhardness increase slightly at 225° C., similar to Alloy 1. However, in comparison, the rate of change is strongly reduced, and the temperature range for which the rate is nearly constant is extended to 350° C., which is 50° C. higher than for Alloy 1. This change represents the co-precipitation of Er and Sc. For temperatures between 350 and 425° C., the slope on the electrical conductivity curve further increases and significant precipitation strengthening is observed on the microhardness curve. At 400° C., the achieved microhardness is the same as the peak microhardness (584±17 MPa) for Alloy 1. Alloy 4 microhardness further increases, reaching 614±15 MPa at 425° C. and marking the beginning of a plateau, up to 475° C. This change in microhardness and electrical conductivity can be associated with the precipitation of Zr. The electrical conductivity further increases with temperature, reaching 22.32±0.09 $MS \cdot m^{-1}$ at 500° C. Although the electrical conductivity increased up to 500° C., the microhardness started to decrease, indicating that precipitates are coarsening. At higher temperature, the electrical conductivity starts to decrease as expected from dissolution of precipitates Compressive Creep at 300° C.

To investigate the effects of Mo and Mn joint additions on creep strength, samples of Alloy 4 were creep tested in two conditions: (i) annealed to peak strength at 400° C. for 24 h, where only $L1_2$ precipitates are present and (ii) overaged at 400° C. for 11 days, where both $L1_2$ and α-Al(Mn,Mo)Si precipitates are present. As the creep experiments are performed at 300° C., well below the aging temperature, no significant coarsening of the precipitates occurs during the creep experiment. Referring to FIG. 12 a double-logarithmic plot of the minimum compressive creep strain-rate versus applied stress during creep experiment at 300° C. for Alloy 4 is shown. Data from literature references are also included for comparison for L12-strengthened Alloy 1 (aged for 24 h at 375° C. and for 264 h at 400° C.) and for a ternary Al-0.06Sc-0.02Er alloy (aged at 300° C. for 24 h or 384 h). Data from two Si-rich alloys with α-strengthening Al-6.3Si-0.34Mg-0.21Cu-0.05Fe-0.05Ti (at. %), modified with 0.09Mo and 0.09Mo-0.08Mn, are also included. Due to the presence of high amount of Si, Mg and Cu, these alloys had a more complex annealing procedure and microstructure: 4 h at 500° C. followed by 1 h at 540° C.; water-quenching; and 5 h at 200° C. In addition to the α-Al(Fe,Mn,Mo)Si precipitates, θ-$Al_2Cu$, Q-$Al_5Cu_2Mg_8Si_6$ and π-$Al_8FeMg_3Si_6$ are also present and produce strengthening at ambient temperature. The creep tests were performed after soaking at 300° C. for 100 h.

For Alloy 4, two peak-aged and one overaged samples were tested (FIG. 12). The two peak-aged samples showed overlapping curves. High apparent stress exponents are observed ($n_{ap}$ between 50 to 60), which are indicative of a threshold stress, below which creep is not measurable. Unlike Alloy 1, overaging the Alloy 4 sample for 10 days at 400° C. induced a shift of the curve by 4 MPa toward lower stresses and it is possible the Alloy 4 sample had a macroscopic flaw.

Compressive Creep at 400° C.

Compressive creep experiments were performed at 400° C. for both Alloy 1 and Alloy 4, allowing to highlight the effects of Mo and Mn on high temperature creep as shown in FIG. 13. Both alloys were peak-aged at 400° C. for 24 h. Alloy 1 was also overaged for 11 days at 400° C. To ensure that the microstructure did not significantly change during the creep test at such high temperature, the alloys were initially tested for durations less than 2 days (Alloy 1: ■○, Alloy 4 ●), at relatively high strain rates which nevertheless allowed us to estimate the dislocation threshold stress. To investigate diffusional creep at low strain rates, a second series of test was performed with initial stresses lower than the alloy's dislocation threshold stress. These tests lasted 22 and 16 days for Alloy 1 (□) and Alloy 4 (○), respectively. Data from Al-0.055Sc-0.005Er-0.02Zr-0.09Si peak-aged (double aged at 300° C. for 4 h and 425° C. for 8 h) and overaged (double-aged and subsequently at 400° C. for ~200 h), and for Al-0.05Sc-0.01Er-0.06Zr-0.03Si peak and overaged are also included for comparison in FIG. 13*a*. Alloy 1 showed comparable creep resistance to an overaged Al-0.05Sc-0.01Er-0.06Zr-0.03Si alloy, while Alloy 4 is stronger than the Al-0.055Sc-0.005Er-0.02Zr-0.09Si alloy, peak or overaged. Apparent stress exponent of $n_{ap}$ of 43 and 30 for Alloy 1 and Alloy 4, respectively, are indicative of a dislocation-climb threshold stress.

Diffusional creep was observed on both alloys at strain rates under $5\times10^{-9}$ and $2\times10^{-9}$ $s^{-1}$ for Alloy 4 and Alloy 1, respectively. In comparison, the previous alloys exhibited diffusional creep at strain rates of $10^{-8}$ $s^{-1}$ or higher. To identify the likely diffusional creep mechanisms in Alloy 1 and Alloy 4, optical microscopy was performed on post-creep samples (subjected to the long duration tests) and grain sizes (width of fitted ellipses) were measured (cf. FIG. 9) at 0.6 mm and 0.35 mm, respectively. FIG. 15*a* shows for Alloy 1 after 8 h homogenization at 640° C. for 8 h, platelet-like $DO_{23}Al_3$(Zr,Sc,Er) precipitates on the grain boundaries which cannot be dissolved upon aging due to the slow diffusion of Zr. In comparison, in the high-Er Al-0.05Sc-0.01Er-0.06Zr-0.03Si alloy, intragranular grain boundaries $Al_3Er$ primary precipitates were found, with the later undergoing Ostwald ripening upon aging, thus reducing their density. The $Al_3Zr$ precipitates are relatively widely spaced along the grain boundaries, with distances varying between ~10 μm to >100 μm. In Alloy 4, Mn—Si-rich primary precipitates are formed on grain boundaries upon casting, which are not dissolved upon homogenization. Typical distances along grain boundary are between 20-50 μm. Due to the short 2 h homogenization time, precipitation of $Al_3Zr$ at grain boundaries is prevented. However, upon aging at 400° C., new α-AlMnSi precipitates forms on grain boundaries, with typical distances of 1-2 μm as shown in FIG. 15*b*.

Origin of Microhardness Improvements in Alloy 4

In order to isolate the improvement on precipitation strengthening from solid solution strengthening induced by Mo and Mn addition, FIG. 14*a* displays the difference of microhardness IHV (i.e., difference of hardness of Alloy 4 compared to hardness of Alloy 1) during isochronal aging. A solid solution strengthening $\sigma_{ss}$~80 MPa is measured in the as-homogenized state. Although Alloy 2 and Alloy 4 have different Mn content (0.4 and 0.25 at. %, respectively), they both display the same extent of solid solution strengthening. This confirms the validity of the estimation of the optimal amount of Mn, 0.22 at. % (made using the APT values of Mn solubility in the matrix of alloy 2), the remnant Mn (0.40-0.22=0.28 at. %) being part of primary precipitates. This hardness difference of ~80 MPa is maintained up to 300° C. FIG. 14*a* also shows a negative microhardness valley at 375° C. This is due to the delayed increase of microhardness for Alloy 4, induced by Mo and Mn addition. While Alloy 1 shows its peak hardness at 400° C., the microhardness of Alloy 4 peaks in a wide plateau stretching from 425° C. to 475° C. As shown in FIG. 14*a* this results in an improved microhardness value as high as 140 MPa when compared to Alloy 1, which is 60 MPa higher than the solid solution strengthening contribution. This improvement is due to the better coarsening resistance of the $L1_2$ precipitates, but also to the precipitation of the α-Al(Mn,Mo)Si phase, as previously estimated for the arc melted Alloy 2 and Alloy 3. As the temperature is further increased to 500° C. and beyond, the differences of microhardness between the two alloys decreases. At 575° C., the difference of microhardness is back to its initial homogenized value of 80 MPa due to solid solution strengthening (FIG. 14*a*).

Modification of the Precipitation Kinetic

The electrical conductivity of an alloy is affected by strong scattering of electrons by point defects in the matrix, and to a smaller extent by the presence of precipitates. Following the change in electrical conductivity or inversely its electrical resistivity, p, allows to monitor the change in the matrix composition and the precipitation process. At a low defect concentration, the increase in resistivity is proportional to the concentration of impurities. However, due to the presence of six dilute alloying elements in Alloy 4—Mn, Si, Mo, Zr, Sc, Er—it is not possible to monitor precisely the change in matrix composition associated to each element. It is however possible to identify the temperatures at which the different reactions occur by plotting the negative numerical derivatives of the resistivity as shown in FIG. 14*b* thereby identifying specific temperatures at which the rate of change of resistivity is the fastest for a given heating rate. Comparing both curves for both Alloy 1 and Alloy 4 allows shift of peaks induced by the Mo and Mn joint additions to be observed.

As previously mentioned, the first peak (I) at 225° C. was not affected by the new alloy composition of Alloy 4 and corresponds to co-precipitation of Er and Sc. However, the peak associated with Zr precipitation (IIa) at 375° C. in Alloy 1 is shifted to 400-425° C. (IIb) for Alloy 4 and is consistent with a reduction of the growth of the $Al_3Zr$ precipitates. This confirm the observation made by atom probe tomography on the arc melted Alloy 2 which showed smaller precipitate radii than Alloy 1 for the same aging duration (Table 3). The broadening of the IIb peak indicates the consumption of Er, Sc and Zr has been reduced. As the temperature is further increased, the rate of electrical conductivity change in Alloy 4 drastically rises, peaking at 475° C. (peak III in FIG. 14*b*). This peak was not present in Alloy 1 and since the temperature range at which Sc, Er and Zr precipitation is significant is less than 475° C., it can be assumed that this change is related to precipitation of Mn, Si and Mo to form the α phase. This point is further supported by the fact that the total change in electrical conductivity between the homogenized state and peak electrical conductivity, which is 4.5 $MS \cdot m^{-1}$, is significantly higher than the 3 $MS \cdot m^{-1}$ measured in Alloy 1 and associated with peak IIa. Due to the precipitation of the α-phase and the strong effect it has on electrical conductivity, it is not possible to identify the temperature at which the $L1_2$ precipitates dissolve as shown for Alloy 1. However, since the peak IIb is shifted toward a higher temperature and that a plateau of microhardness is maintained from 425° C. to 475° C. (FIG. 11*a*), the coarsening of $L1_2$ precipitates is slowed down, while the hardness drop due to $L1_2$ coarsening is counterbalanced by the hardness increase due to α-phase precipitation. The microhardness of Alloy 4 peaks at 475° C. while the peak electrical conductivity is at 500° C., indicating that precipitates are coarsening. The dissolution of precipitates begins at 525° C., evidenced by the decrease in electrical conductivity and the negative numerical derivative shown in FIG. 14*b*. Due to the presence of two types of precipitates, it is not possible to identify the temperature at which the $L1_2$ precipitates start to dissolve. The decrease in microhardness at 500° C. can be due to coarsening of $L1_2$ precipitates, coarsening of a precipitates, and/or dissolution of $L1_2$ precipitates. However, the fast reduction of electrical conductivity at temperatures higher than 500° C. is evidence of significant amount of solute being released back in the matrix. The decreasing slope of electrical conductivity of Alloy 4 is steeper than for Alloy 1, consistent with the simultaneous dissolution of both a and $L1_2$ precipitates. The isochronal aging experiments clearly support the increased thermal stability of Alloy 4, keeping a stable microhardness up to 475° C. which is 75° C. higher than the maximum achieved in the Alloy 1, and showing a higher peak microhardness. This microstructural stability (up to 475° C. for short times), together with the very high creep strength at 300° C., points to the ability of this alloy to be creep-resistant for long testing times at 400° C. and higher.

Accordingly, the effects of micro-additions of 0.11 at. % Mo and 0.25-0.4 at. % Mn to Alloy 1 increased the peak-aging strength and temperature during isochronal aging. Alloy 6 (Al-0.08Zr-0.02Sc-0.009Er-0.10Si-0.25Mn-0.11Mo) displayed extremely enhanced creep resistance at both 300° C. and 400° C. The observed mechanical properties of this new alloy represent a clear advance in the high-temperature performance of aluminum alloys. Specifically, the following conclusions were reached:

Additions of 0.25 at. % Mn is preferable to 0.40 at. % Mn, as both alloys exhibit the same hardness upon under-, peak- and overaging, but only the latter alloy shows primary snowflakes-like $Al_{12}$(Mn,Mo) precipitates (>100 μm in size) (FIG. 8).

Similar to Alloy 1, primary Er—Si-rich precipitates form upon casting. These precipitates can be dissolved upon a homogenization annealing at 640° C. for 2 h while preventing loss of solid solution strengthening, and yield optimal peak microhardness (as compared to shorter or longer times) upon a subsequent precipitation annealing.

The addition of 0.11Mo and 0.25Mn to Alloy 1 induced grain refinement: the millimeter-long elongated grain structure observed in the base alloy changed to an equiaxed structure and the average grain size is reduced from 0.6 mm to 0.35 mm.

An 80 MPa solid solution strengthening $\sigma_{ss}$ is induced by the addition of 0.11Mo and 0.25 Mn.

During isochronal aging experiments, Mn and Mo additions do not affect the co-precipitation of Er and Sc into $Al_3$(Sc,Er) at 200-225° C. but slow down the subsequent Zr precipitation—forming $Al_3$(Zr,Sc,Er)—shifting it towards higher temperature by ~50° C. to 400-425° C. Peak precipitation temperature for Mo, Mn and Si to form α-Al(Mn, Mo)Si precipitates occurs at 475° C. A peak microhardness of 614±15 MPa is reached at 425° C. and maintained up to 475° C.

Under compressive creep at 300° C., the Mo and Mn modified alloys (Alloys 2b and 4) exhibit a threshold stress for dislocation climb of 36.4±0.1 MPa at peak-aging (with fine $L1_2$ precipitates) and 32.4±0.1 MPa, for the overaged conditions (with coarsened $L1_2$ precipitates and α-AlMnSi precipitates). Alloy 1 shows smaller threshold stresses of 17.5±0.6 MPa and 19.3±0.6 MPa in the peak- and overaged conditions, respectively. At 400° C., Alloy 4 at peak aging has threshold stress of 23.5±0.4 MPa, almost twice that of Alloy 1 at 13.1±0.03 MPa. This improvement in dislocation creep resistance is expected to originate from the Mo and Mn solid solution strengthening, and also from the segregation of Mo into the $L1_2$ precipitates, as found by APT.

Diffusional creep at 400° C. was observed for both Alloy 1 and Alloy 4. A threshold stress $\sigma_{th}^{diff}$ of 5.8±0.2 MPa is determined for Alloy 1. For Alloy 4, it is expected to be higher than for Alloy 1, possibly in the 13-15 MPa range.

The observed diffusional creep threshold stresses are consistent with the presence of $Al_3Zr$ precipitates along grain boundaries for Alloy 1, and α-AlMnSi for Alloy 4. The higher density of precipitates Alloy 4 is expected to reduce grain boundary sliding, and, considering the observed grain size, explain the measured low diffusional creep.

Alloys 5 and 6—Effect of Separate or Joint Addition of W and Mo on Microstructure and Mechanical Properties Molybdenum was substituted with W in Alloy 5 and W was added to the Mo—Mn modified Alloy 4 to study a synergistic interaction between these two elements. As cast and homogenized characterization by EPMA confirmed segregation of W in the dendritic structure and monitoring of the W in the homogenization of the alloy. Isothermal aging at 400, 425 and 450° C. illustrated the effect of W on precipitation hardening and synergistic interaction with Mo. APT characterization revealed segregation of W into the shell of the $L1_2$ precipitates and the composition of the α-Al(Mn,Mo,W)Si has been measured by APT.

As Cast Microstructure and Homogenization

SEM observation revealed the Er—Si rich $L1_2$ and α-Al(Mn,Mo')Si precipitates observed in the Al—Zr—Sc—Er—Si—Mn—Mo alloys (Alloys 2 and 4) and the microstructure of Alloy 5 and Alloy 6 were comparable. FIG. 16*a* shows EPMA concentration profiles measured across the dendritic structure of Alloy 6 and thereby allowing measurement of the segregation of each of the alloying elements to the channels or dendrite core. The concentration profiles allow identification of the eutectic and peritectic elements in the system. Particularly, Sc, Mn, Si and Er are eutectic elements and are found segregated in the interdendritic channels and into primary precipitates, identified by peaks in the profile. Oppositely, Zr, Mo and W are found in the dendrite cores. A small amount of Fe contamination was found in the primary precipitates. The strong segregation of solutes throughout the dendritic structure during casting can clearly be highlighted by comparing the composition profile for each of these elements, to the overall DCPMS composition (Table 2) shown with dashed lines in FIG. 16*a*. Depletion of solute from the matrix is due to the presence of primary precipitates in the case of eutectic elements Mn, Si, Sc, and Er. Integrating the EPMA profiles yields a composition comparable to the overall DCPMS composition shown in Table 2. A homogenization annealing of 2 h at 640° C. dissolves most of the primary precipitates and provides a more homogeneous distribution of these solutes as shown in FIG. 16*b*. Concerning the peritectic elements Zr, Mo and W, their strong segregation to the dendrite cores induce high supersaturation in these regions, surrounded by solute depleted channels. The maxima/minima in the Zr, Mo and W profiles are 0.12/0.026, 0.17/0.024, and 0.04/0 (at. %), respectively and maxima are above their respective maximum solubilities at 660° C. (in Al) as reported in the literature, with values of 0.083, 0.08 and 0.025 for Zr, Mo and W, respectively. Accordingly, precipitation of these elements upon homogenization is expected. However, due to the slow diffusivity of Mo and W, the 2 h homogenization annealing did not significantly affect the distribution of these two elements as shown by comparing their concentrations in FIGS. 16*a* and 16*b*. That is, Mo and W maintained their high supersaturation and homogenization did not occur in the interdendritic channels. However, the Zr distribution had a lower amplitude with maxima/minima at ~0.1/0.05 at. %. The presence of large $Al_3M$ precipitates enriched in Zr, Er and Sc are evidenced by the matching spikes on all three profiles. The Zr distribution is thus partially homogenized as the interdendritic concentration increases. Excess of Zr in the dendrite cores is however lost into the $Al_3M$ precipitates.

To investigate the effect of the homogenization annealing on hardness, alloys 5 and 6 have been aged at 400° C. between 10 min to 6 months, right after casting or being homogenized for 2 h with the microhardness results shown in FIG. 17. As-cast hardness of 307±14 and 334±12 MPa were measured in Alloy 5 and Alloy 6, respectively and homogenization for 2 h at 640° C. did not significantly affect the microhardness (310±9 and 332±12 MPa for Alloy 5 and Alloy 6, respectively). As cast electrical conductivity 18.9 and 16.3 (±0.04) $MS \cdot m^{-1}$ are measured for Alloy 5 and Alloy 6 respectively, with the lower electrical conductivity for the latter being due to the presence of Mo. The homogenization annealing induced a small increase of 0.1 and 0.05 $MS \cdot m^{-1}$ for Alloy 5 and Alloy 6, respectively. This change is much smaller than what was measured for Alloy 1 and the 0.25Mn-011Mo— modified Alloy 4 (i.e., 0.5 MS.m-1) (cf. FIG. 10). Considering the change in microstructure observed by EPMA (FIG. 16), it can be estimated that the increase of electrical conductivity induced by the Zr solutes lost into the large $Al_3M$ is compensated by the dissolution of the primary Er—Si- and Si-Mn-rich primary precipitates. Addition of W thus might have an effect on the homogenization process, slowing the precipitation of Zr and allowing to keep it in solution. Comparing the as-homogenized microhardness with the one of the base alloy 1 (266±10 MPa), differences of 44 and 80 MPa are measured in Alloy 5 and Alloy 6, respectively. This solid solution strengthening is induced by the Mn, and Mo (when present) addition. The solid solution strengthening of the two Mn+Mo containing Alloy 2 and Alloy 6 is comparable (~90 MPa). It can thus be concluded that W addition do not produce significant solid solution strengthening at the level of 0.025 at. %.

During aging at 400° C., although within experimental error, the homogenized Alloy 5 shows slightly higher microhardness compared to the non-homogenized condition (~20 MPa) as shown in FIG. 17*a*. A peak hardness of 660±12 MPa was reached in 16 and 24 h, for the homogenized and non-homogenized samples, respectively. Also similar microhardnesses, are obtained for longer aging duration of both homogenization conditions. After aging at 400° C. for 6 months, Alloy 5 displays a microhardness of 506±18 MPa. In the case of Alloy 6, in the nonhomogenized state it needs 24 h at 400° C. to reach a peak hardness of 660±18 MPa as is comparable to Alloy 5. In the homogenized state, Alloy 6 needs only 8 h to reach 697±15 MPa and maintains this level up to 48 h. A slow decrease of hardness is observed when the sample is further aged.

The electrical conductivity curves show large discrepancies beyond peak aging for Alloy 5 and Alloy 6, even on samples that underwent the same heat treatment (FIG. 19*c*) and is not possible to correlate electrical conductivity change to microhardness. The electrical conductivity curve "apparent" rate of change at long aging duration is only due to the semi-log display. Since these discrepancies appear at long durations, i.e. >48 h for the homogenized samples, it can be considered that this is related to the precipitation of the α-AlMnSi and α-Al(Mn,Mo)Si phase in Alloy 5 and Alloy 6, respectively, since the $L1_2$ precipitation is completed in ~24 h. At 6 months, the electrical conductivity of homogenized and non-homogenized samples, for both Alloy 5 and Alloy 6 are drastically different, but do not translate into different microhardness values.

While homogenization of Alloy 5 does not yield drastic change in microhardness upon aging, it is likely to affect more drastically other mechanical properties, such as tensile testing or creep deformation. The benefit of homogenizing is however much clearer for Alloy 6, with an increase in peak hardness and a reduction of processing time for the alloy. The more homogeneous distribution of Zr, Sc and Er solutes is expected to reduce the width of the $L1_2$ precipitate free interdendritic areas, and thus improve creep properties. While Alloy 5 and Alloy 6 show a peak hardness of 660 MPa when not homogenized, the base Al—Zr—Sc—Er—Si alloy (Alloy 1) and the Mn-Mo-modified Alloy 4 reach peak hardnesses of only 450 and 490 MPa, respectively.

Isothermal Aging at 400° C.

Referring to FIG. 18*a*, a plot of the change in the Vickers microhardness as a function of aging time at 400° C. for Alloy 5 and Alloy 6 is shown and the associated electrical conductivity curves are shown in FIG. 18*d*. The Vickers microhardness of Alloy 1 and Alloy 2 (+Mo/Mn) are also shown in FIG. 18*a* for comparison. Unlike Alloy 1 and Alloy 2 that needed an incubation time of 20 min at 400° C. before any precipitation strengthening was observed, the two W modified alloys (i.e., Alloy 5 and Alloy 6) show significant strengthening (about 65 MPa) after 10 min of aging. The Mo free Alloy 5 with W addition reached a plateau of hardness of 660±18 MPa after 16 h, and up to 24 h, of aging. This peak hardness is 86 MPa higher than the peak hardness of Alloy 1, and comparable to the peak hardness of alloy 2. Alloy 2 however had higher solid solution strengthening stemming from Mo addition. It can thus be estimated that the presence of W induces significant change in $L1_2$ precipitation and its associated strengthening, possibly affecting nucleation and growth kinetics of the $L1_2$ precipitates. Beyond peak aging, a slow decrease of hardness is observed, reaching 506±18 MPa at 6 months of aging. The difference between Alloy 1 and Alloy 5 is roughly 100 MPa and this difference is maintained for aging times of at least 6 months. These results thus hint that the slow diffusing W does not significantly affect the coarsening resistance of the $L1_2$ precipitates. Alloy 2 however displays slower decrease of microhardness with time due to the Mo addition and its effect on coarsening of the $L1_2$ precipitates, and its effect on the precipitation and coarsening of the α-Al(Mn,Mo)Si phase. The strengthening from α-Al(Mn,W)Si precipitates in the Mo-free Alloy 5 thus might be lower.

In the case of the Mo—Mn—W containing Alloy 6, the peak hardness of 697±15 MPa is reached in 8 h (FIG. 18*a*), $1/3^{rd}$ the time needed for Alloy 1. This peak hardness is 122 and 42 MPa higher than the peak hardness of Alloy 1 and Alloy 2, respectively. While the difference in peak values between Alloy 5 and Alloy 6, of ~40 MPa can be attributed to Mo solid solution strengthening, the joint addition of Mo and W affects the precipitation kinetic. Over time, the difference of hardness between Alloy 5 and Alloy 6 increases to ~50 MPa even while Mn solid solution strengthening decreases due to precipitation of α-Al(Mn,Mo,W)Si phase, as observed in Alloy 2. This highlights the positive effects of Mo on coarsening kinetics, i.e., at 6 months Alloy 6 displays a hardness of 550±8 MPa.

For both W containing alloys (Alloy 5 and Alloy 6), it was observed that precipitation kinetics were accelerated, but, unlike Mo, the slow diffusion of W does not seem to slow $L1_2$ precipitate coarsening kinetics. Accordingly, joint additions of Mo and W takes advantage of both elements and further increases the alloy's mechanical properties.

Isothermal Aging at 425° C.

Referring to FIG. 20*b*, the evolution of the Vickers microhardness as a function of aging time at 425° C. for Alloy 1, the Mo—Mn modified Alloy 2, the Mn—W modified Alloy 5 and the Mo—Mn—W modified Alloy 6 is shown. At 425° C., 10 min of aging induces observable additional nanoprecipitation strengthening in Alloy 2, 5 and 6, compared to the homogenized microhardness value. The Vickers microhardness then increases rapidly. For Alloys 2, 5 and 6 the microhardness curves display a plateau starting at 4 h. For Alloy 2, the plateau has a microhardness value of 557±11 MPa and increases with aging time, achieving 588±12 MPa after 6 days, and decreases to 495±8 MPa after aging for 6 months. The plateaus of microhardness of the Alloy 5 and Alloy 6 are closer to each other, i.e., 614 and 628±14 MPa respectively. While for Alloy 5, the microhardness starts to decrease at 16 h, the microhardness of Alloy 6 stays constants up to 24 h and shows the enhanced coarsening resistance due to the addition of Mo. Also, the reduction in hardness Alloy 6 occurs at a slower rate than Alloy 5 due to the Mo addition with microhardnesses of 427 and 453±8 MPa reached at 6 months for Alloy 5 and Alloy 6, respectively. Although the peak of the microhardness of Alloy 2 is not as high as the peaks of microhardness for Alloy 5 and Alloy 6, the slower increase of hardness may have delayed the loss of microhardness for Alloy 2. At this temperature, Alloy 2 displays the highest long-term microhardness.

Isothermal Aging at 450° C.

Referring to FIG. 18*c*, the evolution of the Vickers microhardness as a function of aging time at 450° C. for Alloys 1, 2, 5 and 6 are shown. For the two W-free alloys (Alloys 1 and 2), the hardness started increasing after 20 min of aging and slowly reaches plateaus of hardness. Alloy 1 displays a plateau of hardness of ~400 MPa after 8 h and up to 21 days, before decreasing to ~350 MPa after 3 months, while Alloy 2 reaches a plateau of ~460 MPa after 4 h and is stable up to 1 day before slowly decreasing to ~400 after 6 months. In comparison, the microhardnesses of Alloy 1 aged either at 425° C. or 450° C. are the same at 21 days and beyond. A microhardness of 300 MPa at 6 months can thus be extrapolated at 450° C. From the initial ~90 MPa difference between the Alloy 1 and Alloy 2 due to solid solution strengthening from Mo and Mn addition, this value decreases with increasing aging time down to 40±10 MPa. This smaller difference and the earlier aging peak can be attributed to faster diffusion of Mo at 450° C. (~5 time faster than at 400° C.) and its precipitation to form α-Al(Mn,Mo)Si, which induces loss of solid solution strength. Beyond 21 days at 400° C., Alloy 1 loses microhardness faster than Alloy 2, confirming the longer high temperature stability induced by Mo and Mn addition.

In the case of the W containing Alloy 5 and Alloy 6, significant increase of hardness is already observed after 10 minutes at 450° C., before drastically increasing and reaching a beginning of a plateau in 2 h. Unlike at lower temperatures, alloy 5 achieves slightly higher peak hardness value than alloy 6. At the beginning of the plateau, alloy 5 and 6 respectively displays hardnesses of 551 and 522±10 MPa. It then reaches peak values of 569±9 MPa after 8 h and 544±6 MPa after 16 h, for Alloy 5 and Alloy 6, respectively.

In the coarsening phase, between 16 h and up to 3 days, both Alloy 5 and Alloy 6 display similar hardnesses. Alloy 5 however displays poorer coarsening resistance and loses hardness more quickly, making it comparable to Alloy 2 after 11 days at 450° C. (372±8 MPa) despite its extremely high peak hardness. Due to the joint addition of Mo and W, the loss of microhardness is slower in Alloy 6, with microhardness of 407±4 MPa at 6 months. Alloy 6 displays a microhardness ~40 MPa higher than Alloy 2 and Alloy 5 at long aging durations. While the W addition increases peak microhardness and accelerates precipitation kinetics, the addition of W with Mo maintains coarsening resistance at this high temperature (i.e., 450° C.).

The achieved peak hardness, of the W-containing alloys, when directly aged at 450° C., 569±9 MPa, is comparable to peak hardness values achieved by the previous generation of Al—Sc—Er—Zr—Si alloys when aged at 400° C., FIG. 1. The hardness at 6 months of alloy 6 407±4 MPa is comparable with the one of the Si lean Al—Sc—Er—Zr—Si alloys. This highlight the drastic increase in high temperature stability of the alloys due to the joint addition of Mn, Mo and W, technically increasing the maximum exposure temperature by 50° C. without significant increase in price due to the low cost of these elements.

Characterization by Atom-Probe Tomography

Referring to FIG. 19, and based on the isothermal aging results, two samples from each of the W-containing alloys (i.e., Alloys 5 and 6), homogenized 2 h and then aged at 400° C., were selected to perform APT analyses. Particularly, a slightly overaged samples (i.e., 24 h at 400° C.) of Alloy 5 and Alloy 6 (FIGS. 19*a*, 19*c*), and overaged samples (11 days at 400° C.) of Alloy 5 and Alloy 6 (FIGS. 19*b* and 19*d*) were analyzed. These durations were chosen because APT datasets were obtained for the Alloy 1 and Alloy 2 under the same aging conditions are thus comparable directly with the results of Alloy 5 and Alloy 6. The collected datasets are shown below in Table 7 and Table 8 and indicate the precipitate distribution, tip and matrix composition and mean precipitate composition. As shown in Table 7 and 8, significant solute variation was observed from tip to tip, notably for the peritectic elements Mo and W that allows to identify the position of the tip in the dendritic structure when compared to the EPMA line scan in FIG. 16.

TABLE 7

| | | | Precipitate distribution | | | Tip composition (at. ppm) | | | | | | | |
|---|---|---|---|---|---|---|---|---|---|---|---|---|---|
| Alloy | Aging | Sample | $N_V$ ($\times 10^{22}$ $m^{-3}$) | ⟨R⟩ (nm) | φ (%) | Sc | Er | Zr | Si | Mo | Mn | W | Sc + Er + Zr |
| Alloy 5 | 400° C./24 h | 5p1 | 1.58 ± 0.75 | 2.53 ± 0.79 | 0.16 ± 0.08 | 66 | 6 | 428 | 1086 | | 2177 | 70 | 500 |
| | | 5p2 | 3.72 ± 0.84 | 2.45 ± 0.31 | 0.34 ± 0.08 | 179 | 15 | 646 | 1133 | | 1624 | 76 | 840 |
| | | 5p3† | 4.14 ± 5.76 | 2.32 ± 0.53 | 0.42 ± 0.06 | 257 | 31 | 760 | 974 | | 1517 | 179 | 1048 |
| Alloy 5 | 400° C./11 days | 5o1 | 0.81 ± 0.17 | 3.58 ± 0.99 | 0.30 ± 0.06 | 177 | 21 | 549 | 245 | | 519 | 68 | 747 |
| | | 5o2 | 1.05 ± 0.33 | 4.01 ± 1.04 | 0.52 ± 0.17 | 316 | 33 | 927 | 272 | | 1161 | 146 | 1276 |
| | | 5o3† | 0.98 ± 0.24 | 3.95 ± 0.45 | 0.41 ± 0.10 | 251 | 30 | 774 | 277 | | 1146 | 176 | 1055 |
| Alloy 6 | 400° C./24 h | 6p1† | 3.44 ± 0.29 | 2.59 ± 0.58 | 0.42 ± 0.04 | 204 | 33 | 661 | 821 | 376 | 1491 | 60 | 898 |
| | | 6p2 | 2.91 ± 0.33 | 2.4 ± 0.69 | 0.34 ± 0.04 | 228 | 36 | 557 | 939 | 439 | 1273 | 72 | 821 |
| Alloy 6 | 400° C./11 days | 6o1 | 9.33 ± 0.38 | 4.04 ± 0.82 | 0.49 ± 0.2 | 324 | 45 | 854 | 221 | 433 | 1080 | 71 | 1223 |
| | | 6o2† | 1.19 ± 0.40 | 3.95 ± 1.14 | 0.43 ± 0.14 | 206 | 24 | 835 | 211 | 478 | 882 | 73 | 1065 |
| | | 6o3 | 1.67 ± 0.63 | 3.69 | 0.60 ± 0.23 | 472 | 54 | 1196 | 209 | 441 | 483 | 80 | 1722 |
| | | 6o4† | 1.70 ± 0.64 | 3.68 ± 1.6 | 0.43 ± 0.16 | 200 | 26 | 808 | 187 | 1227 * | 1344 | 134 | 1034 |
| | | 6o5 | 2.04 ± 0.63 | 3.2 ± 0.8 | 0.63 ± 0.19 | 330 | 50 | 1145 | 241 | 1930 * | 1162 | 205 | 1525 |
| | | 606 | 1.39 ± 0.46 | 4.22 ± 0.15 | 0.39 ± 0.13 | 231 | 33 | 978 | 238 | 2296 * | 738 | 208 | 1242 |

TABLE 8

| | | | Precipitate composition (at. %) | | | | | | | | Matrix composition (at. ppm) | | | | | | | |
|---|---|---|---|---|---|---|---|---|---|---|---|---|---|---|---|---|---|---|
| Alloy | Aging | Sample | Al | Sc | Er | Zr | Si | Mo | Mn | W | Sc | Er | Zr | Si | Mo | Mn | W | Sc + Er + Zr |
| Alloy 5 | 400° C./24 h | 5p1 | 72.98 | 5.65 | 0.50 | 18.58 | 1.91 | — | 0.35 | 0.03 | ND | ND | 83 | 1055 | — | 2172 | 70 | 83 |
| | | 5p2 | 72.60 | 5.36 | 0.52 | 19.22 | 1.77 | — | 0.39 | 0.14 | 7 | ND | 79 | 1052 | — | 1617 | 73 | 86 |
| | | 5p3† | 72.38 | 7.84 | 1.03 | 15.38 | 2.75 | — | 0.51 | 0.11 | 19 | ND | 160 | 868 | — | 1505 | 176 | 179 |
| | 400° C./11 days | 5o1 | 73.96 | 6.61 | 0.84 | 17.14 | 1.16 | — | 0.25 | 0.04 | 14 | ND | 61 | 216 | — | 515 | 67 | 75 |
| | | 5o2 | 74.27 | 6.81 | 0.64 | 16.68 | 1.07 | — | 0.40 | 0.13 | 18 | ND | 129 | 228 | — | 1153 | 143 | 147 |
| | | 5o3† | 73.58 | 7.30 | 0.87 | 16.43 | 1.23 | — | 0.40 | 0.19 | 12 | ND | 82 | 240 | — | 1142 | 172 | 94 |
| Alloy 6 | 400° C./24 h | 6p1† | 71.51 | 9.28 | 1.80 | 13.29 | 3.17 | 0.47 | 0.43 | 0.05 | 6 | ND | 123 | 745 | 358 | 1486 | 58 | 129 |
| | | 6p2 | 72.60 | 7.42 | 1.21 | 15.36 | 2.43 | 0.59 | 0.34 | 0.05 | 12 | ND | 98 | 855 | 423 | 1267 | 71 | 110 |
| | 400° C./11 days | 6o1 | 72.77 | 5.78 | 0.64 | 18.76 | 0.62 | 1.04 | 0.27 | 0.12 | 20 | ND | 72 | 175 | 404 | 1069 | 69 | 92 |
| | | 6o2† | 73.41 | 6.13 | 0.76 | 18.04 | 0.78 | 0.62 | 0.21 | 0.05 | 19 | ND | 78 | 188 | 452 | 878 | 71 | 97 |
| | | 6o3 | 72.82 | 6.67 | 1.01 | 16.94 | 0.99 | 0.98 | 0.47 | 0.12 | 32 | ND | 162 | 121 | 391 | 466 | 77 | 194 |
| | | 6o4† | 73.08 | 5.38 | 0.68 | 18.69 | 0.74 | 1.15 | 0.14 | 0.14 | 22 | ND | 89 | 167 | 1190 | 1351 | 132 | 111 |
| | | 6o5 | 72.55 | 6.51 | 1.05 | 17.33 | 0.90 | 1.23 | 0.26 | 0.17 | 26 | ND | 137 | 190 | 1880 | 1147 | 203 | 163 |
| | | 6o6 | 72.61 | 6.14 | 0.87 | 17.42 | 1.05 | 1.51 | 0.29 | 0.11 | 33 | ND | 134 | 213 | 2260 | 730 | 206 | 167 |

The volumes with 80 at.ppm W or less are from the interdendritic channels while 140 at.ppm W or higher characterize the dendrite cores. Mo is seen to follow the same trend but at level 480 at.ppm or less for the channels and above 1200 at.ppm for the cores. Although the homogenization annealing allowed to improve Zr homogeneity, variation in $L1_2$ precipitate formation was also observed. FIG. 19 displays 3D volume rendering of Zr, Sc and Er, and FIG. 20 displays their associated proximity histogram. The specific tips having a total content of $L1_2$ precipitates close to 1000 at.ppm, comparable with the amount found in Alloy 1 and Alloy 2, and marked with the symbol '†' in tables. Determination of concentration by APT being based on counting statistic, the gray area in the proxigrams (FIG. 20) indicate the detection limit of 1 at/bin, post background subtraction. This limit allows to better assess the concentration level measured in the precipitates' core where the counting statistic is weaker. The mean number density, precipitate radius and volume fraction are reported in Table 3 alongside data from Alloy 1 and Alloy 2. Samples marked with an * indicate the presence of an overlap in their mass spectrum between $Mo_2^{++}$ and $Mo^{+}$, that can possibly yield to an overestimation of Mo concentration in these datasets, as the overlapping peaks were associated to the $Mo_2^{++}$ molecules.

Peak Aged Condition (24 h at 400° C.)

Referring now to FIGS. 19*a* and 19*c*, two of the collected APT datasets after 24 h of aging, for Alloy 5 and Alloy 6, respectively are displayed. Not considering the 5p1 dataset, which is sampling a region with a low amount of $L1_2$ forming elements (only 500 at.ppm), both Alloy 5 and Alloy 6 display comparable precipitate distribution (Table 3). Average number densities of 3.93±0.5 and 3.18±0.22×$10^{22}$ $m^{-3}$ and mean radii of 2.39±0.31 and 2.50±0.45 nm are measured in Alloy 5 and Alloy 6, respectively. The same volume fraction of 0.38±0.05% is measured in both alloys and indicates Mo additions do not significantly affect the early nucleation and growth of the $L1_2$ precipitates. And this confirms the difference in microhardness between Alloy 5 and Alloy 6 is a result of a difference in solid solution strengthening.

The base Mn—Mo—W-free Alloy 1 had a number density of $L1_2$ precipitates of 3.56±0.34×$10^{22}$ $m^{-3}$, a larger mean radius of 2.66±0.55 nm and lower volume fraction of 0.33±0.03%. Both W-containing alloys (Alloy 5 and Alloy 6) thus achieve higher volume fraction, than Alloy 1 and Alloy 2, while maintaining smaller precipitates radii, even for the Mo-free alloy. In addition to the solid solution strengthening induced by Mn and Mo addition, the higher volume fraction reduces the distance between precipitates and their smaller sizes makes them more efficient at blocking dislocation motion, this mechanism being the limiting factor at the considered precipitate radii (Table 6). These two characteristics are thus the origin behind the increased peak hardness. As previously mentioned, the time to reach peak hardness were 16 h and 8 h, for Alloy 5 and Alloy 6, respectively, which is significantly faster than the 24 h needed for Alloy 1 and Alloy 2. For the APT datasets collected on samples aged for 24 h (FIGS. 19*a*, 19*c*), the precipitate distributions are actually slightly overaged. This could explain the larger precipitate size observed when compared to Alloy 2. This point also highlights the accelerated precipitation kinetics induced by the W addition, which provides an increase the volume fraction of $L1_2$. Considering the matrix composition of tips containing ~1000 at.ppm of Sc+Er+Zr, samples 5p3, 6p1 and 6p2 in (Table 8), and compare it with the one of Alloy 2 (Table 4), it can be noticed that larger quantity of $L1_2$ forming elements is removed from the matrix to form the precipitates. Overall, only 11-17% of these solutes remains in the matrix of Alloy 5 and Alloy 6 after 24 h of aging, compared with 35% for Alloy 2. The W addition thus possibly affects the driving force for precipitation by affecting the solubility limits of Sc, Er and Zr and Al, and provides more efficient use of these elements. In the case of the solute depleted volume 5p1 (Table 7) with only 500 at.ppm Sc+Er+Zr, with concentrations comparable to the interdendritic channels (FIG. 16*b*), although the volume fraction is low (0.16%), the sample still exhibits a high number density of precipitates (1.6×$10^{22}$ $m^{-3}$) with radii of 2.53±0.79 nm. This indicates that the precipitates are forming in these low solute regions despite the low solute concentration in the interdendritic channels. Unlike previous Zr-based aluminum alloy, the interdendritic channels are thus also precipitation strengthened.

Referring to FIGS. 20*a* and 20*c*, the proximity histograms of Alloy 5 and Alloy 6, respectively, aged 24 h at 400° C. are shown. For both Alloy 5 and Alloy 6, the $L1_2$ precipitates display the usual core-shell structure observed in the $L1_2$ strengthened Alloy 1. The core is enriched in the fast diffusing Sc (17-18%), Er (5-7%) and Si (5-10%), while the shell is enriched in Zr (20-23%). As previously observed in Alloy 2 (cf. FIG. 4*b*), increased concentration of Mn is found in the core for both Alloy 5 and Alloy 6 (1-2%), while the Mo profile displays an enrichment up to 0.8% in the shell, along with Zr, in the Mo-containing Alloy 6, with a concentration of ~0.25% in the precipitates. Segregation of W in the shell is observed for both alloys, with maximum at 0.2%. Unlike Mo that displays a constant concentration throughout the precipitate, besides the increased concentration in the shell, the W concentration increases also closer to the core with up to 0.6 at % for certain samples. While the co-precipitation of Mn with Sc, Er and Si in Alloy 2 is likely due to its (Mn) relatively high diffusivity, finding W in the core is unexpected as this element is diffuses extremely slow. Such find would agree with the microhardness data that strongly suggested accelerated precipitate nucleation/growth with W affecting the formation of the precipitates nuclei and potentially being an inoculant element like Si. Calculations are needed to investigate the bonding energy of W with the elements present in the system. The observed segregation of W in the precipitate shell is however certainly diffusion limited as its distribution follows the similarly slow Mo distribution.

Over Aged Condition (11 Days at 400° C.)

Referring to FIGS. 19 *b* and 19*d*, two of the collected APT datasets after 11 days of aging for Alloy 5 and Alloy 6, respectively, are shown. As it can be observed when compared with peak aged samples, the number density of $L1_2$ precipitates decreased during aging, while their radii increased due to Ostwald ripening. Both overaged Alloy 5 and Alloy 6 display similar precipitate distribution, with average number densities of 0.94±0.14 and 1.49±0.22×$10^{22}$ $m^{-3}$, and mean radii of 3.85±0.51 and 3.80±0.39 nm, for Alloy 5 and Alloy 6, respectively. The overall volume fraction is significantly higher for Alloy 6, with 0.49% vs 0.41% for Alloy 5. While the mean radii and number densities are relatively comparable between the two alloys, when compared to peak aged conditions, the mean radius increased slightly faster for the Mo-free Alloy 5. However, in comparison with Alloy 1 and Alloy 2 having mean radii of 3.37±0.66 and 3.09±0.63, respectively, the W-containing Alloys 5 and 6 display significantly larger precipitate radii. Although the larger precipitate radius is less efficient at blocking dislocation motion at room temperature, the increased volume fraction, most particularly for Alloy 6 counterbalance this loss, as evidenced by the microhardness values of Alloy 2 and Alloy 6 at 11 days shown in FIG. 18*a*. Similarly, at peak aged conditions, a higher consumption of Sc+Er+Zr is observed in the W-containing Alloys 5 and 6, with 8-12% of these solutes remaining in the matrix compared to 16% for Alloy 2 thereby explaining the higher volume fraction and larger precipitate radii.

Referring to FIGS. 20 *b* and 20*d*, the proximity histograms of Alloy 5 and Alloy 6, respectively, aged 24 h at 400° C. are shown. For both Alloys 5 and 6, the $L1_2$ precipitates display a slightly homogenized core-shell structure when compared to the peak aged nanostructure (FIGS. 20*a*, 20*c*) with more Zr present in the core and a larger shell. This was also observed in Alloy 1 and Alloy 2. For Alloy 5, the core concentration is up to 18% Sc, 3-4% Er, 4% Zr, 5% Si, 1% Mn and the concentrations of Sc, Er, Si and Mn progressively decrease toward the interface, with Zr increasing up 22% in the shell. The W is found dissolved at 0.2-0.3 at % throughout the precipitates, which is an amount comparable to what was found in the nanoprecipitate shell at peak aging condition. This thus confirms that the interfacial segregation of W observed at peak aging is a kinetic effect, with W diffusing more slowly in the $L1_2$ precipitate than in the matrix. The same trends are observed in Mo-containing Alloy 6, with a concentration of 1% Mo found throughout the precipitates. This homogeneous distribution of Mo was also found in Alloy 2 (FIG. 4*d*). However, a major difference is found in the concentration in Mn and Si. Particularly, while the $L1_2$ precipitates in Alloy 5 and Alloy 6 display overall Si concentration of 0.6-1%, and Mn of 0.2-0.5% after aging for 11 days (Table 8), concentrations of 0.15% Si and Mn were found in the overaged Alloy 2 (Table 4). This increased content in Alloys 5 and 6 correlates with the higher tip content in Si and Mn, after 11 days, for Alloy 5 and Alloy 6, of roughly at 200-250 at.ppm Si and ~500-1000 at. ppm Mn (Table 8), when compared with the 60 at.ppm Si and 455 at.ppm Mn found in the overaged Alloy 2 (Table 5). The lower Si and Mn tip content observed in Alloy 2 was associated with the consumption of these species to form the α-Al(Mn,Mo)Si phase, with Si and Mn atoms diffusing out of the $L1_2$ precipitates due to the low matrix concentration. It can also be seen that higher local W concentration due to peritectic segregation correlate with lower Mn concentration (Table 7). On peak aged samples, no variation in Mn concentration in the tip was observed between samples low or rich in W, thus indicating good Mn homogenization. The lower overall consumption of Si and Mn observed in Alloy 5 and Alloy 6, but also the W/Mn correlation are thus an indication that W affects the growth of the α-Al(Mn,Mo,W) Si phase. This is expected to result in a smaller α-precipitate population, which would produce higher precipitation strengthening, although at a lower volume fraction. This effect is potentially stronger at higher temperatures and would explain the strong increase of peak hardness observed when aged at 450° C. (FIG. 18*c*) where Mo and W diffusivities become more significant. Maintaining a higher concentration of Si in the matrix of the alloy can however induce faster $L1_2$ precipitate coarsening (e.g., Alloy 2), as Si increases Zr, Sc and Er solute diffusivities thereby accelerating diffusion limited Ostwald ripening. Although the W addition improves peak hardness and reduces processing time, it appears to, at least indirectly, induce a negative effect on the coarsening resistance of the $L1_2$ precipitates by affecting the matrix Si concentration. The overall mechanical properties are however maintained due to the higher achieved volume fraction.

It should be understood from the teachings of the present disclosure that micro-additions of W accelerate precipitation kinetics of a dilute Al-0.08Zr-0.025Sc-0.008Er-0.10Si-0.26Mn (at. %) alloy and micro-additions of W and Mo significantly increased peak hardness while decreasing processing time by a factor of 3. In addition, the following variations are provided.

The Al-0.08Zr-0.024Sc-0.008Er-0.11Si-0.26Mn-0.12Mo-0.028W alloy (Alloy 6) displayed increased peak hardness, while maintaining coarsening resistance up to 450° C. Also, W segregates with Zr and Mo into dendrite cores and thereby confirms the peritectic segregation of this element upon casting.

In other variations, Er—Si-rich and α-AlMnSi precipitates are found as-cast structures and most these precipitates are dissolved after homogenization for 2 h at 640° C., allowing to recover the solutes that was trapped into them. While the Mo and W concentration profiles do not appear to be affected by the homogenization annealing, the Zr distribution appears to partially homogenize, preventing formation of $L1_2$ precipitates free region.

Unlike previous Al—Zr—Sc—Er—Si(—Mn—Mo) alloys, direct aging of non-homogenized W-containing alloys still produce high precipitation strengthening. The homogenization of the alloys allows to further increase peak hardness on a subsequent aging, while reducing the processing time. The long-term microhardness values are not affected by homogenization annealing.

Replacing Mo by the equally slow W did not promote improved $L1_2$ coarsening resistance. On the contrary W is found to increase precipitation kinetic, in the investigated temperature range of 400-450° C., reducing processing time, i.e. from 24 h down to 8 h when aged at 400° C.

Higher peak microhardnesses values are reached when W is added. Joint addition with Mo further increases the peak microhardness. Al—Zr—Sc—Er—Si—Mn—Mo—W achieves 697±15 MPa in 8 h at 400° C.

The peak hardness observed after direct aging at 450° C. have been drastically improved by W addition, up to 569±9 MPa at peak aging, which slowly decrease down to ~400 MPa after 6 months when Mo is also added. The microhardness achieved for the Mn—Mo—W containing alloys aged at 450° C. is comparable to previous generations of Al—Zr—Sc—Er—Si alloy aged at 400° C. The newest alloy thus allows to reach higher service temperature without significant cost increase.

The Mo free Al—Zr—Sc—Er—Si—Mn—W alloy displays a weaker coarsening resistance than the Mo containing alloys. Adding both Mo and W thus synergistically increase peak hardness, reduce processing time and improve coarsening resistance.

The addition of W induces formation of higher volume fraction of $L1_2$ precipitates, explaining the improved peak hardness, while the faster precipitation kinetic is correlated to the presence of W in the precipitate core, alongside Sc, Er, Si and Mn. Tungsten is also found to enrich the shell of these nanoprecipitate alongside Zr, and Mo.

The core-shell structure of the $L1_2$ precipitates homogenize during overaging, notably for Mo and W, at level of 1.0 and 0.3 at. %, respectively. This solubility in the $L1_2$ structure is expected to affect lattice parameter mismatch with the matrix.

By monitoring the tip and matrix composition, the consumption of Si and Mn allows indirect following of the precipitation of the α-Al(Mn,Mo,W) Si phase. When compared with prior data on W-free alloy, it appears that W reduce the consumption of Si and Mn, meaning it reduces the growth of the α-precipitates.

The composition of $\alpha$-$Al_{12-x}(Mn,Mo,W)_{2.4+x}Si_2$ was estimated by APT. A Zr solubility of 0.14 at. % was found. Er and Sc segregation was detected at the α-precipitate/matrix interface. This segregation is considered to results from an easier diffusion pathway of these fast diffusing species as the precipitate grows. When in too high excess, $L1_2$ precipitates are nucleated in contact with the α-precipitate, confirmed by TEM observations.

The composition of a large $L1_2$ precipitate, formed upon homogenization, was done by APT. Careful analysis of the concentration profiles allowed to determine Mo site occupancy in $Al_3M$ on the Al sublattice alongside Si, resulting in labelling as $L1_2$-$(Al,Si,Mo)_3(Zr,Sc,Er)$. Solubilities of the different elements in $Al_3Zr$ is estimated.

While the alloys discussed above used Fe, Mn, Mo and/or W, it should be understood that in at least one variation of the present disclosure the alloy include Mg for solid solution strengthening. In such a variation, more than 0.0 at. % and less than or equal to 5.0 at. % Mg is included in the allow. For example, in one variation the alloys include greater than 0.0 at. % and less than or equal to 2.5 at. % Mg, or in the alternative, greater than 0.0 at. % and less than or equal to 2.0 at. % Mg. In addition, and while the alloys discussed above are enriched in Sc and Er, in some variations of the present disclosure the alloys are enriched with one or more other rare earth elements such as Ce, Dy, Eu, Gd, Ho, La, Lu, Nd, Pr, Pm, Sm, Tb, Tm, Yb, and Y, as well as one or more early transition metals such as Ti, Hf, Rf, V, Nb, Ta, Db, Cr, Sg, Tc, Re, and Bh.

It should be understood that while the chemical formulas for the $L1_2$, Fe-free α-Al(Mn,M')Si, α-Al(Mn,M")Si, $Al_6Mn$, and $Al_{12}Mn$ precipitates are shown with whole number subscripts, including no subscript corresponding to 1.0, such subscripts can include a range of values between 0.0 and 1.0, i.e., each of the precipitates disclosed herein can have a stochiometric range. It should also be understood that values for alloy element concentration disclosed herein are presented as atom percent where or not atom percent, atom %, at. % or % proceeds or follows such a value. For example, the alloy "Al-0.08Zr-0.024Sc-0.008Er-0.11Si-0.26Mn-0.12Mo-0.028W" should be read or interpreted as Al—0.08 at. % Zr—0.024 at. % Sc—0.008 at. % Er-0.11 at. % Si-0.26 at. % Mn-0.12 at. % Mo—0.028 at. % W (with or without incidental impurities), values such as "Mn of 0.2-0.5%" should be read or interpreted as "Mn 0.2 at. %-0.5 at. %" and values such as "scandium greater than 0.0 and less than or equal to 0.045" should be read or interpreted as "scandium greater than 0.0 at. % and less than or equal to 0.045 at. %."

Unless otherwise expressly indicated herein, all numerical values indicating mechanical/thermal properties, compositional percentages, dimensions and/or tolerances, or other characteristics are to be understood as modified by the word "about" or "approximately" in describing the scope of the present disclosure. This modification is desired for various reasons including industrial practice; material, manufacturing, and assembly tolerances; and testing capability.

As used herein, the phrase at least one of A, B, and C should be construed to mean a logical (A OR B OR C), using a non-exclusive logical OR, and should not be construed to mean "at least one of A, at least one of B, and at least one of C."

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. An aluminum alloy consisting of, in atom %:
scandium greater than 0.0 and less than or equal to 0.15;
zirconium greater than 0.0 and less than or equal to 0.35;
erbium greater than 0.0 and less than or equal to 0.15;
silicon greater than 0.0 and less than or equal to 0.2;
at least one of molybdenum greater than 0.0 and less than or equal to 0.75 and tungsten greater than 0.0 and less than or equal to 0.35;
manganese greater than 0.0 and less than or equal to 1.5;
optionally iron less than or equal to 0.1; and
balance aluminum.

2. The aluminum alloy according to claim 1, wherein the total amount of Zr+Er+Sc is greater than or equal to 0.1.

3. The aluminum alloy according to claim 1, wherein the scandium is greater than 0.0 and less than or equal to 0.025.

4. The aluminum alloy according to claim 1, wherein the zirconium is greater than 0.0 and less than or equal to 0.1.

5. The aluminum alloy according to claim 1, wherein the erbium is greater than 0.0 and less than or equal to 0.01.

6. The aluminum alloy according to claim 1, wherein the silicon is greater than 0.0 and less than or equal to 0.1.

7. The aluminum alloy according to claim 1, wherein the molybdenum is greater than 0.0 and less than or equal to 0.2.

8. The aluminum alloy according to claim 1, wherein the tungsten is greater than 0.0 and less than or equal to 0.05.

9. The aluminum alloy according to claim 1, wherein the manganese is greater than 0.0 and less than or equal to 0.5.

10. The aluminum alloy according to claim 1 further comprising iron greater than 0.0 and less than or equal to 0.1.

11. The aluminum alloy according to claim 1, wherein:
scandium is greater than 0.0 and less than or equal to 0.045;
zirconium is greater than 0.0 and less than or equal to 0.1;
erbium is greater than 0.0 and less than or equal to 0.07;
silicon is greater than 0.0 and less than or equal to 0.1;
molybdenum is greater than 0.0 and less or equal to 0.2;
tungsten is greater than 0.0 and less than or equal to 0.05; and
manganese is greater than 0.0 and less than or equal to 1.1.

12. The aluminum alloy according to claim 11 further comprising iron greater than 0.0 and less than or equal to 0.045.

13. The aluminum alloy according to claim 12, wherein the iron is greater than 0.0 and less than or equal to 0.02.

14. The aluminum alloy according to claim 1, wherein the alloy comprises $L1_2$ precipitates and at least one of α-Al(Mn,M")Si precipitates, $Al_6Mn$ precipitates and $Al_{12}Mn$ precipitates where M" is at least one of Fe, Mn, Mo and W.

15. The aluminum alloy according to claim 14, wherein the alloy $L1_2$ precipitates comprise $Al_3M$ precipitates where M is selected from the group consisting of one or more rare earth elements, one or more early transition metals, and combinations thereof.

* * * * *